US007780474B2

(12) United States Patent
Ito

(10) Patent No.: US 7,780,474 B2
(45) Date of Patent: Aug. 24, 2010

(54) HIGH SPEED TRANSMISSION CONNECTOR WITH SURFACES OF GROUND TERMINAL SECTIONS AND TRANSMISSION PATHS IN A COMMON PLANE

(75) Inventor: Toshiyasu Ito, Tougane (JP)

(73) Assignee: Yamaichi Electronics Co., Ltd., Tokyo (JP)

( * ) Notice: Subject to any disclaimer, the term of this patent is extended or adjusted under 35 U.S.C. 154(b) by 7 days.

(21) Appl. No.: 11/902,474

(22) Filed: Sep. 21, 2007

(65) Prior Publication Data

US 2009/0068887 A1 Mar. 12, 2009

(30) Foreign Application Priority Data

Aug. 3, 2007 (JP) ..... 2007-203274

(51) Int. Cl.
*H01R 13/648* (2006.01)

(52) U.S. Cl. ..... 439/607.05

(58) Field of Classification Search ..... 439/608, 439/108, 61, 79, 701, 941
See application file for complete search history.

(56) References Cited

U.S. PATENT DOCUMENTS 4,846,727 A 7/1989 Glover et al.
4,975,084 A 12/1990 Fedder et al.
5,104,341 A 4/1992 Gilissen et al.
5,215,473 A * 6/1993 Brunker et al. ..... 439/108
5,645,436 A 7/1997 Shimizu et al.
6,409,543 B1 6/2002 Astbury, Jr. et al.
6,461,202 B2 10/2002 Kline
6,517,360 B1 2/2003 Cohen
6,540,522 B2 * 4/2003 Sipe ..... 439/61
6,551,140 B2 * 4/2003 Billman et al. ..... 439/608
6,602,095 B2 8/2003 Astbury, Jr. et al.
6,623,302 B2 9/2003 Billman et al.
6,623,310 B1 9/2003 Billman et al.
6,634,908 B1 10/2003 Billman et al.
6,638,079 B1 10/2003 Billman et al.
6,638,110 B1 10/2003 Billman
6,641,438 B1 11/2003 Billman
6,645,009 B1 11/2003 Billman et al.
6,652,318 B1 11/2003 Winings et al.
6,652,319 B1 11/2003 Billman
6,663,401 B2 12/2003 Billman et al.
6,663,427 B1 12/2003 Billman et al.
6,682,369 B1 1/2004 Korsunsky et al.
6,692,272 B2 2/2004 Lemke et al.
6,692,305 B2 2/2004 Nelson et al.
6,705,895 B2 3/2004 Hasircoglu
6,712,646 B2 3/2004 Shindo
6,739,918 B2 * 5/2004 Cohen et al. ..... 439/701
6,746,278 B2 6/2004 Nelson et al.

(Continued)

FOREIGN PATENT DOCUMENTS

JP 2002-75544 3/2002

(Continued)

*Primary Examiner*—Chandrika Prasad
(74) *Attorney, Agent, or Firm*—Finnegan, Henderson, Farabow, Garrett & Dunner, LLP

(57) ABSTRACT

Each of the ground contact terminals of a contact unit has a pair of bifurcated terminals located on opposite sides of a pair of transmission contact terminals formed adjacent to each other.

15 Claims, 63 Drawing Sheets

U.S. PATENT DOCUMENTS

| | | | | |
|---|---|---|---|---|
| 6,749,468 | B2 | 6/2004 | Avery | |
| 6,764,340 | B2 | 7/2004 | Toda | |
| 6,764,349 | B2 | 7/2004 | Provencher et al. | |
| 6,769,935 | B2 | 8/2004 | Stokoe et al. | |
| 6,808,399 | B2 | 10/2004 | Rothermel et al. | |
| 6,808,419 | B1 | 10/2004 | Korsunsky et al. | |
| 6,817,868 | B2 | 11/2004 | Matsuo et al. | |
| 6,827,611 | B1 | 12/2004 | Payne et al. | |
| 6,843,686 | B2 * | 1/2005 | Ohnishi et al. | 439/608 |
| 6,848,917 | B2 | 2/2005 | Lang et al. | |
| 6,851,980 | B2 | 2/2005 | Nelson et al. | |
| 6,863,549 | B2 * | 3/2005 | Brunker et al. | 439/108 |
| 6,872,085 | B1 | 3/2005 | Cohen et al. | |
| 6,875,031 | B1 | 4/2005 | Korsunsky et al. | |
| 6,884,117 | B2 | 4/2005 | Korsunsky et al. | |
| 6,890,215 | B2 | 5/2005 | Lang et al. | |
| 6,918,789 | B2 | 7/2005 | Lang et al. | |
| 6,923,664 | B2 | 8/2005 | Ito et al. | |
| 6,945,787 | B2 | 9/2005 | Matsuo | |
| 6,976,886 | B2 | 12/2005 | Winings et al. | |
| 6,986,682 | B1 | 1/2006 | Jeon | |
| 6,988,902 | B2 | 1/2006 | Winings et al. | |
| 6,994,569 | B2 | 2/2006 | Minich et al. | |
| 7,040,901 | B2 | 5/2006 | Benham et al. | |
| 7,044,793 | B2 | 5/2006 | Takemasa | |
| 7,059,907 | B2 | 6/2006 | Winings et al. | |
| 7,083,432 | B2 | 8/2006 | Hull et al. | |
| 7,094,102 | B2 | 8/2006 | Cohen et al. | |
| 7,101,191 | B2 | 9/2006 | Benham et al. | |
| 7,108,556 | B2 | 9/2006 | Cohen et al. | |
| 7,112,098 | B2 | 9/2006 | Matsuo et al. | |
| 7,114,964 | B2 * | 10/2006 | Winings et al. | 439/79 |
| 7,118,391 | B2 * | 10/2006 | Minich et al. | 439/79 |
| 7,121,889 | B1 | 10/2006 | Jeon | |
| 7,131,870 | B2 * | 11/2006 | Whiteman et al. | 439/608 |
| 2002/0123254 | A1 * | 9/2002 | Kato et al. | 439/108 |
| 2003/0153202 | A1 | 8/2003 | Koyama | |
| 2004/0092143 | A1 * | 5/2004 | Fromm et al. | 439/108 |
| 2006/0042829 | A1 | 3/2006 | Matsuo et al. | |

FOREIGN PATENT DOCUMENTS

| | | |
|---|---|---|
| JP | 3326507 | 7/2002 |
| JP | 3470318 | 9/2003 |
| JP | 2004-521448 | 7/2004 |
| JP | 2004-363032 | 12/2004 |
| JP | 3754959 | 12/2005 |
| WO | WO 02/060011 | 8/2002 |

* cited by examiner

| | Lout | Lin | ΔL |
|---|---|---|---|
| PL1 | 38.1 | 36.87 | 1.23 |
| PL2 | 32.19 | 30.94 | 1.25 |
| PL3 | 26.26 | 25.02 | 1.24 |
| PL4 | 21.09 | 19.84 | 1.25 |
| PL5 | 15.95 | 14.71 | 1.24 |
| PL6 | 10.81 | 9.57 | 1.24 |

FIG.21

| | CT | Side | Length | Ave | ΔL |
|---|---|---|---|---|---|
| PLUG | PPL1 | LOUT | 5.416 | 5.491 | 0.711 |
| | | LIN | 5.566 | | |
| | PPL2 | LOUT | 6.127 | 6.202 | |
| | | LIN | 6.277 | | |
| SOCKET | SL1 | LOUT | 5.44 | 5.62 | 0.89 |
| | | LIN | 5.8 | | |
| | SL2 | LOUT | 6.35 | 6.51 | |
| | | LIN | 6.67 | | |

FIG.37

(10Gbps) Eye Diagram RT · FT = 35ps (20Gbps) Eye Diagram RT · FT = 17ps

HIGH SPEED TRANSMISSION CONNECTOR WITH SURFACES OF GROUND TERMINAL SECTIONS AND TRANSMISSION PATHS IN A COMMON PLANE

This application claims the benefit of Japanese Patent Application No. 2007-203274, filed Aug. 3, 2007, which is hereby incorporated by reference herein in its entirety.

BACKGROUND OF THE INVENTION

1. Field of the Invention

The present invention relates to a high-speed transmission connector for forming part of a high-speed signal transmission path.

2. Description of the Related Art

When a data transmission is carried out at a relatively high speed, for example, at 2.5 Gbps or more per a channel, a differential transmission system is employed. In the transmission path wherein such a differential transmission system is employed, a high speed transmission connector has been in practical use for electrically connecting a mother board as a wiring board with a daughter board. As such a high speed transmission connector, a connector called as a backplane connector is proposed, for example, as shown in Japanese Patent Laid-Open No. 2004-521448.

The backplane connector is electrically connected to the mother board and a daughter card connector described later by a plurality of connection terminals (blade contacts) disposed in the interior of the backplane connector. The daughter card connector disposed in the daughter board is provided with a housing for accommodating a plurality of wafers in the interior thereof with wafers piled up each other.

The respective wafer comprises a daughter card shield member having a plurality of ground terminals arranged at a predetermined spacing at one end thereof, and a supporting plate (housing) for supporting a signal contact blank having a plurality of signal terminals arranged at a predetermined spacing at one end thereof. The daughter card shield member and the signal contact blank are piled up together so that the ground terminal pairs and the signal terminal pairs are arranged in a single line and the respective pair of the signal terminals is disposed between the respective pair of ground terminals.

In the signal contact blank, there are daughter board terminal section (contact tails) and a terminal section (a continuous contact area) for the blade contacts having a width larger than that of the transmission path at opposite ends of a transmission path forming the respective signal line.

SUMMARY OF THE INVENTION

In the high speed transmission path as described above, impedance mismatching within the connector is not negligible. Because this impedance mismatching causes signal reflection, the impedance matching within the above-mentioned back plane connector is required.

Also, it is necessary to inhibit the crosstalk between the adjacent transmission paths.

However, there is a risk in that the impedance may vary since the blade contact terminal section has a width larger than that of the transmission path as described hereinabove, which is accompanied with a problem in that the back plane connector back does not lend itself to impedance matching. When the impedance matching is difficult in such a manner, it may cause signal reflection, whereby the realization of high speed signal transmission, such as exceeding 10 Gbps per channel, becomes difficult.

Also, in the continuous contact area of the signal contact blank, shield beam contacts formed to be integrated with the shield plate are disposed between the respective pairs of beam contacts. But, since the positioning of the shield beam contact relative to the beam contact is not assured, there is a risk in that the crosstalk between the adjacent transmission paths is not sufficiently avoidable.

To take above-mentioned problems into consideration, an object of the present invention concerning a high speed transmission connector is to provide a high speed transmission connector capable of assuredly preventing the crosstalk from occurring between transmission paths adjacent to each other as well as easily carrying out the impedance matching within the connector.

To achieve the above-mentioned object, the high speed transmission connector according to the present invention comprises a contact unit including a ground blade having two ground terminal sections disposed in a common plane while sandwiching connecting ends of two high speed signal transmission paths adjacent to each other, a plug section having a casing detachably accommodating the contact unit, a high speed signal transmission path connected to the respective connecting ends of the two high speed signal transmission paths of the contact unit when connected to the plug section, and a socket section arranged on both sides of the high speed signal transmission path to intervene the transmission path while being connected to the ground terminal section of the ground blade.

As apparent from the above-mentioned description, according to the high speed transmission connector of the present invention, since the contact unit includes the ground blade having two ground terminal sections disposed in the common plane while intervening the connecting ends of the adjacent two high speed signal transmission paths disposed in the common plane, it is possible to assuredly avoid the crosstalking between the adjacent transmission paths as well as easily match the impedance within the connector.

Further features of the present invention will become apparent from the following description of exemplary embodiments (with reference to the attached drawings).

BRIEF DESCRIPTION OF THE DRAWINGS

FIG. 21 illustrates a table of the respective set values in the embodiment shown in FIG. 20;

FIG. 37 is a table of the respective set values made available for explaining FIGS. 36A and 36B;

DESCRIPTION OF THE EMBODIMENTS

Figure 2:
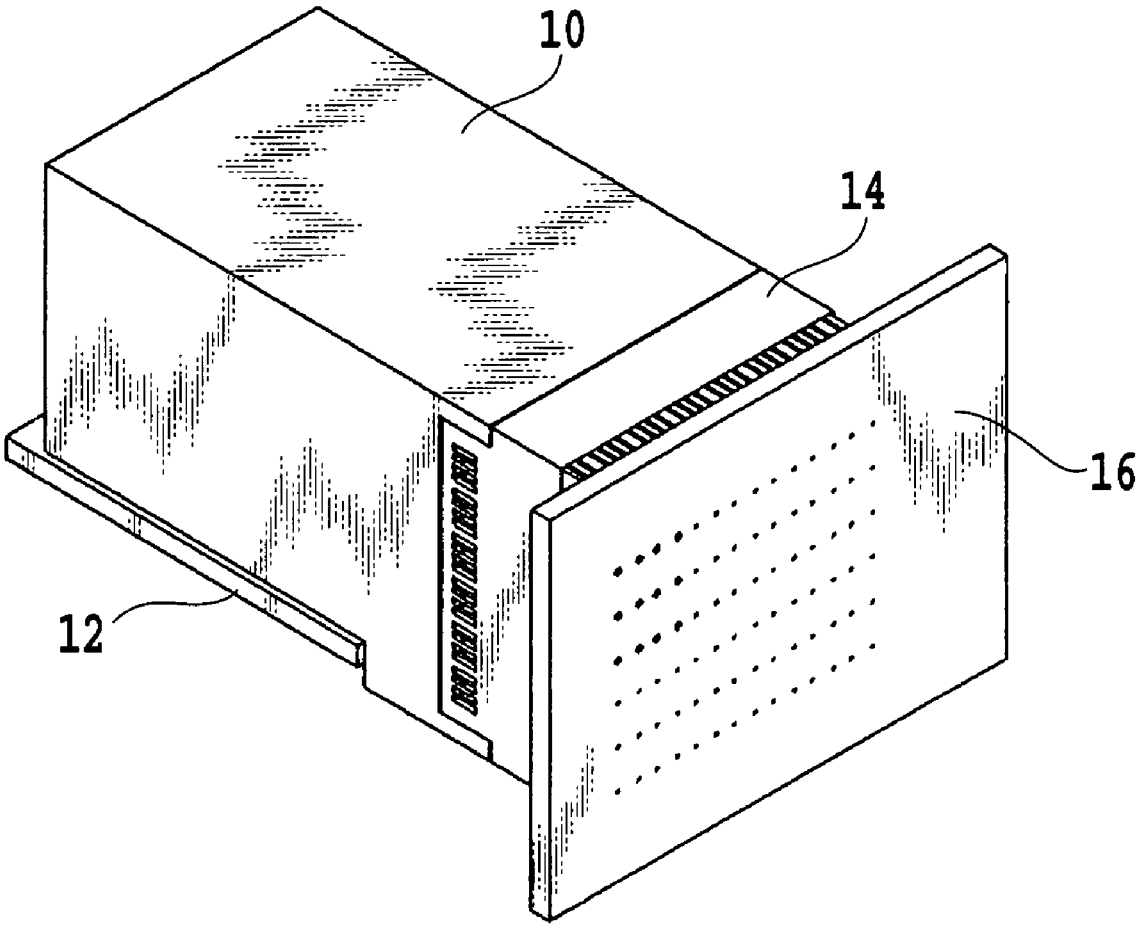
FIG. 2 is a perspective view illustrating a state wherein a plug section and a socket section constituting one embodiment of a high speed transmission connector according to the present invention are connected to each other.

FIG. 2 illustrates the appearance of one embodiment of a high speed transmission connector according to the present invention together with the printed wiring board.

In FIG. 2, the high speed transmission connector is comprised by a plug section 10 fixed to a given printed wiring board 12 and a socket section 14 fixed to another given printed wiring board 16. In this regard, FIG. 2 illustrates a state wherein the plug section 10 is connected to the socket section 14.

Figure 3:
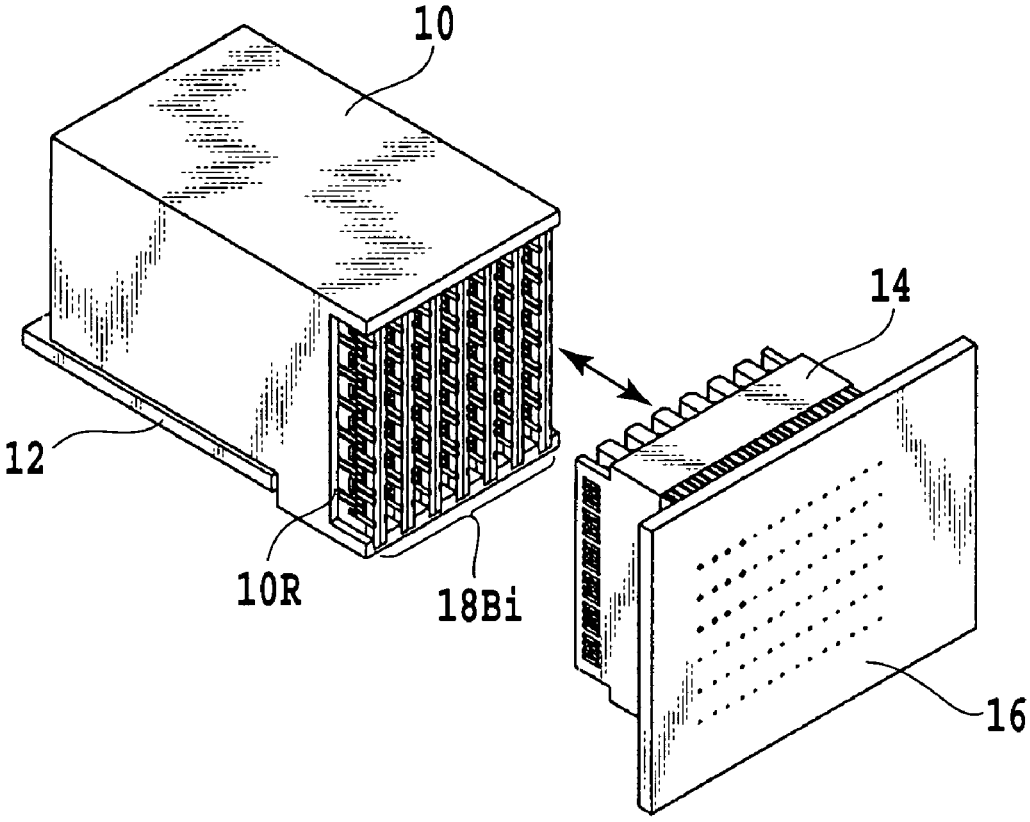
FIG. 3 is a perspective view illustrating a state wherein a plug section and a socket section constituting one embodiment of a high speed transmission connector according to the present invention are separated from each other.

The plug section 10 is adapted to be attachable/detachable relative to the socket section 14 as shown in FIG. 3. As shown in FIGS. 4 to 6 and 8, the plug section 10 comprises a casing 10C having a plurality of cells 10Si (i=1 to n, n is an integer) accommodating the respective blade type contact units 18Bi (i=1 to n, n is an integer) described later to be attachable/detachable.

Figure 5:
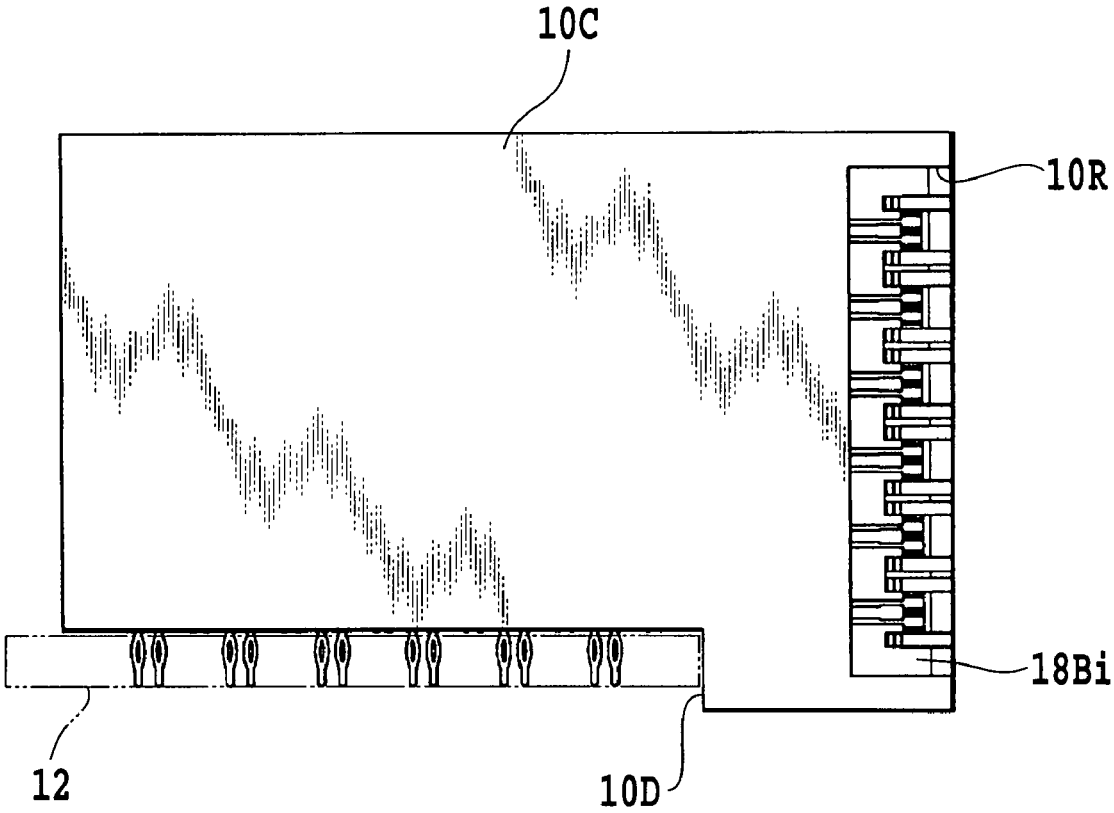
FIG. 5 is a side view of the embodiment shown in FIG. 4.
Figure 6:
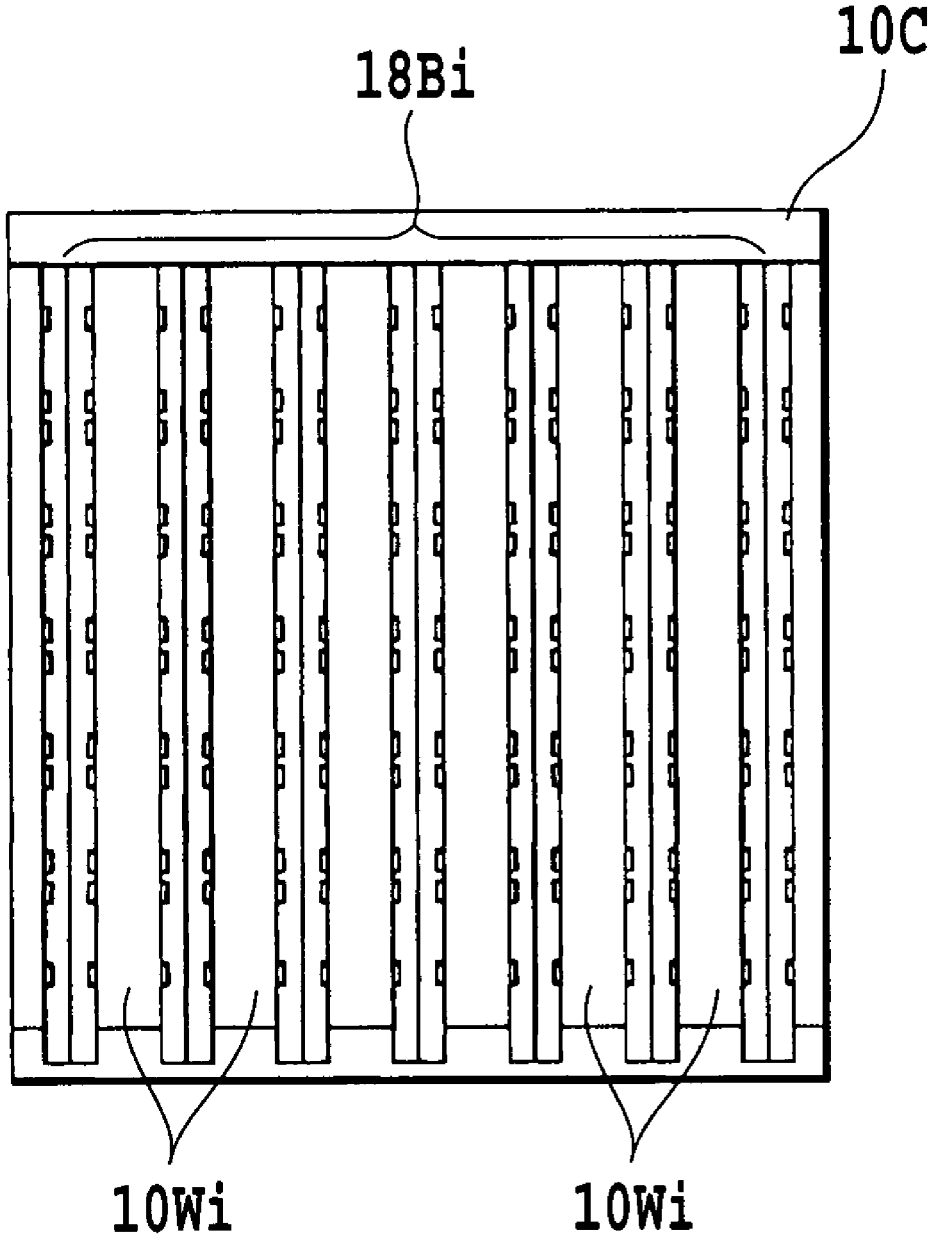
FIG. 6 is a front view of the embodiment shown in FIG. 4.
Figure 7:
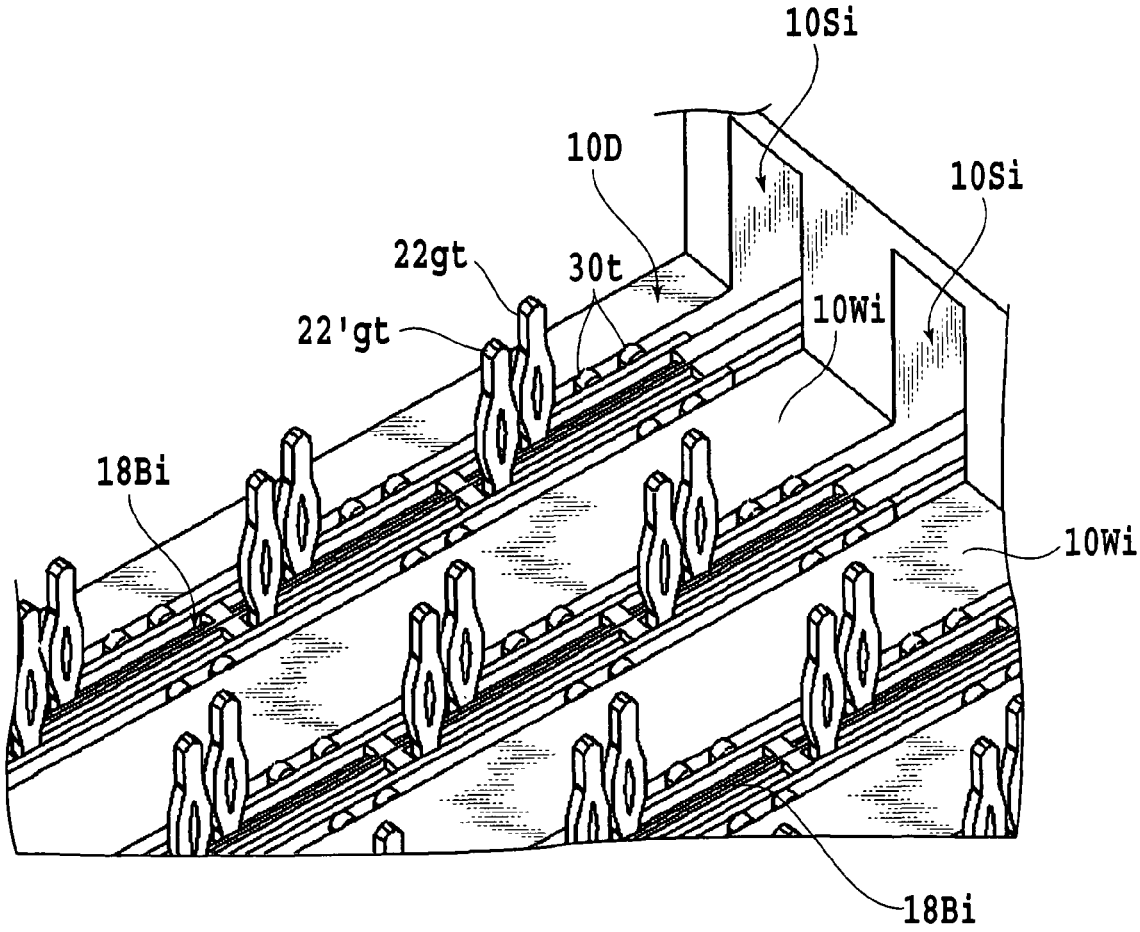
FIG. 7 is a partially enlarged perspective view of a bottom portion of the embodiment shown in FIG. 4.

As shown in FIG. 5, the casing 10C molded with resinous material such as e.g. liquid crystal polymer (LCP) has a stepped portion 10D in the bottom thereof wherein the printed wiring board 12 is arranged. As shown in FIG. 7 in enlarged dimension, openings communicated with the cells 10Si are formed at a predetermined spacing.

In the respective opening, a ground terminal and a signal terminal of the respective blade type contact unit 18Bi described later are exposed. The adjacent openings are sectioned by a partitioning wall formed in contiguous to a partitioning wall 10Wi separating the adjacent cells 10Si.

Figure 8:
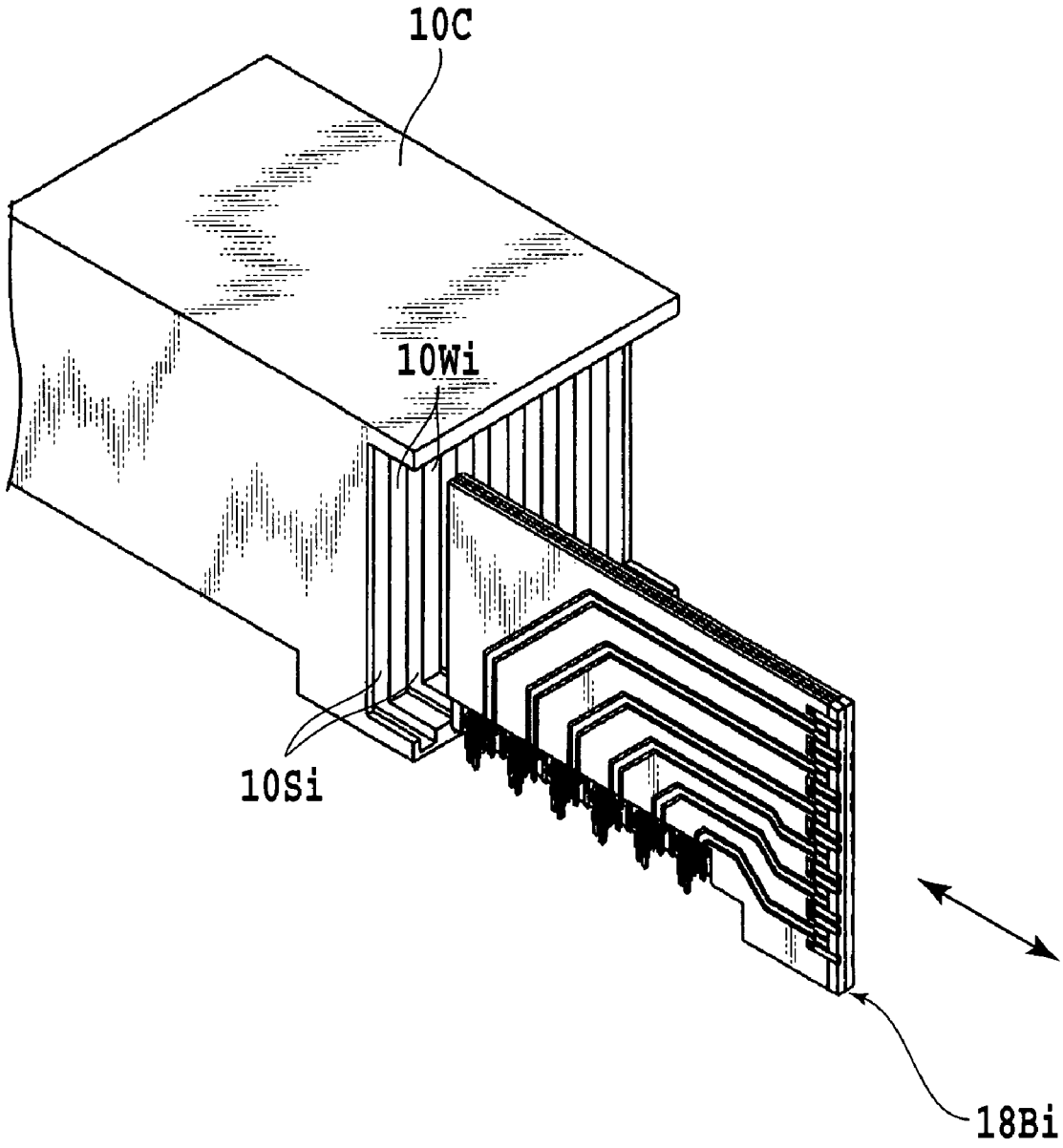
FIG. 8 is a perspective view made available for explaining the attachment/detachment of the contact unit in the embodiment shown in FIG. 1.

As shown in FIG. 8, the cells 10Si in the casing 10C are formed at a predetermined spacing generally parallel to a long side thereof. The respective cell 10Si extends in the interior of the casing 10C along the long side thereof. A guide groove is formed on the bottom side of the respective cell 10Si for guiding ends of the ground terminal and the signal terminal of the contact unit 18Bi when the contact unit 18Bi is attached/detached in the direction shown by an arrow shown in FIG. 8. The adjacent cells 10Si are sectioned by a partitioning wall 10Wi.

Figure 4:
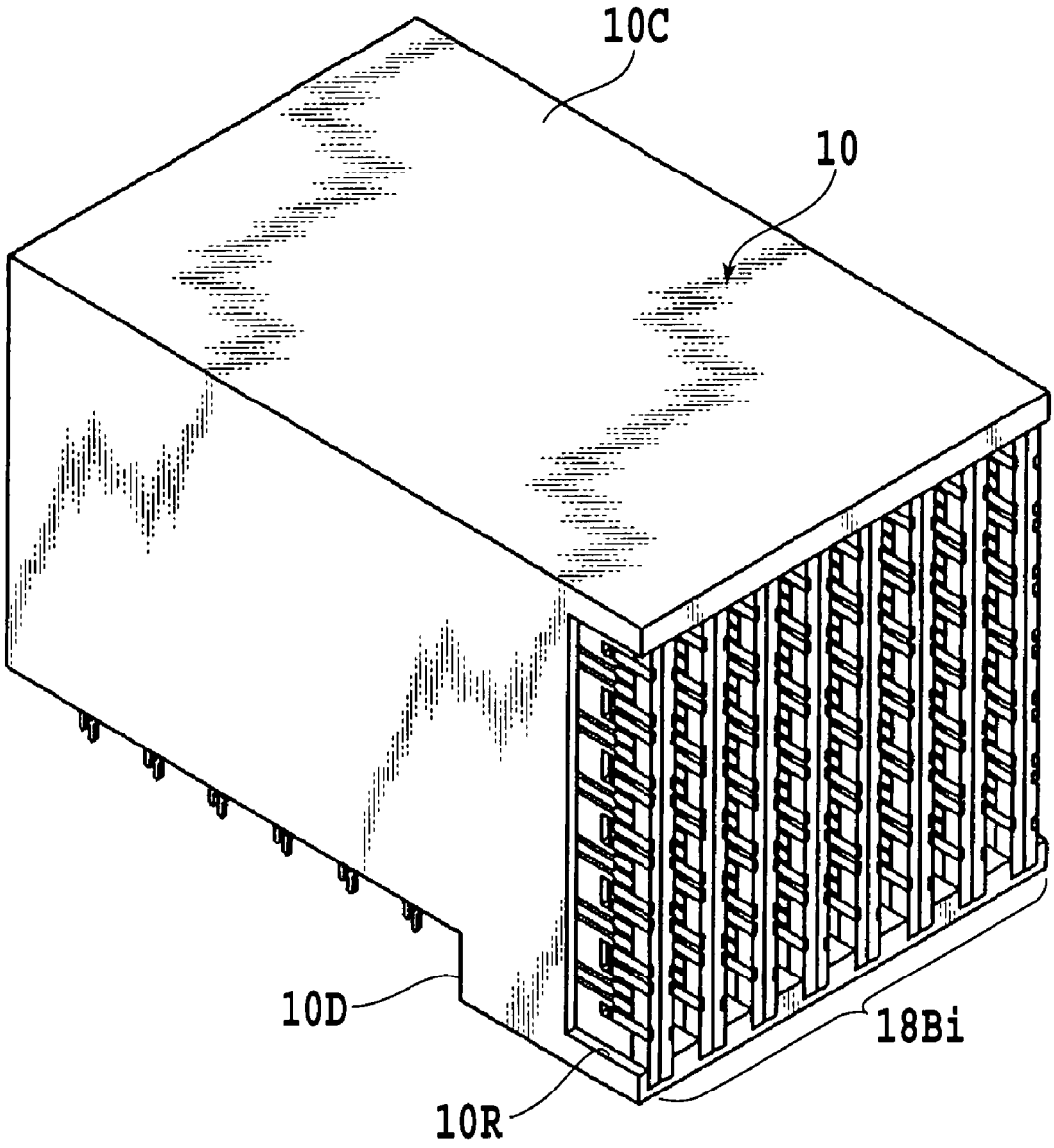
FIG. 4 is a perspective view illustrating an appearance of a plug section constituting one embodiment of a high speed transmission connector according to the present invention.

As shown in FIG. 4, a recess 10R engageable with connection ends located at opposite ends of the socket section 14 described later is formed on opposite side walls of the socket section 14. When the plug section 10 is connected to the socket section 14 described later, an open end surface of the cell 10Si in the casing 10C touches to a stepped surface 50S (see FIG. 24) in the socket section 14 described later.

Figure 1:
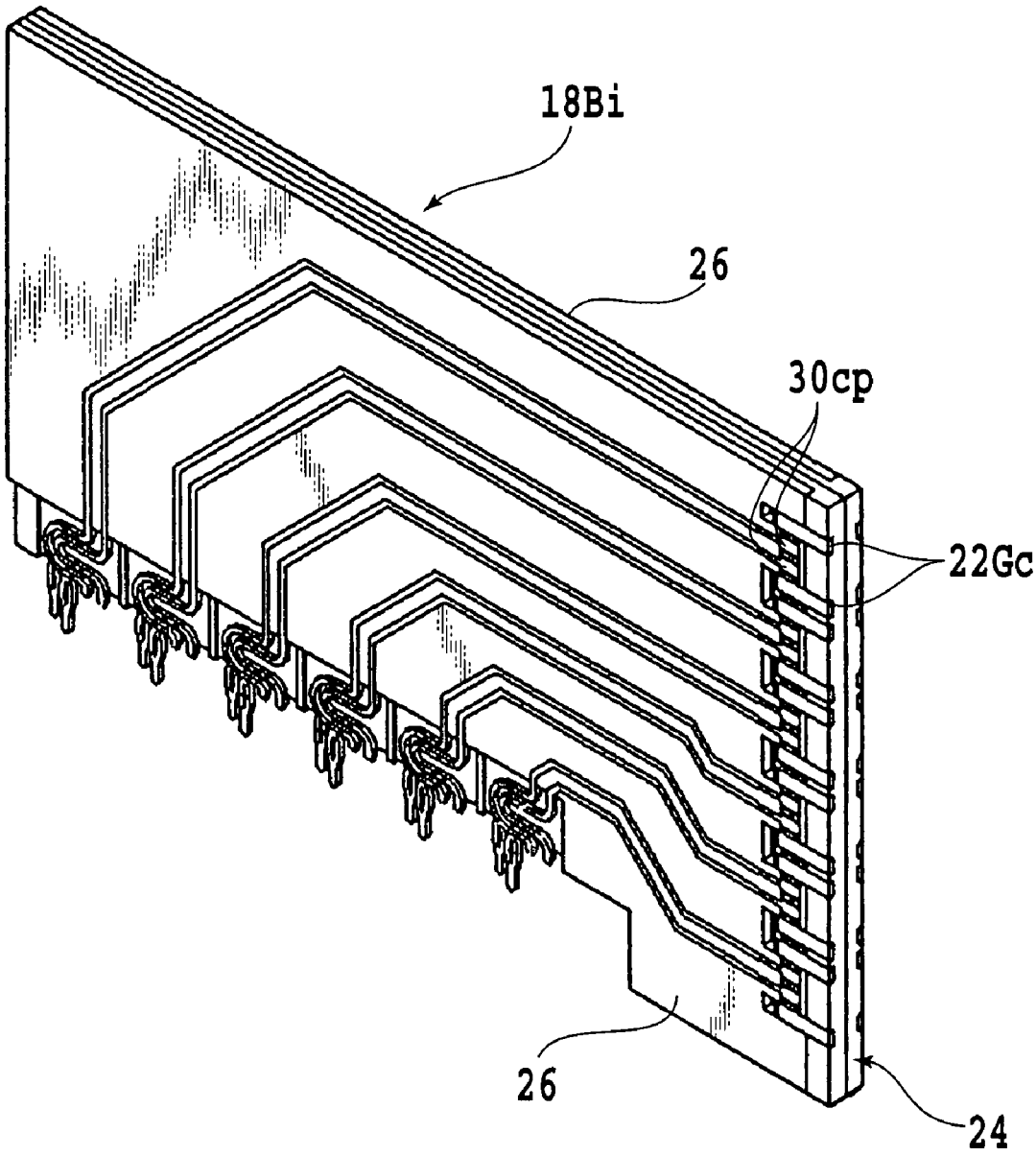
FIG. 1 is a perspective view illustrating an appearance of a contact unit used in one embodiment of a high speed transmission connector according to the present invention.

As shown in FIG. 1 in enlarged dimension, a single contact unit 18Bi includes a single ground blade 24 and two transmission blades 26 disposed on the outer surfaces of the ground blade facing each other. The ground blade 24 includes ground contact terminal groups 22G1 to 22G6 and 22'G1 to 22'G6 (see FIG. 10). The transmission blade 26 includes a transmission contact terminal group 30*a* to 30*m* for transmitting signals or data.

Figure 10:
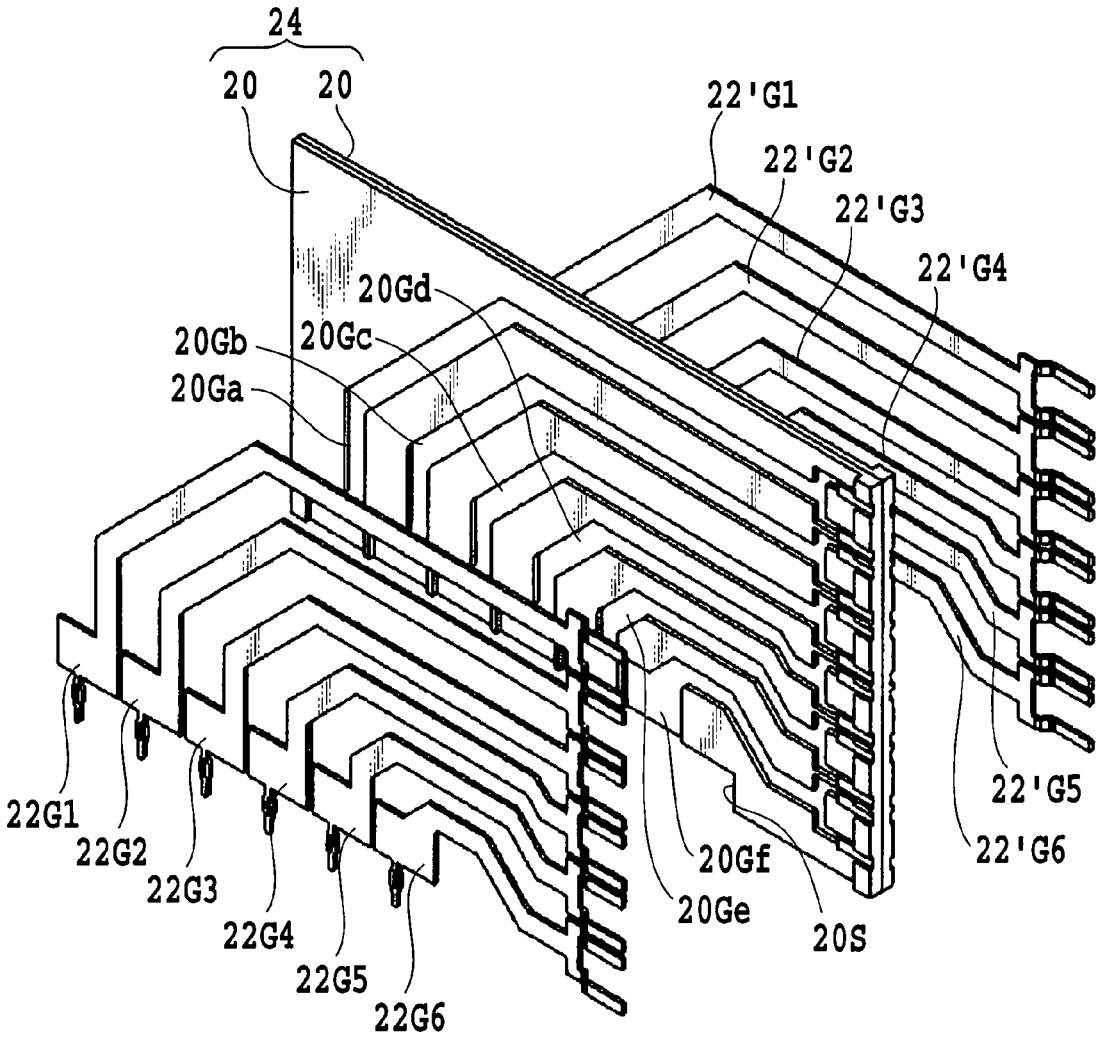
FIG. 10 is an exploded perspective view of the ground blade constituting the contact unit in the embodiment shown in FIG. 1.

As shown in FIG. 10 in enlarged dimension, the ground blade 24 includes two supporting plates 20 having, respectively, ground contact terminal groups 22G1 to 22G6 and 22'G1 to 22'G6 to be inserted into grooves of the respective supporting plates 20.

The respective supporting plates 20 are molded, for example, with liquid crystal polymer (LCP) which is electrically insulated resinous material. Since both the supporting plates 20 have the same structure, the explanation thereof will be made on one of them and that of the other will be eliminated.

The supporting plate 20 has a stepped portion 20S on a lower edge thereof to be engaged with one end of the above-mentioned printed wiring board 12.

On one surface layer of the supporting plate 20, grooves 20Ga to 20Gf are formed, into which the respective ground contact terminals are individually inserted.

In the groove 20Gf formed at a position nearest to the above-mentioned stepped portion 20S, the ground contact terminal 22G6 is inserted. One end of the groove 20Gf is bifurcated. On the other hand, the other end of the 20Gf communicates with a joint groove Gco formed adjacent to the stepped portion 20S generally parallel thereto. In this regard, the joint groove Gco is formed to have a depth equal to those of the grooves 20Ga to 20Gf to commonly communicate with the other ends of the grooves 20Ga to 20Gf. In the joint groove Gco, the respective fixed terminals of the ground contact terminal group 22G1 to 22G6 are inserted in one row.

A part between one end and the other end of the groove 20Gf is bent. The crook is formed so that two horizontal sections having a height difference between them are connected by a slant.

Figure 14:
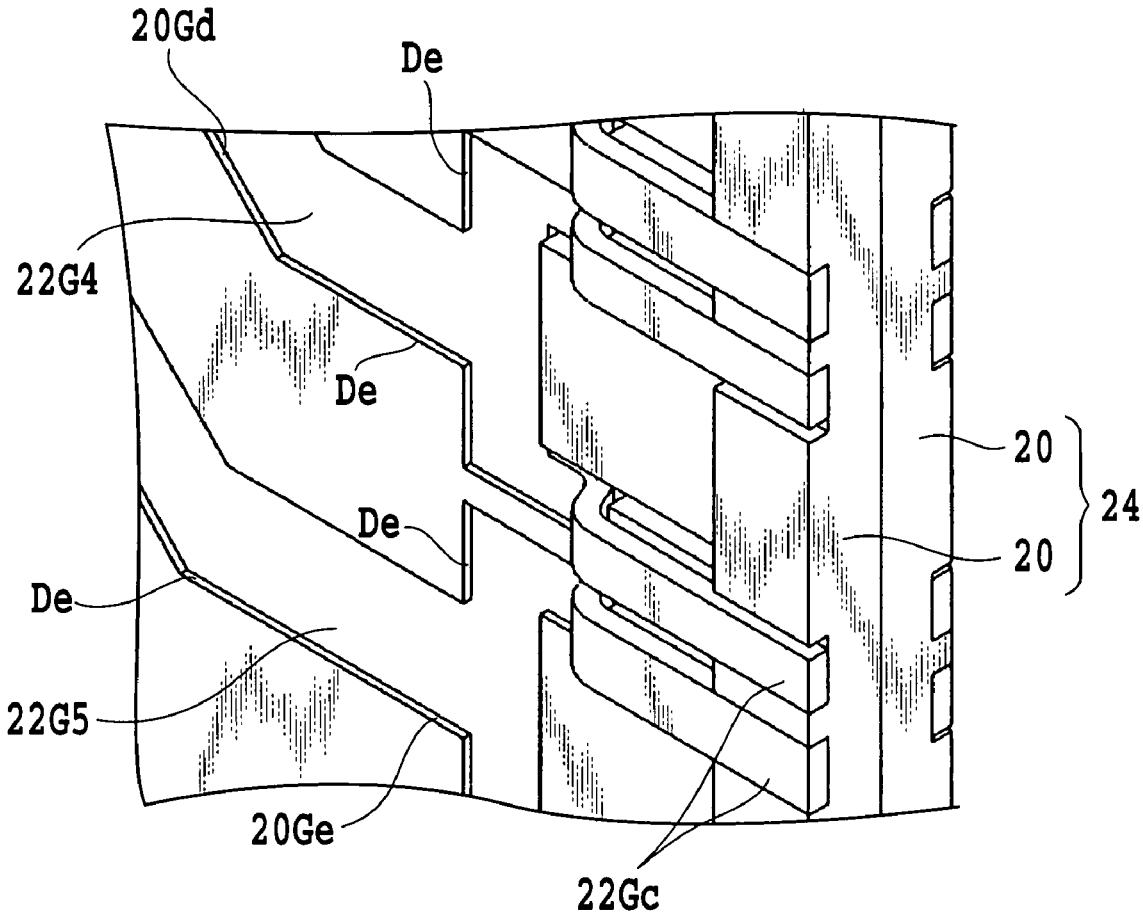
FIG. 14 is a partially enlarged perspective view of the ground blade in the embodiment shown in FIG. 9.
Figure 15:
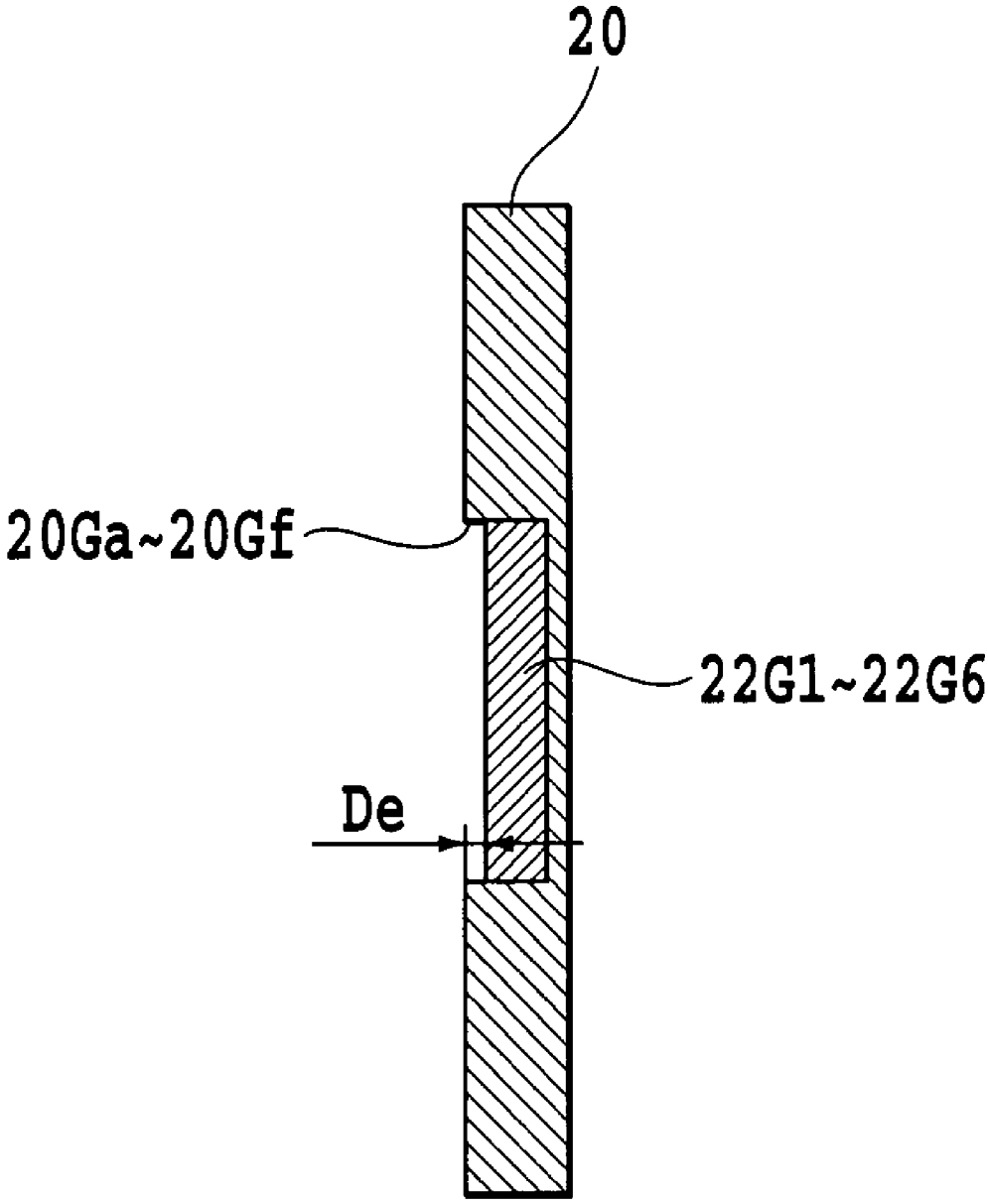
FIG. 15 is a partially sectional view the supporting plate for the ground blade in the embodiment shown in FIG. 9.

As shown in FIG. 15 in a partially enlarged manner, the depth of the groove 20Gf and the other grooves 20Ge to 20Ga are selected larger than a thickness of the ground contact terminals 22G1 to 22G6. Thereby, as shown in FIGS. 14 and 15, a step difference De is formed between the outer surface of the supporting plate 20 and the surfaces of the inserted ground contact terminals 22G1 to 22G6.

Figure 16A:
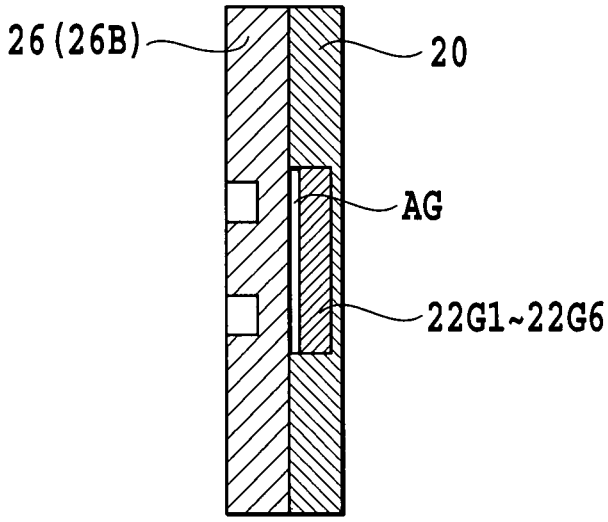
FIG. 16A is a partially sectional view of the ground blade and the transmission blade.

Accordingly, when the transmission blade 26 described later is laid on the supporting plate 20, as shown in FIG. 16A in a partially enlarged manner, a predetermined air layer AG is formed between the surface of the ground contact terminals 22G1 to 22G6 and the transmission blade 26 opposite thereto, in correspondence to the step difference De.

In the grooves 20Ge to 20Ga at positions upper than the groove 20Gf, the ground contact terminals 22G5, 22G4, 22G3, 22G2 and 22G1 are inserted.

A shape of the groove 20Ge adjacent to the groove 20Gf is similar to that of the groove 20Gf at a predetermined interval. The groove 20Ge is formed to encircle the groove 20Gf.

A shape of the groove 20Gd adjacent to the groove 20Ge is similar to that of the groove 20Gf at a predetermined interval. The groove 20Gd is formed to encircle the groove 20Ge.

A shape of the groove 20Gc adjacent to the groove 20Gd is similar to that of the groove 20Gf at a predetermined interval. The groove 20Gc is formed to encircle the groove 20Gd.

A shape of the groove 20Gb adjacent to the groove 20Gc is similar to that of the groove 20Gf at a predetermined interval. The groove 20Gb is formed to encircle the groove 20Gc.

A shape of the groove 20Ga adjacent to the groove 20Gb is similar to that of the groove 20Gf at a predetermined interval. The groove 20Ga is formed to encircle the groove 20Gb.

Thereby, bifurcated grooves are formed in one row at a predetermined spacing at one end of the supporting plate 20.

Since the ground contact terminal group 22G1 to 22G6 and the ground contact terminal group 22'G1 to 22'G6 has the same shape except for the difference of positions of the fixed terminal sections 22*gt* and 22*gt*', the explanation will be done solely on the ground contact terminal group 22G1 to 22G6 and that of the ground contact terminal group 22'G1 to 22'G6 will be eliminated.

Figure 11:
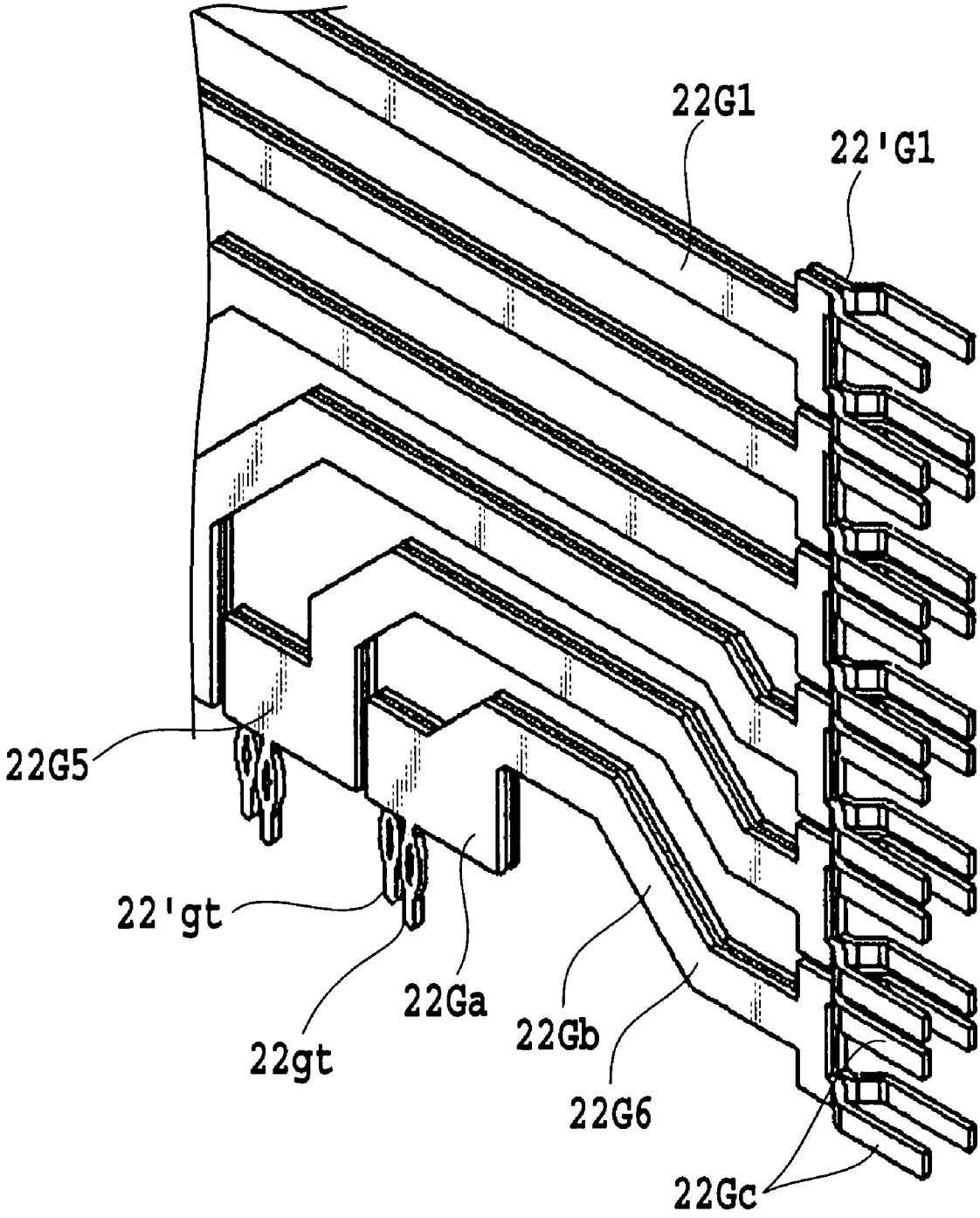
FIG. 11 is a partially enlarged perspective view of a ground contact terminal group shown in FIG. 10.

The ground contact terminal 22G6 is made of copper alloy, for example, phosphor bronze alloy to be a thin plate. One end of the ground terminal 22G6 has a pair of terminals 2Gc bifurcated as shown in FIG. 11 in a partially enlarged manner. The pair of terminals 22Gc bent to be separated outward from a middle portion of the ground contact terminal 22G6 extend parallel to each other at a predetermined interval while being vertical to a short side of the supporting plate 20 to which it is fixed. The pair of terminals 22Gc (a ground pad section) is divided into upper and lower pads for avoiding the crosstalk of signals adjacent to each other upward and downward.

On the other hand, at the other end of the ground contact terminal 22G6, as shown in FIG. 11 in enlarged dimension, a flat enlarged portion 22Ga is formed, having a fixed terminal section 22*gt* to be press-fit into a through-hole of the printed wiring board 12 described later. The fixed terminal section 22*gt* is formed at an end of the enlarged portion 22Ga to be generally vertical to the extension line of the above-mentioned terminal 22Gc. A part 22Gb in the ground contact terminal 22G6 between one and other ends thereof is bent. A crook is formed to connect two horizontal portions having the height difference by a slant.

Shapes of the ground contact terminal 22G5 and the other ground contact terminals 22G4 to 22G1 disposed above the former are similar to that of the ground contact terminal 22G6.

Regarding line lengths of the ground contact terminals 22G1 to 22G6, it is defined that the length of the ground contact terminal 22G6 is minimum and the length of the ground contact terminal 22G1 is maximum. The line length of the ground contact terminal 22G5 is defined to be longer than that of the ground contact terminal 22G6, the line length of the ground contact terminal 22G4 is defined to be longer than that of the ground contact terminal 22G5, and the line length of the ground contact terminal 22G3 is defined to be longer than that of the ground contact terminal 22G4. And, the line length of the ground contact terminal 22G2 is defined to be longer than that of the ground contact terminal 22G3. Thus, as shown in FIG. 11, when the ground contact terminals 22G1 to 22G6 are arranged in a common plane in the order of the line lengths, the ground contact terminals having relatively shorter line lengths are encircled with those having relatively longer line lengths.

Figure 12:
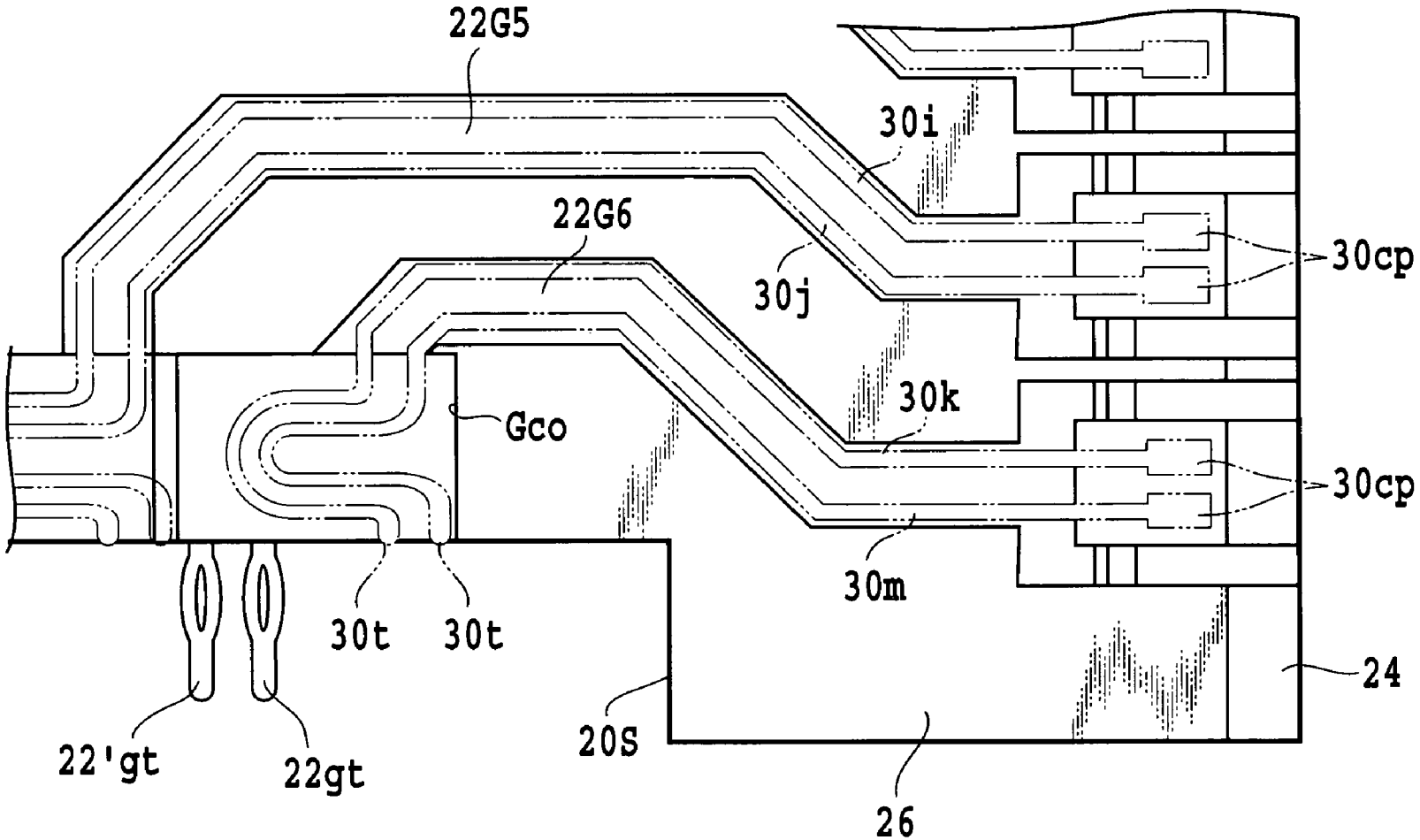
FIG. 12 is a partially enlarged plan view of the ground blade in the embodiment shown in FIG. 9.

Also, when the ground contact terminals 22G1 to 22G6 and 22'G1 to 22'G6 are inserted into the respective grooves 20Ga to 20Gf of the respective supporting plates bonded together in a common bonding plane, for example, the ground contact terminal 22'G1 as shown in FIG. 11. At this time, as shown in FIG. 12, a position of the fixed terminal 22*gt* is defined to be closer to a front end of the supporting plate 20 by a predetermined distance in comparison with a position of the fixed terminal 22*gt*'.

The ground blade 24 wherein the ground contact terminals 22G1 to 22G6 and 22'G1 to 22'G6 are integrated with each other as described above is formed to be relatively thin, for example, a thickness of approximately 0.7 mm, whereby it has the flexibility.

Figure 17:
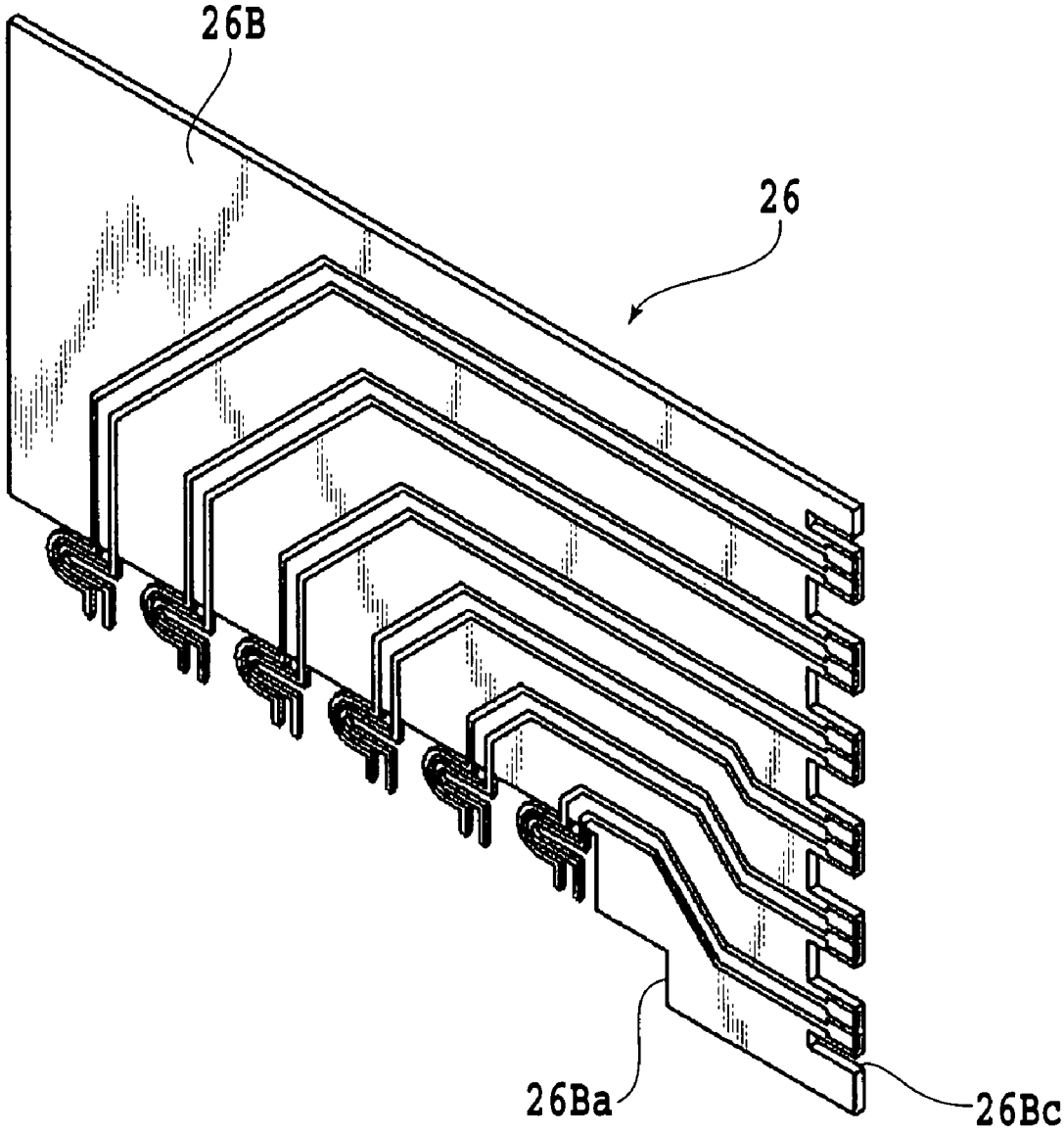
FIG. 17 is a perspective view of the transmission blade constituting the contact unit in the embodiment shown in FIG. 1.

As shown in FIG. 17 in enlarged dimension, the transmission blade 26 has a structure wherein the contact terminal group 30*a* to 30*m* forming the respective transmission paths arranged at a predetermined interval is insert-molded with liquid crystal polymer as an electro-insulation material. A resinous substrate 26B for the transmission blade 26 is defined to have a thickness of approximately 0.4 mm, whereby it has the flexibility. The transmission blade 26 is disposed to be fixed to the opposite outer surfaces of the ground blade 24, respectively, via contact pad forming sections described later.

At one end of the transmission blade 26, a plurality of contact pad forming sections 26Bp are formed at a predetermined interval, which sections are disposed between the pair of terminals 22Gc in the above-mentioned ground blade 24. Between the adjacent contact pad forming sections 26Bp, a notch 26Bc is formed. Also, at the lowest end of the substrate 26B of the transmission blade 26, a stepped portion 26Ba engageable with an end of the above-mentioned printed wiring board 12 is formed opposite to the stepped portion 20S of the supporting plate 20 in the ground blade 24, wherein both the stepped portions have the same shape. As illustrated in the Figures, the terminals 22Gc of ground blade 24 may be disposed in a common plane, with contact pads 30*cp* of adjacent high speed signal transmission paths being interposed in the common plane.

Figure 18:
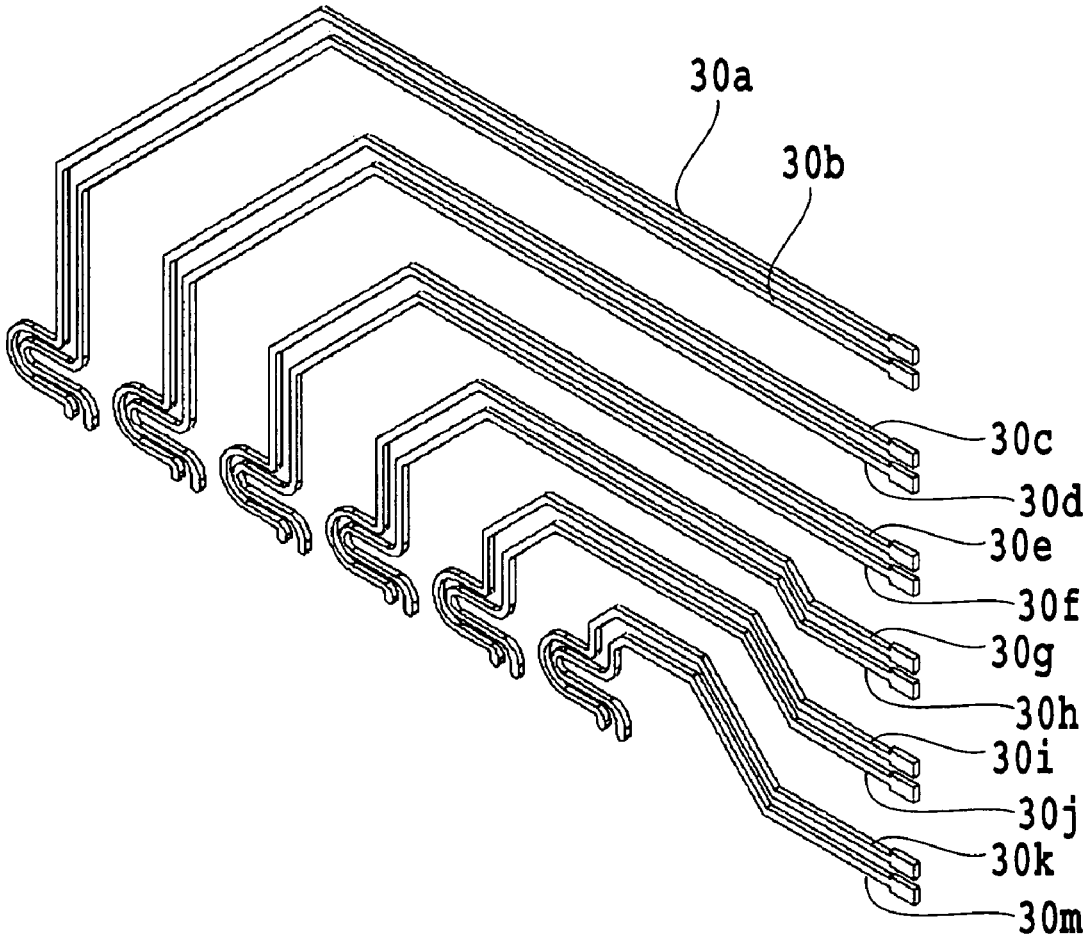
FIG. 18 is a perspective view illustrating a contact terminal group shown in FIG. 17.

The contact terminal group 30*a* to 30*m* is made, for example, of phosphor bronze alloy to be a thin plate, and as shown in FIG. 18 in enlarged dimension, the line lengths thereof are different from each other. The contact terminal 30*a* is defined to have the maximum line length, and the contact terminal 30*m* is defined to have the minimum line length. The contact terminals 30*a* and 30*b*; 30*c* and 30*d*; 30*e* and 30*f*; 30*g* and 30*h*; 301 and 30*j*; and 30*k* and 30*m* respectively define pairs of signal paths.

The contact terminal 30*a* in the contact terminal group 30*a* to 30*m* is disposed at a position in the vicinity of the uppermost end of the substrate 26B, while the contact terminal 30*m* is disposed at a position in the vicinity of the lowermost stepped portion 26Ba.

Figure 19:
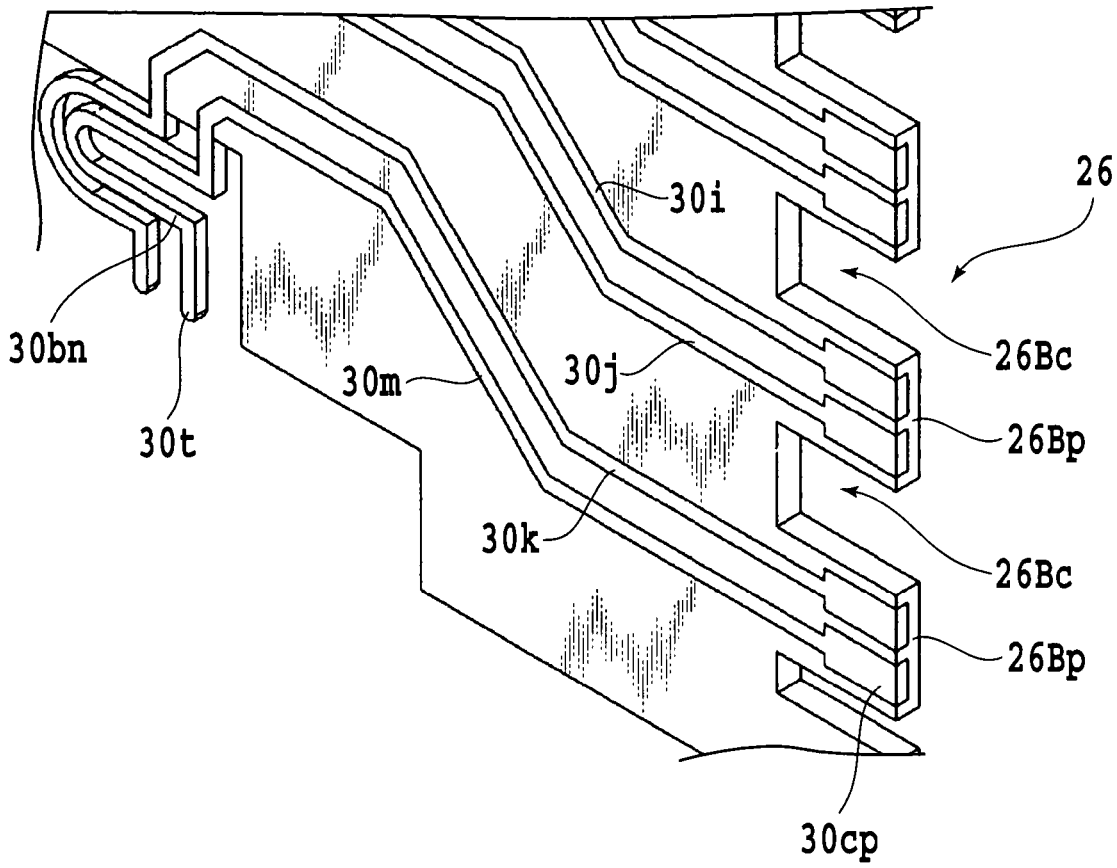
FIG. 19 is a partially enlarged perspective view showing a main part of the embodiment shown in FIG. 17.

One end of the contact terminal 30*m* has a contact pad 30*cp* as shown in FIG. 19 in a partially enlarged manner. A width of the contact pad 30*cp* in the arrangement direction is defined larger than that of the remaining portion of the contact terminal 30*m*.

On the other hand, at the other end of the contact terminal 30*m*, a crook 30*bn* is formed having a terminal part 30*t* to be in contact with a conductive pattern of the printed wiring board 12 described later at a predetermined pressure. The terminal part 30*t* is formed at an end of the elastic crook 30*bn* to be generally vertical to the extension line of the above-mentioned contact pad 30*cp*. As shown in FIG. 12 by two-dot chain lines, an area between the one end and the other crook of the contact terminal 30*m* is bent on the surface of the substrate 26B while being opposed to a part 22Gb of the above-mentioned ground contact terminal 22G6. The crook is formed to connect two horizontal parts having the height difference via slants.

A shape of a contact terminal 30*k* disposed above the contact terminal 30*m* while being adjacent thereto and those of other contact terminals 30*j* to 30*a* disposed further above the former are similar to that of the contact terminal 30*m*.

Regarding a line length between the contact pad and the crook in the respective contact terminals 30*a* to 30*m* (hereinafter also referred to as an effective line length), the line lengths between the respective pair of signal paths are preferably the same to each other in the differential transmission system.

Figure 20:
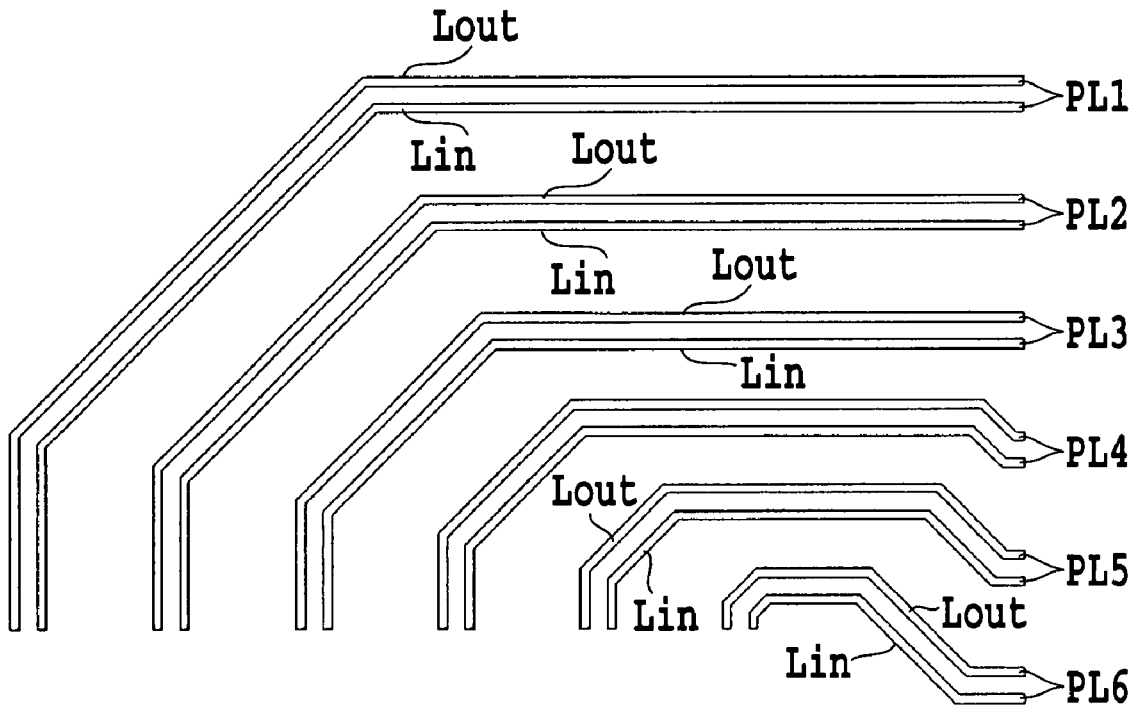
FIG. 20 is an illustration made available for explaining a line length in the contact terminal group shown in FIG. 17.

In this embodiment, as shown in FIGS. 20 and 21, since the effective line lengths (mm) of the contact terminals 30*a* and 30*b* forming the pair of signal paths PL1 are determined, for example, as 38.1 mm and 36.17 mm, the contact terminal 30*b* becomes shorter by 1.23 mm corresponding to the line length difference ΔL. Since the effective line lengths of the contact terminals 30*c* and 30*d* forming the pair of signal paths PL2 are determined, for example, as 32.19 mm and 30.94 mm, the contact terminal 30*d* becomes shorter by 1.25 mm corresponding to the line length difference ΔL. Since the effective line lengths of the contact terminals 30*e* and 30*f* forming the pair of signal paths PL3 are determined, for example, as 26.26 mm and 25.02 mm, the contact terminal 30*f* becomes shorter by 1.24 mm corresponding to the line length difference ΔL. Since the effective line lengths of the contact terminals 30*g* and 30*h* forming the pair of signal paths PL4 are determined, for example, as 21.09 mm and 19.84 mm, the contact terminal 30*h* becomes shorter by 1.25 mm corresponding to the line length difference ΔL.

Since the effective line lengths of the contact terminals 30*i* and 30*j* forming the pair of signal paths PL5 are determined, for example, as 15.95 mm and 14.71 mm, the contact terminal 30*j* becomes shorter by 1.24 mm corresponding to the line length difference ΔL. Since the effective line lengths of the contact terminals 30*k* and 30*m* forming the pair of signal paths PL6 are determined, for example, as 10.81 mm and 9.57 mm, the contact terminal 30*m* becomes shorter by 1.24 mm corresponding to the line length difference ΔL.

As described later, the above-mentioned line length differences ΔL further becomes shorter by approximately 0.5 mm all over a total length thereof by integrating an end of the shorter contact terminal forming the respective shorter signal path in each of the signal paths PL1 to PL6 with a part of the crook 30*bn* having a longer line length.

At that time, as shown in FIG. 17, if the contact terminals 30*a* to 30*m* are arranged in a common plane in the order of the line lengths thereof, the contact terminal having a relatively shorter line length is encircled by the contact terminal having a relatively longer line length. Also, if the crooks of the contact terminals are arranged at a predetermined interval in the arrangement direction, it is possible to avoid the interference between the terminal parts 30*t* of the respective blades.

Figure 22C:
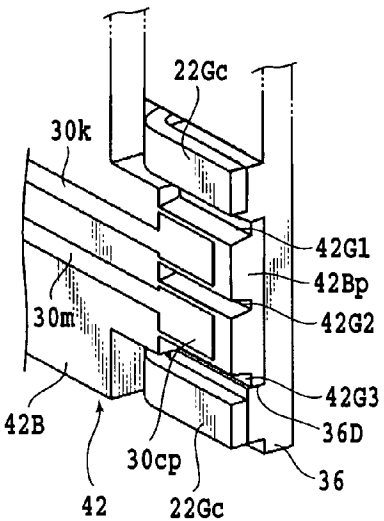
FIGS. 22A, 22B, 22C and 22D are partially enlarged perspective views, respectively, of modifications of the transmission blade constituting the contact unit in the embodiment shown in FIG. 1.

In the above-mentioned embodiment, as shown in FIG. 1, a tip end of the contact pad forming section 26Bp in the substrate 26B of the transmission blade 26 does not penetrate through the end of the supporting plate 20 but the position thereof is restricted by the stepped portion. This embodiment is not limitative but as shown in FIG. 22A in enlarged dimension, a tip end of the contact pad forming section 38Bp may be fitted to a groove 32D formed between the terminals 22Gc at an end of the supporting plate. In this regard, in FIGS. 22A to 22D, the arrangement of the contact terminals 30*a* to 30*m* is the same as that shown in FIG. 17.

Figure 22B:
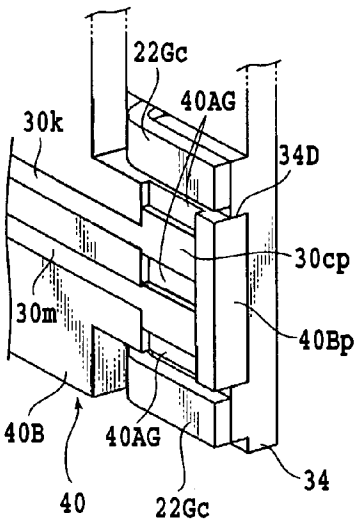

As shown in FIG. 22B in a partially enlarged manner, while a tip end of a contact pad forming section 40Bp in a substrate 40B of a transmission blade 40 is fitted to a groove 34D formed between the terminals Gc at the end of the supporting plate, grooves 40AG having a depth identical to a thickness of the contact pad 30*cp* may be formed between the contact pads 30*cp* in the contact pad forming section 40Bp and between the terminals 22Gc. Thereby, it is possible to increase the impedance, for example, in the impedance adjustment while maintaining the holding strength of the contact pad.

Further, as shown in FIG. 22C in a partially enlarged manner, in a state wherein a tip end of a contact pad forming section 42Bp in a substrate 42B of a transmission blade 42 is fitted into a groove 36 of the supporting plate, grooves 42G1, 42G1 and 42G3 having a depth larger than a thickness of the contact pad 30*cp* may be formed between the contact pads 30*cp* in the contact pad forming section 42Bp and between the terminals 22Gc. Thereby, it is possible to increase the impedance, for example, in the impedance adjustment.

Figure 22D:
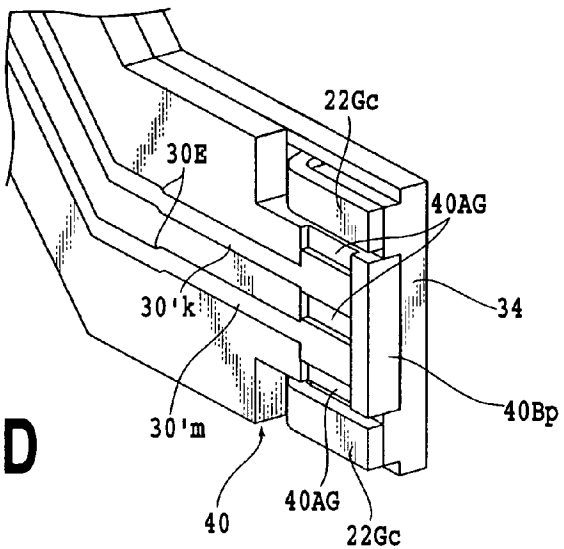
Figure 22A:
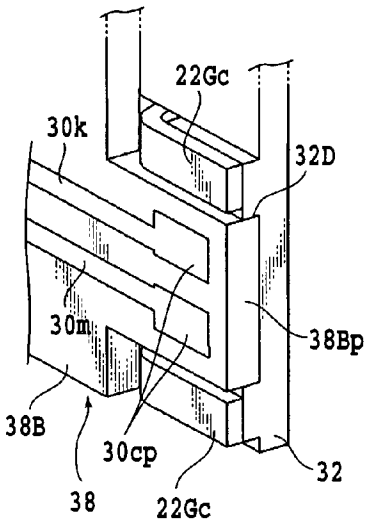

In the embodiment shown in FIG. 22B, as illustrated in FIG. 22D in a partially enlarged manner, a smaller portion 30E having a width, for example, of 0.2 mm and a length of 1.0 mm may be formed in each of contact terminals 30*k*' and 30*m*' at an upstream thereof in the vicinity of the contact pad 30*cp*.

Figure 16B:
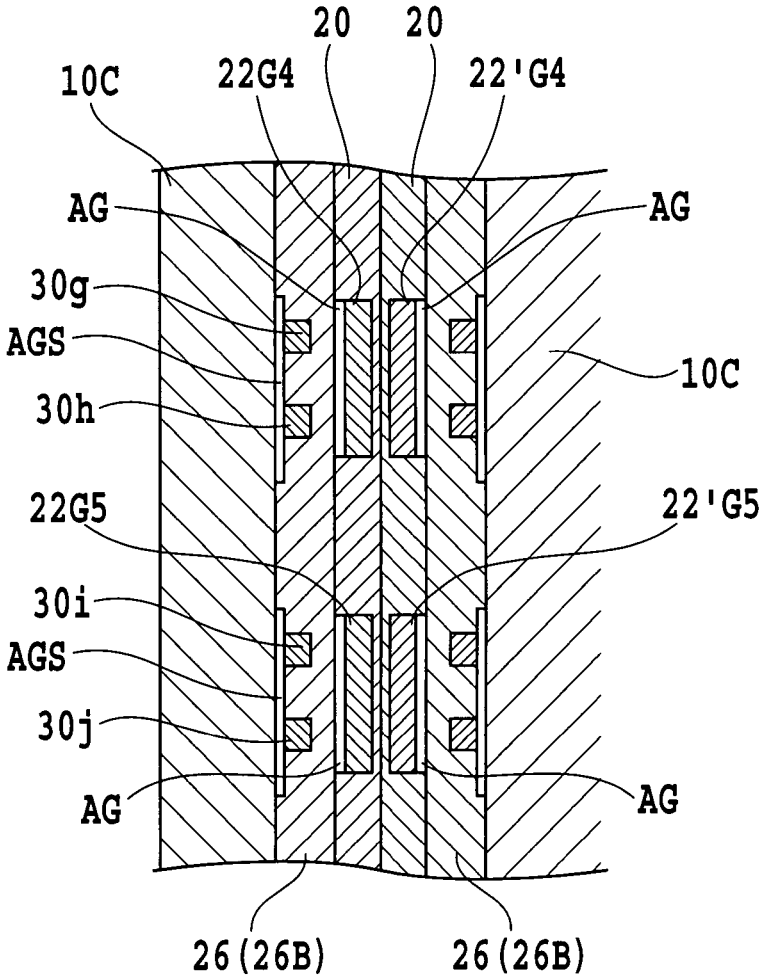
FIG. 16B is a partially sectional view of the contact unit mounted in a casing.

Further, as shown in FIG. 16B in a partially enlarged manner, recesses may be formed on a surface of the transmission blade 26 in the vicinity of an area wherein the contact terminals 30*a* to 30*m* in the transmission blade 26 are embedded. Thereby, when the contact unit 18Bi is mounted to a cell 18Si, gaps AGS forming an air layer are formed between a surface of a partitioning wall 10Wi of the casing 10C and a surface of the transmission blade 26 in the vicinity of an area wherein the contact terminals 30*a* to 30*m* are embedded.

A width of the contact pad 30*cp* should be wider than that of the thin transmission path (0.25 mm) for the purpose of absorbing the positional deviation from the socket section 14. In this embodiment, the width of the contact pad is defined as 0.48 mm according, for example, to the connector specification.

When the contact pad 30*cp* is encircled with resin in the same manner as in the transmission path while maintaining the above-mentioned width of the former, the impedance is stabilized at a low value of 100Ω or less.

Accordingly, according to the embodiment, as described above, part of resin between the contact pads 30*cp* is removed (or recessed) to increase the impedance to be approximately 100Ω.

To arrange signals at a high density, in an embodiment of the inventive connector, it is important that the width of the contact pad is approximately twice that of the signal line when the signal line spacing is 0.8 mm.

If the width of the contact pad becomes near to triple of the width of the signal line, there may be a risk in that the impedance is lowered by 5Ω or more relative to 100Ω.

Figure 54:
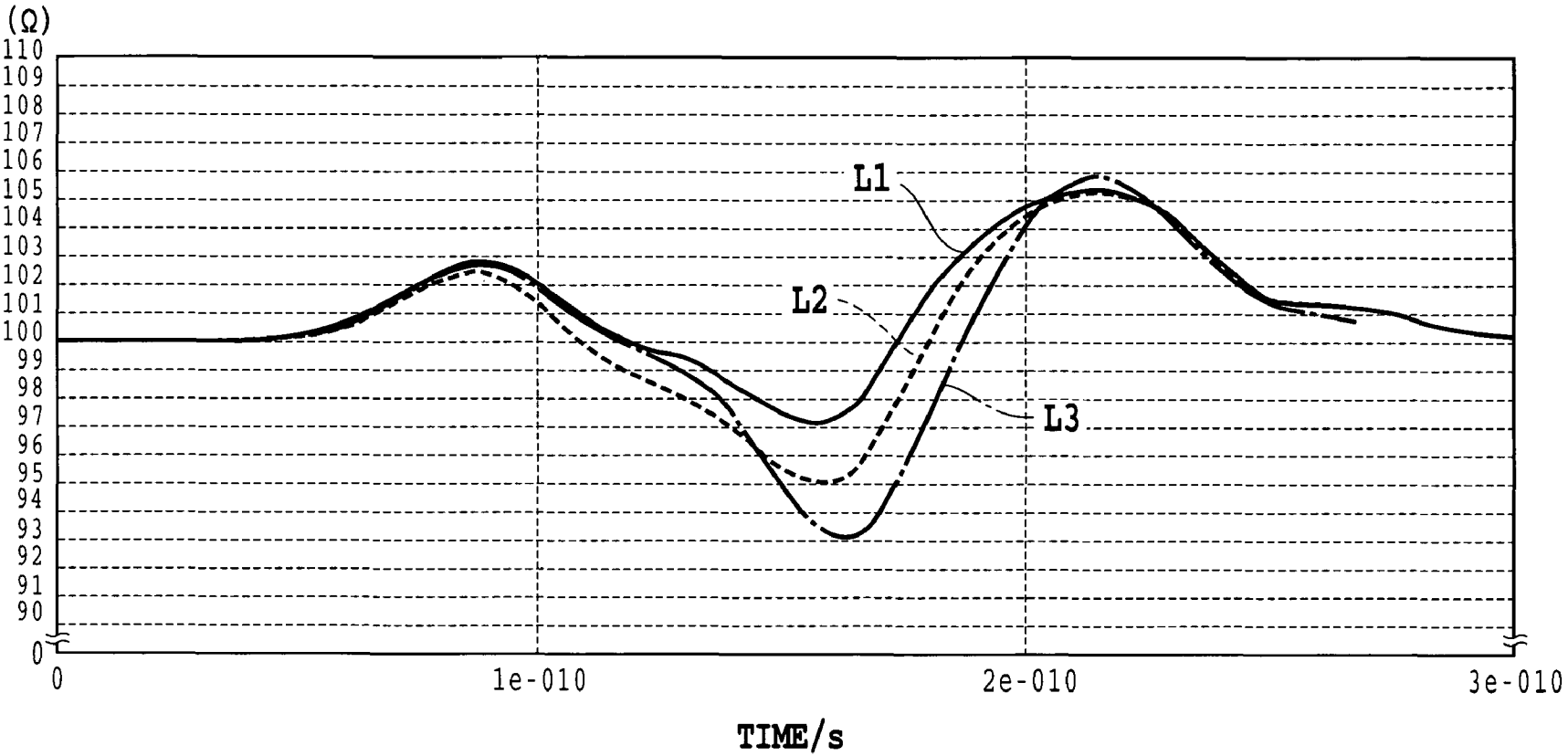
FIG. 54 is characteristic diagram illustrating the impedance characteristic of the plug section and the socket section constituting an embodiment of a high speed transmission connector according to the present invention.

FIG. 54 illustrates characteristic curves L1 and L2 of the impedance variation due to the above-mentioned recess wherein a vertical axis represents the impedance (Ω) and a horizontal axis represents a time (s).

The characteristic curve L1 represents a case wherein the groove 40AG or the grooves 42G1 to 42G3 are formed and a width of the contact pad 30*cp* is 0.48 mm as shown in FIG. 22B or 22C. Also, the characteristic curve L2 represents another case wherein there are no such grooves and a width of the contact pad 30*cp* is 0.48 mm as shown in FIG. 22A.

Further, a characteristic curve L3 represents the impedance variation in a case wherein there are no recesses and a width of the contact pad is defined as 0.75 mm.

One contact unit 18Bi of the connector according to this embodiment includes a single ground blade 24 and two transmission blades 26, all of which are piled together to form a single blade. In each of the cells 10Si of the housing 10C for receiving a plurality of blades, a guide groove is provided for receiving the respective contact unit 18Bi.

However, the respective guide groove is formed somewhat larger than a thickness of the contact unit 18Bi for the purpose of receiving the latter. Accordingly, there is an unintended gap between the contact unit 18Bi and the housing.

Thereby, the signal line exposed on the surface thereof and the inner circumference of the partitioning wall 10Wi forming the cell 10Si may be in tight contact with each other or opposed to each other at a gap therebetween. If the surface of the signal line is in tight contact with the resin or there is a gap therebetween, a large variation occurs in the impedance in accordance with sizes of the gap as shown in FIG. 52.

Figure 52:
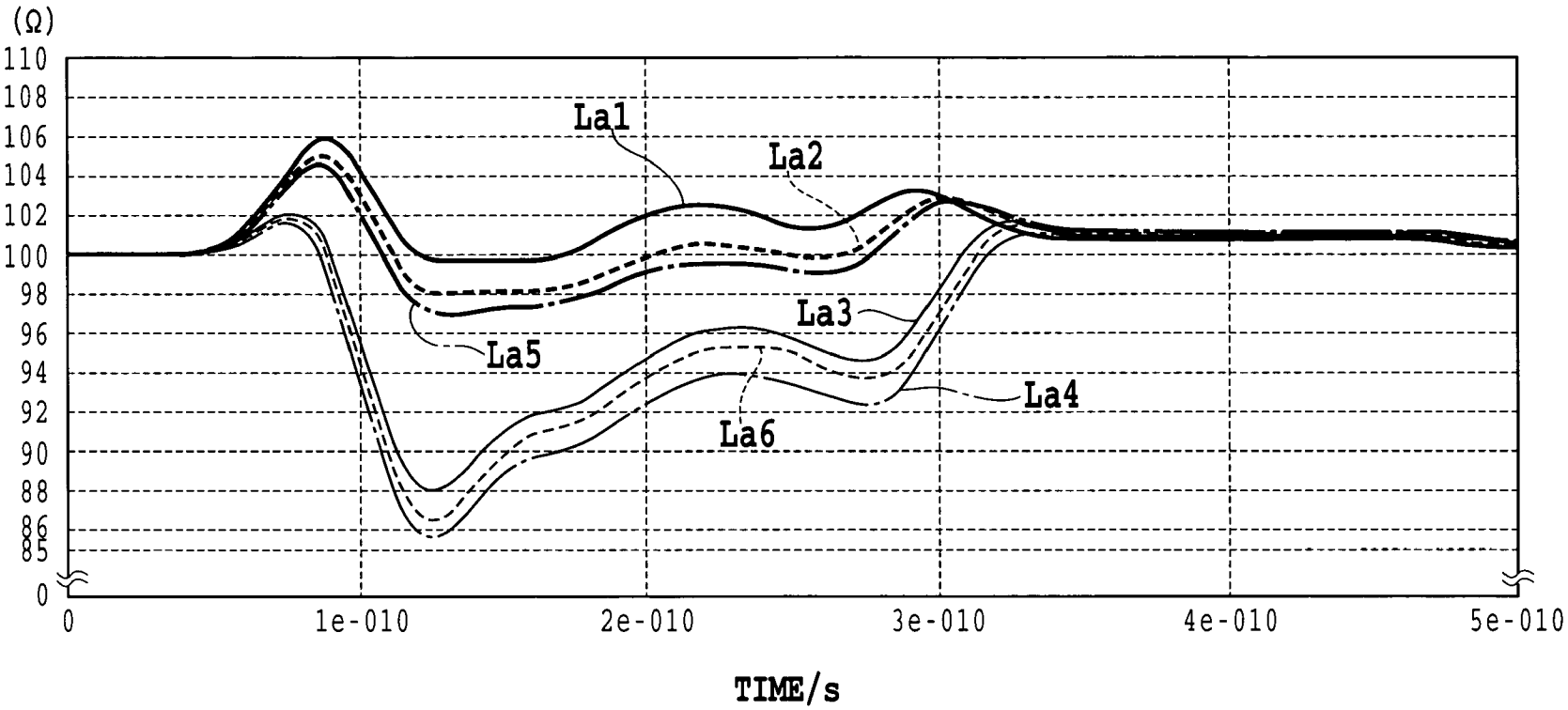
FIG. 52 is characteristic diagram illustrating the impedance characteristic of the plug section and the socket section constituting one embodiment of a high speed transmission connector according to the present invention.

FIG. 52 illustrates characteristic curves La1, La2, La3 and La4 of the impedance variations in accordance with sizes of the gap AGS between a surface of the partitioning wall 10Wi in the above-described casing 10C and a common surface of areas wherein the contact terminals 30*a* to 30*m* of the transmission blade 26 are embedded, which curves are represented on the coordinates wherein the vertical axis shows the impedance (Ω) and the horizontal axis shows a time (s). The characteristic curves La1, La2, La3, La4, La5 and La6 represent the impedance characteristics when the gaps AGS are 0.1 mm, 0.05 mm, 0.03 mm, 0 mm, 0.04 mm and 0.02 mm, respectively.

To prevent the impedance variation due to such unintentional gap from occurring; that is, to stabilize the impedance in the vicinity of 100Ω, a gap is provided between a surface of the signal line and an inner circumference of the partitioning wall 10Wi of the housing 10C. This gap is determined to be larger than a size (approximately 0.05 mm) at which the impedance variation becomes less, so that even if the finished dimension of the housing blade varies, the impedance variation is minimum. In this embodiment, projections (not shown) are provided in the transmission blade 26 for avoiding the contact terminals 30*a* to 30*m* and incorporated in the housing 10C to provide the gaps.

Further, in this embodiment, to increase the number of contact units 18Bi accommodated in the housing 10C per 1 inch, a thickness of the contact unit 18Bi is made as thin as possible.

That is, when the ground blade 24 and two transmission blades 26 are piled together, air layers AG are formed between the ground contact terminals 22G1 to 22G6 and the substrate 26B of the transmission blade 26 as described before (see FIGS. 16A and 16B).

Since the relative dielectric constant of air is 1.0 and that of the resinous material such as liquid crystal polymer (LCP) is approximately 3.0, the air layer (air gap) AG, for example, of 0.1 mm thick corresponds to LCP of approximately 0.173 mm thick (about 93.0 (=1.73) times), while the air layer AG of 0.2 mm thick corresponds to the resinous material of 0.34 mm thick.

Accordingly, since the transmission blade 26 is provided on each of opposite surfaces of the ground blade 24, a thickness of the contact unit 18Bi (blade) could be reduced by twice the above-mentioned value in comparison with a case wherein no air layer AG is formed.

Figure 53:
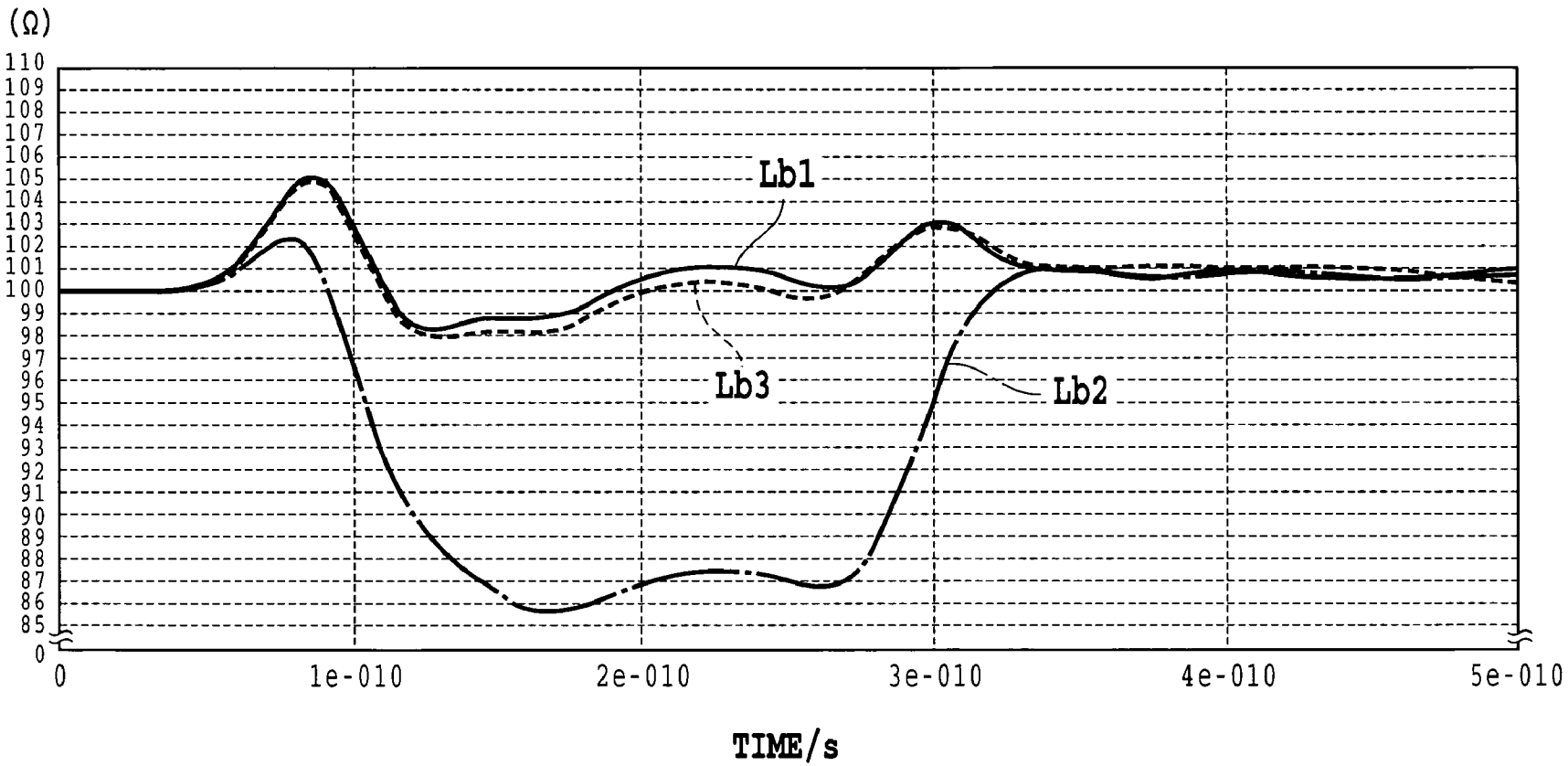
FIG. 53 is characteristic diagram illustrating the impedance characteristic of the plug section and the socket section constituting an embodiment of a high speed transmission connector according to the present invention.

Results regarding the influence of the air layer AG on the impedance verified and obtained by the inventors of the present invention are shown in FIG. 53. The verification was carried out by measuring the impedance of the transmission blade 26 combined with the ground blade 24 as shown in FIG. 16A.

FIG. 53 shows the characteristic curves Lb1, Lb2 and Lb3 of the impedance variations in the transmission blade 26 caused by the existence or non-existence of the air layer AG on the coordinates wherein a vertical axis represents the impedance (Ω) and a horizontal axis represents a time (s).

The characteristic curve Lb1 represents the impedance variation when the air layer is not provided but a thickness of the transmission blade 26 is increased by 0.17 mm than the predetermined value, and the characteristic curve Lb2 represents the impedance variation when the air layer is not provided but a thickness of the transmission blade 26 is maintained at a predetermined value. Further, the characteristic curve Lb3 represents the impedance variation when the air layer of 0.08 mm thick is provided and a thickness of the transmission blade is maintained at a predetermined value.

As apparent from the characteristic curves Lb1 and Lb3 in FIG. 53, when the air layer AG of 0.08 mm thick is provided, or when the thickness of the transmission blade 26 is made to be thicker by 0.17 mm than the predetermined value, the impedance of the transmission blade 26 is stabilized at a value in the vicinity of 100(Ω)±2, whereby the impedance matching is resulted. On the other hand, as apparent from the characteristic curve Lb2, when there is no air layer AG, the impedance is stabilized at a value considerably lower than 100(Ω).

Figure 23A:
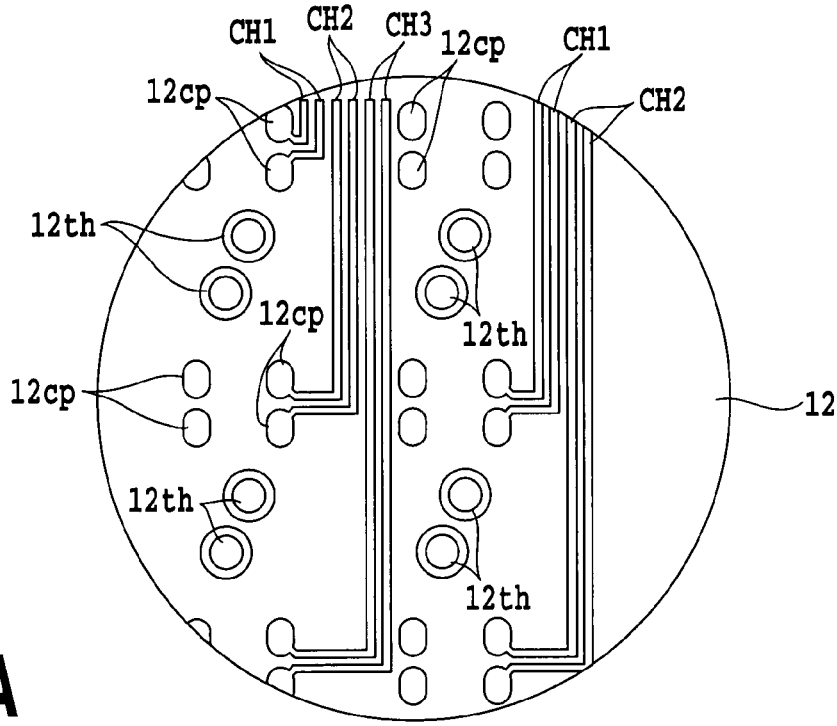
FIGS. 23A and 23B are partially enlarged views, respectively, showing an example of a conductive pattern of a printed wiring board.

A conductive pattern of the printed wiring board 12, with which are in contact or fixed the terminal part 30*t* of the transmission blade 26 and the terminal parts 22*gt* and 22*gt'* of the ground blade 24 is formed as shown in FIG. 23A in a partially enlarged manner. In this regard, in FIG. 23A, a part is illustrated wherein two contact units 18Bi are disposed adjacent to each other.

In this conductive pattern, a plurality of pairs of plated through-holes 12*th* is formed at a predetermined apart, into which the terminal sections 22*gt* and 22*gt'* of the ground blade 24 in a single contact unit 18Bi are press-fit. Between the pairs of plated through-holes 12*th* adjacent to each other, lands 12*cp* are formed at four positions. Two in the four lands 12*cp* are formed on one line extending in the arrangement direction of the plated through-holes 12*th*.

The lands 12*cp* adjacent to each other while putting the pair of through-holes 12*th* therebetween are connected to signal paths CH1, CH2 and CH3 forming three channels, respectively. The signal paths CH1, CH2 and CH3 are formed parallel to each other between the lands 12*cp* for one of the adjacent contact unit 18B1 and the lands 12*cp* for the other of the adjacent contact unit 18Bi.

Figure 23B:
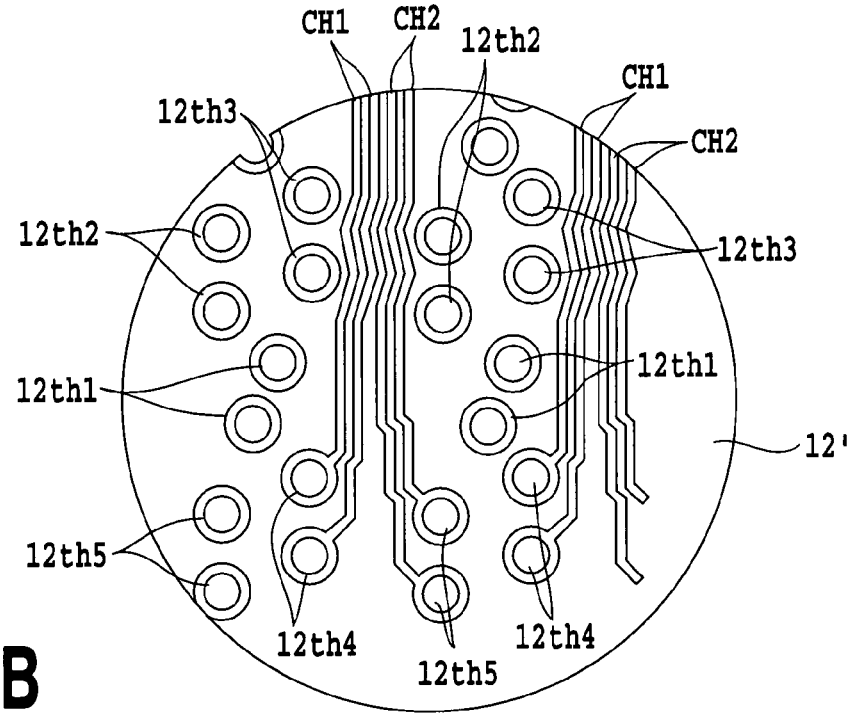

As shown in FIG. 23B, when signal paths CH1 and CH2 forming two channels are necessary between the adjacent contact units 18Bi in the conductive pattern of a printed wiring board 12', further four pairs of plated through-holes 12*th*2, 12*th*3, 12*th*4 and 12*th*5 may be formed, into which are press-fit the terminal parts 30*t* of the transmission blade 26, respectively, in an area between the pair of plated through-holes 12*th*1, into which are press-fit the terminal parts 22*gt* and 22*gt'* of a single ground blade 24. To the plated through-holes 12*th*4 and 12*th*5, the signal paths CH1 and CH2 are connected, respectively.

Since the ground blade 24 and the transmission blade 26 in the respective contact unit 18Bi thus structured have the flexibility and the ground blade 24 and the transmission blade 26 are not adhered to each other, a structure is obtained wherein three plates are piled together when the contact unit 18Bi is incorporated in the cell 10Si of the casing 10C.

Figure 9:
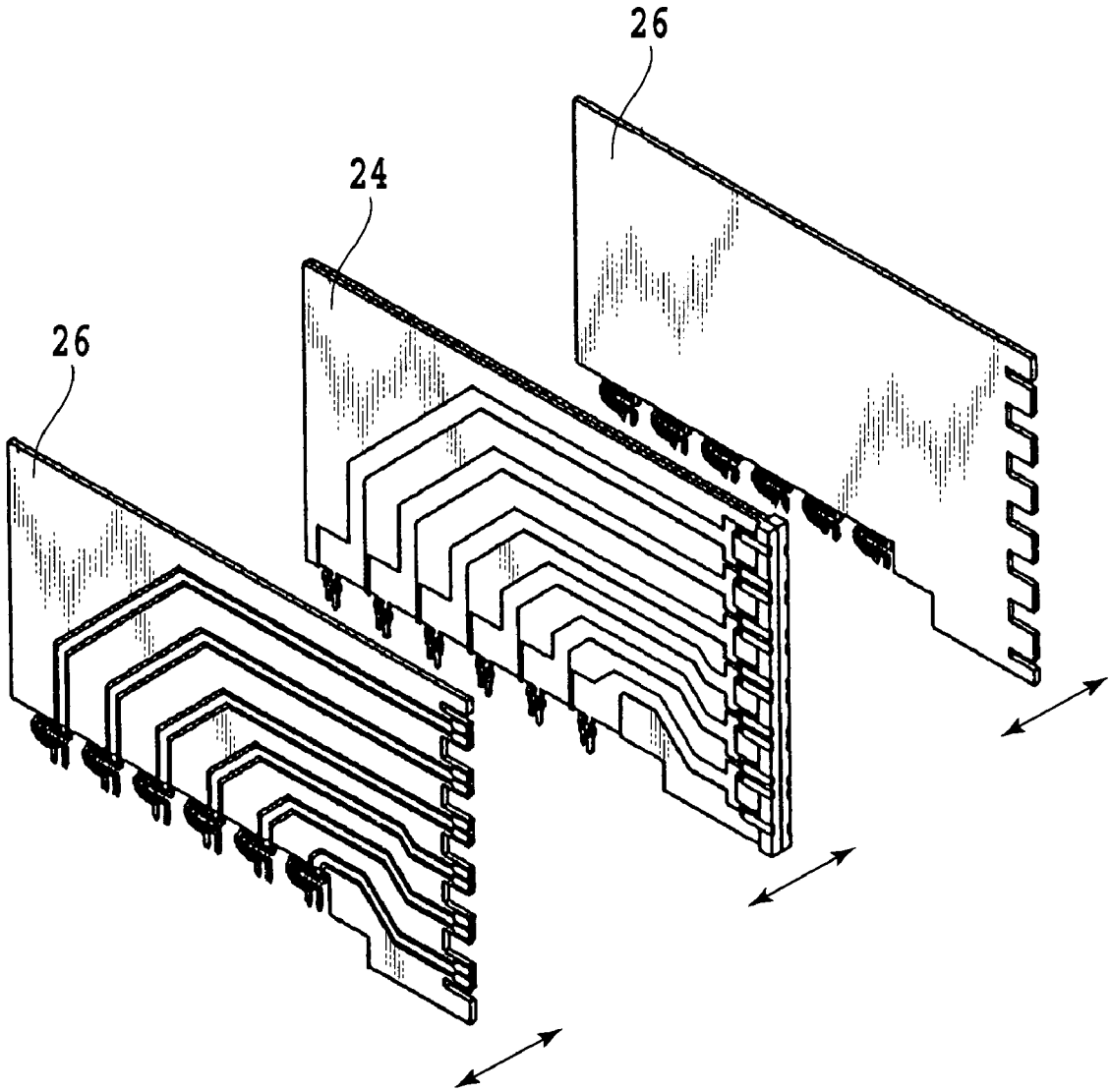
FIG. 9 is an exploded perspective view of the contact unit in the embodiment shown in FIG. 1.

Since a thickness of the respective plate is as thin as 0.4 to 0.7 mm as described before, even if the three plates are piled together, they are easily deformable in the thickness direction as shown in FIG. 9 while slipping to each other.

Figure 13:
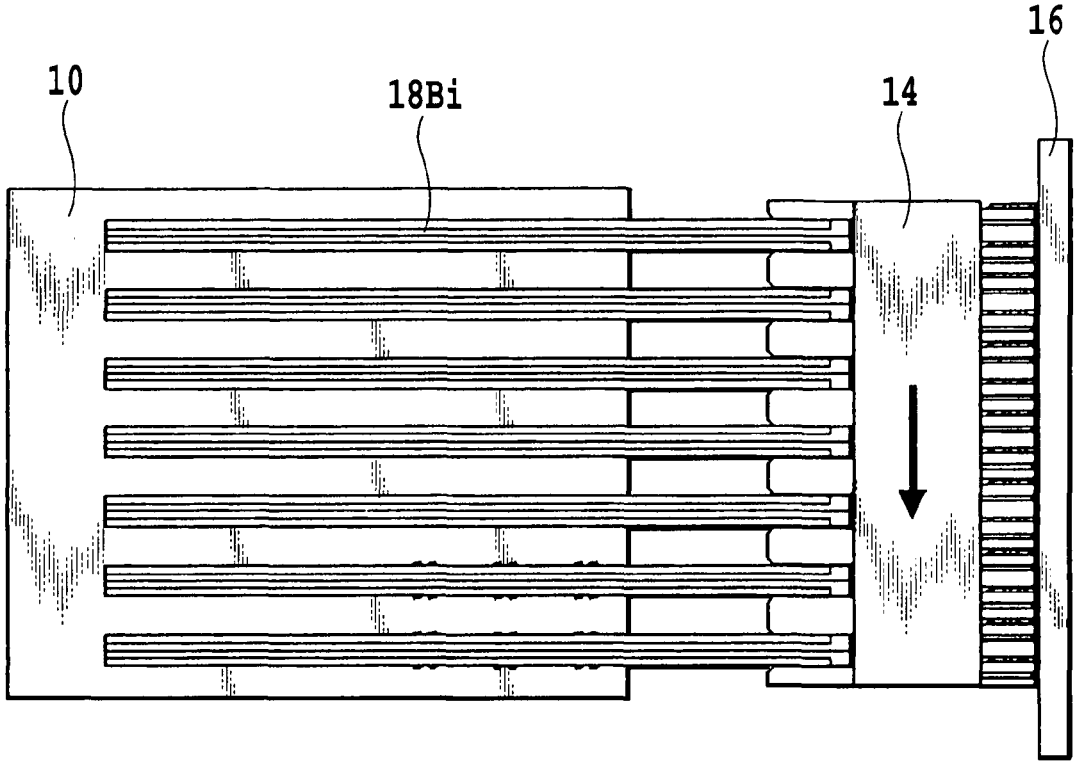
FIG. 13 is an illustration made available for explaining the flexibility of the contact unit in the embodiment shown in FIG. 1.

Accordingly, when the relative positions of the plug section 10 and the socket section 14 deviate from each other in the direction shown by an arrow in FIG. 13, it is possible to absorb the deviation of the mounting position of the socket 14, since a tip end of the contact unit 18Bi (blade) is movable leftward/rightward, even if the fixed terminal section 22*gt* of the respective contact unit 18Bi is mounted and fixed to the printed wiring board 12.

As a result, since the attachment position of the printed wiring boards 12, 16 relative to the housing; the printed wiring boards carrying the plug section 10 and the socket section 14 thereon; can be deviated, the lowering of the contact reliability caused by the increase of load applied to the contact or the lack of contacting force is avoidable, either in a case wherein the plug section 10 and the socket section 14 are engaged with each other or a case wherein the plug section 10 and the socket section 14 are not completely engaged with each other while generating the relative positional deviation in a range from approximately 0.1 to 0.2 mm.

Figure 24:
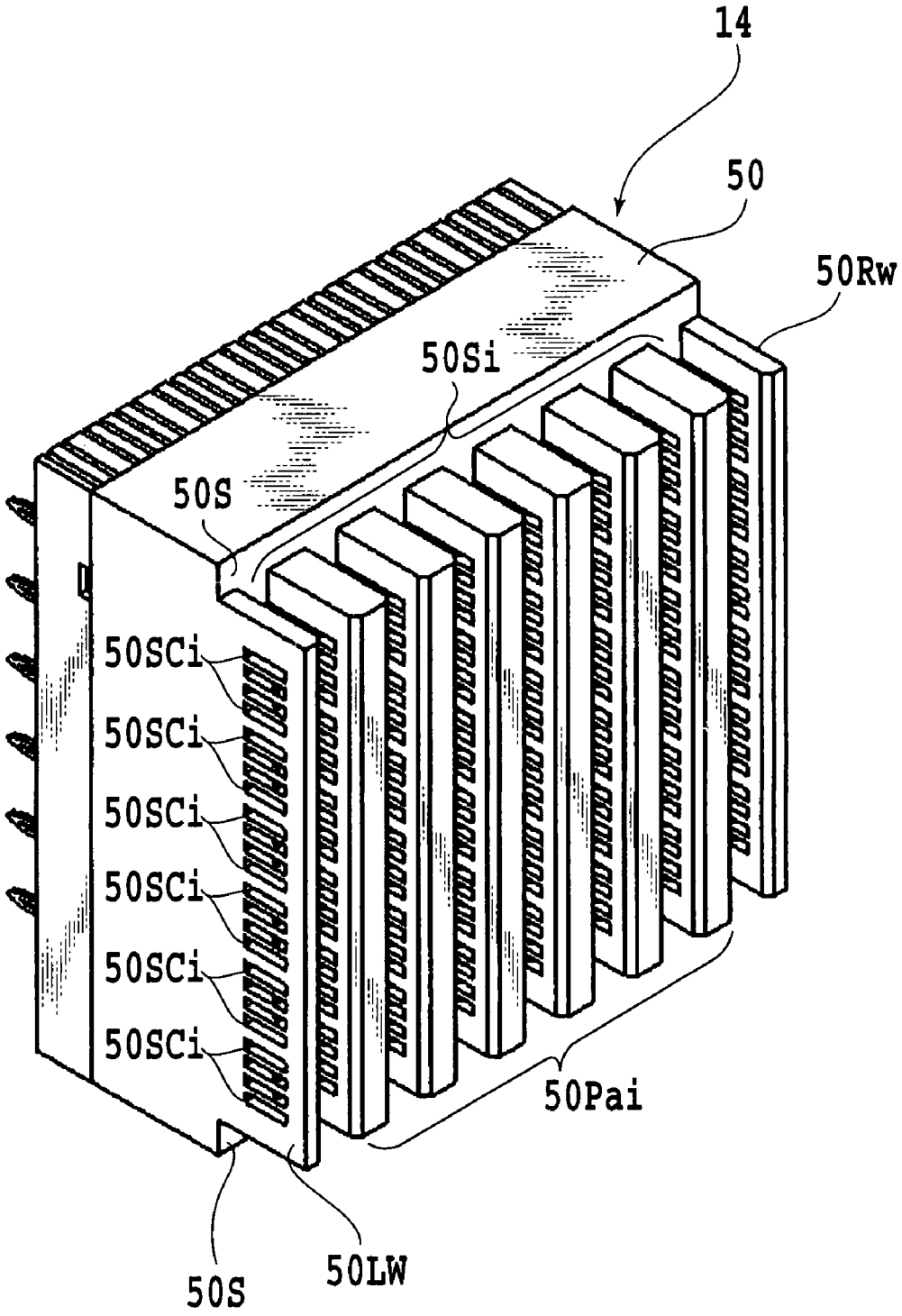
FIG. 24 is a perspective view illustrating an appearance of the socket section constituting one embodiment of a high speed transmission connector according to the present invention.
Figure 25:
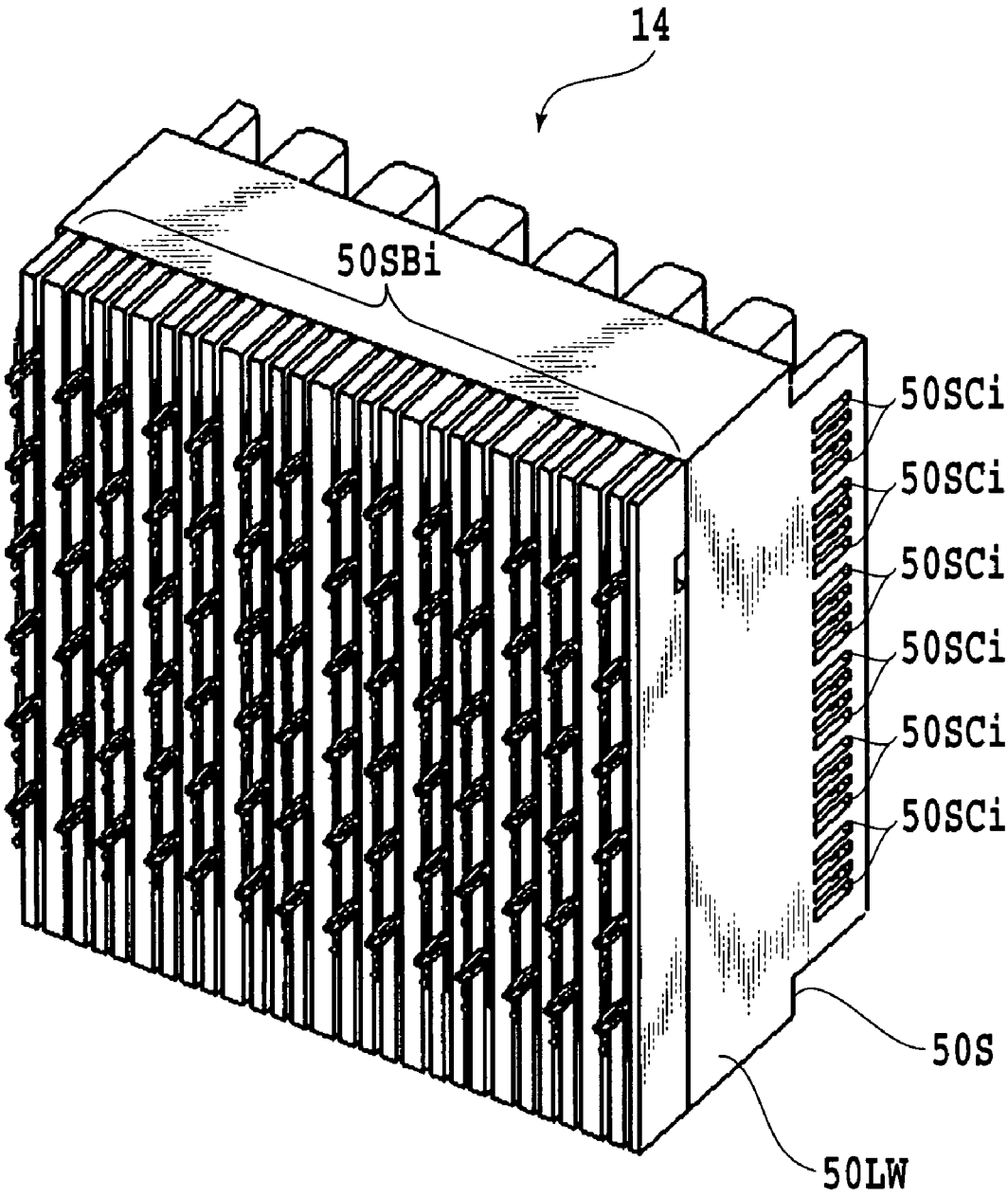
FIG. 25 is a perspective view illustrating a back part of the embodiment shown in FIG. 24.

As shown in FIGS. 24 and 25 in enlarged dimension, the socket section 14 has projections 50Pai (i=1 to n, n is an integer) on one end of a casing 50 molded in one piece with resinous material such as e.g. liquid crystal polymer, which projections form connecting ends projecting to correspond to gaps between the respective contact units 18Bi of the above-mentioned plug section 10. The projections 50Pai are formed between side walls 50RW and 50LW at a predetermined spacing in the arrangement direction of the contact units 18Bi in the plug section 10. A mutual distance of the adjacent projections 50Pai is determined somewhat larger than the thickness of the contact unit 10Bi. Thereby, between the respective adjacent projections 50Pai, a gap 50Si (i=1 to n, n is an integer) is formed.

Each of the projections 50Pai, the side walls 50RW and 50LW is of a rectangular parallelepiped shape and formed generally parallel to each other. On the respective surfaces of the projections 50Pai and the side walls 50R and 50LW opposed to each other, slits 50SCi (i=1 to n, n is an integer) are formed at a predetermined interval, through which contact parts of the ground contact terminals 54 and the signal contact terminals 52 to be described later are exposed, respectively.

Figure 26:
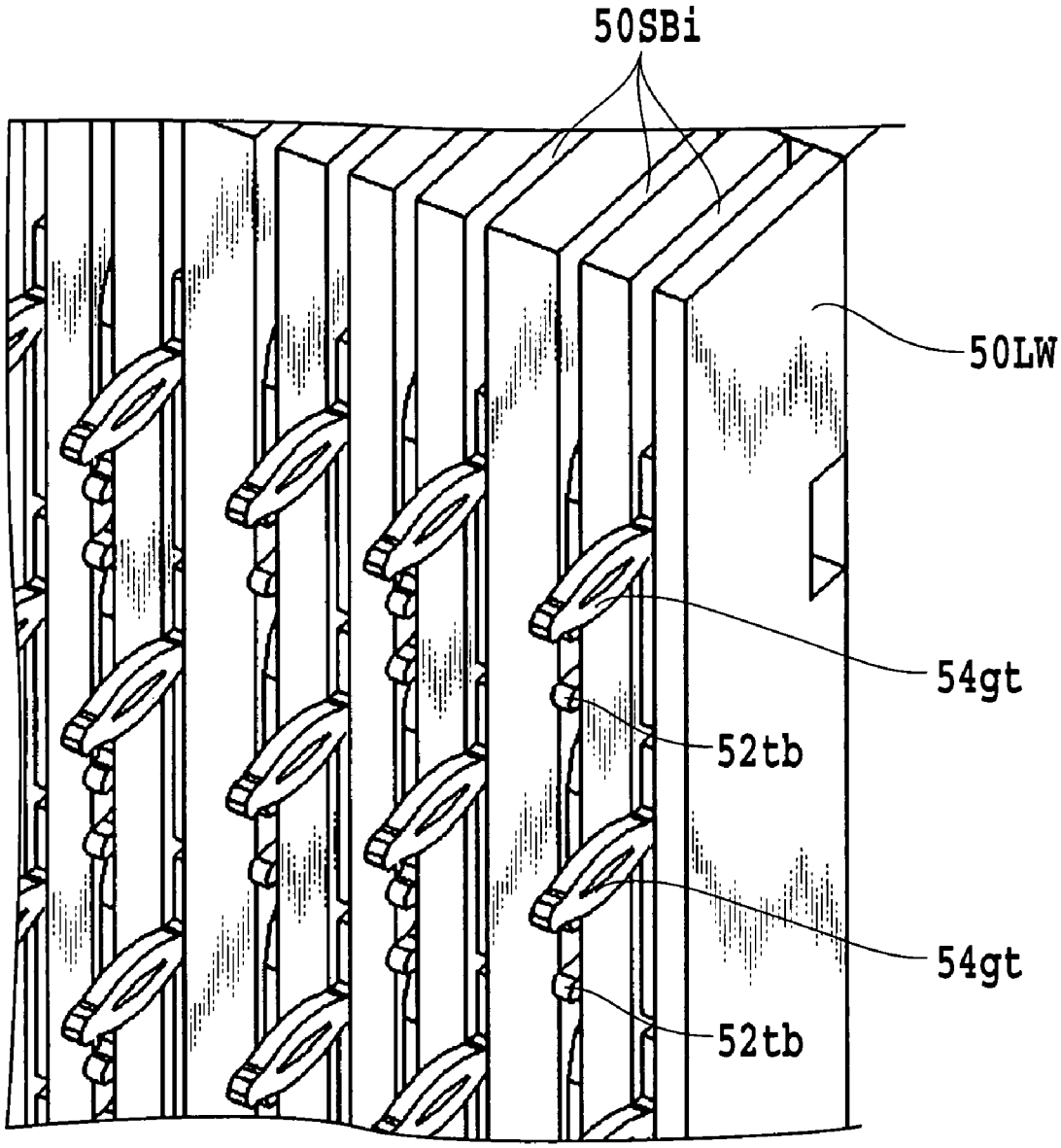
FIG. 26 is a partially enlarged view of the embodiment shown in FIG. 25.
Figure 28:
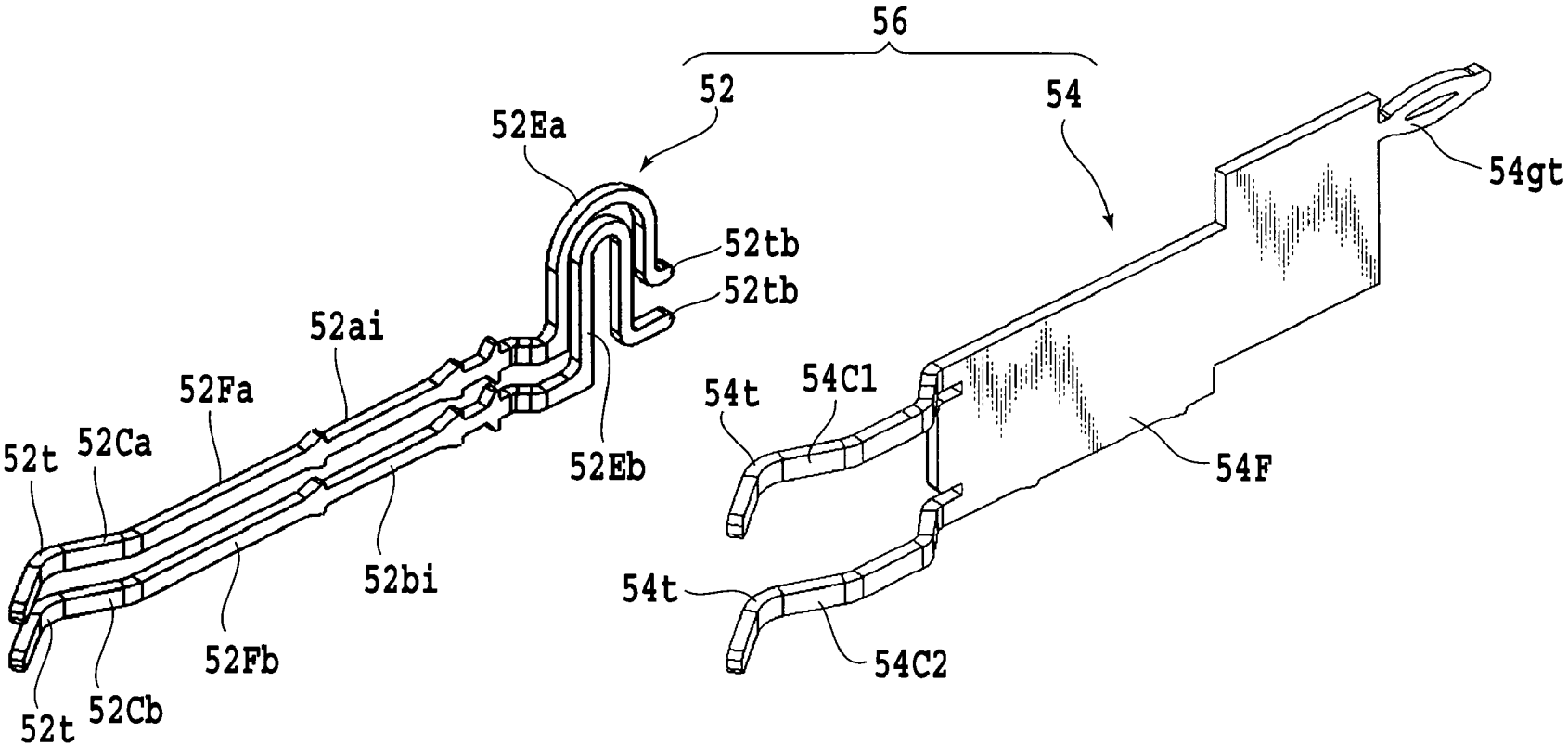
FIG. 28 is a perspective view illustrating the ground contact terminal and the signal contact terminal constituting a socket contact used in the socket section shown in FIG. 24.

The casing 50 has a plurality of slits 50SBi (i=1 to n, n is an integer) on the inside thereof for accommodating the ground contact terminals 54 or the signal contact terminals 52 (see FIG. 28). The respective slits 50SBi are formed at a predetermined interval and communicated with the interior of the respective projections 50Pai. The adjacent slits 50SBi are divided by partitioning walls, respectively. An open end of the respective slit 50SBi opens to an end surface fixed on the printed wiring board 16 in the socket section 14. Through the open ends of the slits 50SBi, a plurality of fixed terminals 54*gt* and terminals 52*tb* are exposed as shown in FIG. 26 in enlarged dimension.

Figure 31:
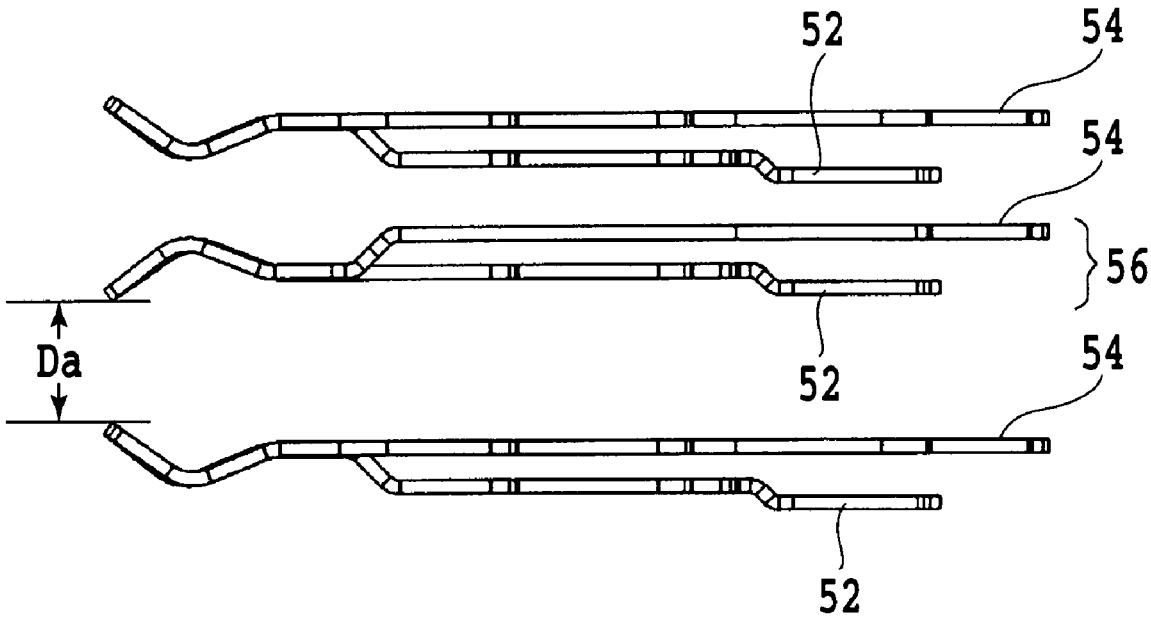
FIG. 31 is a plan view of the embodiment shown in FIG. 30.

A socket contact 56 corresponding to a signal path for one channel is of a microstrip structure (a structure wherein a differential pair signal lines is provided on the ground plate) as shown in FIG. 28, consisting of the ground contact terminal 54 and the signal contact unit 52 including signal contact terminals 52*ai* and 52*bi*. As shown in FIG. 26, in the respective adjacent slits 50SBi, the ground contact terminal 54 and the signal contact unit 52 are arranged, respectively. For a pair of terminals 22Gc and a pair of contact pad 30*cp*; that is, a two channel signal path; arranged on the opposite surfaces of a single contact unit 18Bi, the socket contacts 56 are disposed facing each other as shown in FIG. 31.

Figure 34:
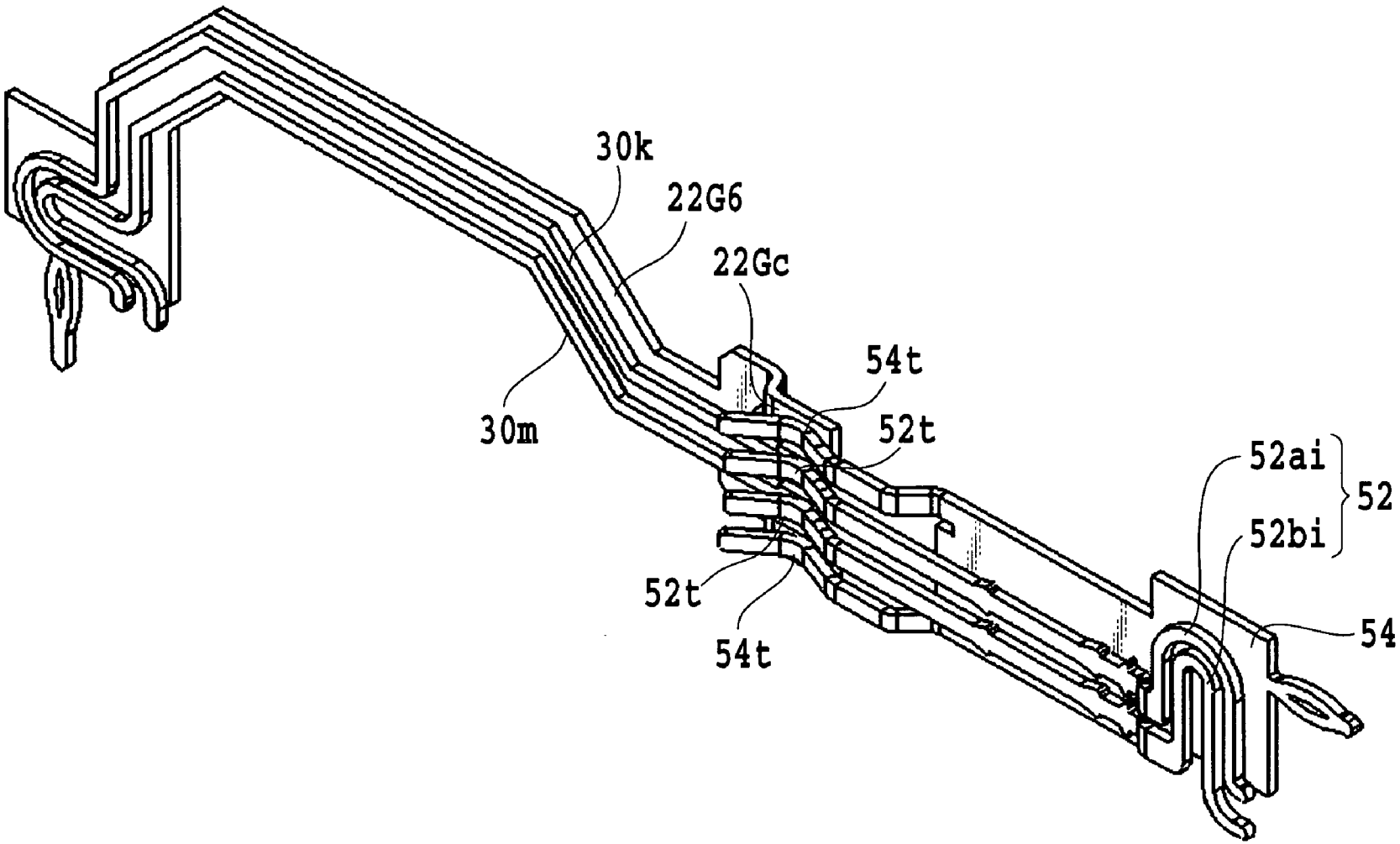
FIG. 34 is a schematic perspective view illustrating a state wherein the socket contact shown in FIG. 28 and the ground contact terminal and the transmission contact terminal shown in FIG. 12 are connected to each other.

As shown in FIG. 34, the ground contact terminal 54 comprises terminal sections 54C1 and 54C2 having contact sections 54*t* in contact with a pair of terminals 22Gc in the contact unit 18Bi when connected to the plug section 10, a fixed terminal section 54*gt* fixed to the conductor of the printed wiring board 16, and a fixed section 54F for connecting the terminal sections 54C1 and 54C2 with the fixed terminal section 54*gt*. The ground contact terminal 54 inserted into the slit 50B1 is positioned and held by locking means (not shown) formed in the slit 50Bi.

The signal contact terminal 52*ai* comprises a terminal section 52Ca having a contact 52*t* in contact with the contact pad 30*cp* of the contact unit 18Bi, a crook 52Ea having a terminal 52*td* in contact with the conductor of the printed wiring board 16, as shown in FIG. 34, when connected to the plug section 10, and a fixed part 52Fa connecting the terminal 52Ca to the crook 52Ea. The terminal section 52Ca and the fixed terminal 52*tb* are elastically deformable.

The signal contact terminal 52*bi* comprises a terminal section 52Cb having a contact 52*t* in contact with the contact pad 30*cp* of the contact unit 18Bi, a crook 52Eb having a fixed terminal 52*tb* in contact with the conductor of the printed wiring board 16, as shown in FIG. 34, when being connected to the plug section 10, and a fixed part 52Fb connecting the terminal 52Cb to the crook 52Eb. The terminal section 52Cb and the fixed terminal 52*tb* are elastically deformable.

As mentioned above, in the differential transmission system, it is preferable so that line lengths between the respective pairs of signal paths are identical to each other. In this embodiment, as shown in FIGS. 36B and 37, a pair of signal paths SL1 and SL2 are formed, respectively, in the crook 52Ea of the signal contact terminal 52*ai* and the crook 52Eb of the signal contact terminal 52*bi*.

In the signal path SL1, since the line length (Length) (mm) of a part Lout having a larger radius of curvature and that of a part Lin having a smaller radius of curvature are 5.44 mm and 5.8 mm, respectively, an average value Ave of the line lengths is 5.62 mm. Also, in the signal path SL2, since the line length (Length) (mm) of a part Lout having a larger radius of curvature and that of a part Lin having a smaller radius of curvature are 6.35 mm and 6.67 mm, respectively, an average value Ave of the line lengths is 6.51 mm. Thus, the difference of the line lengths ΔL in the pair of signal paths SL1 and SL2 is 0.89 mm.

Figure 36A:
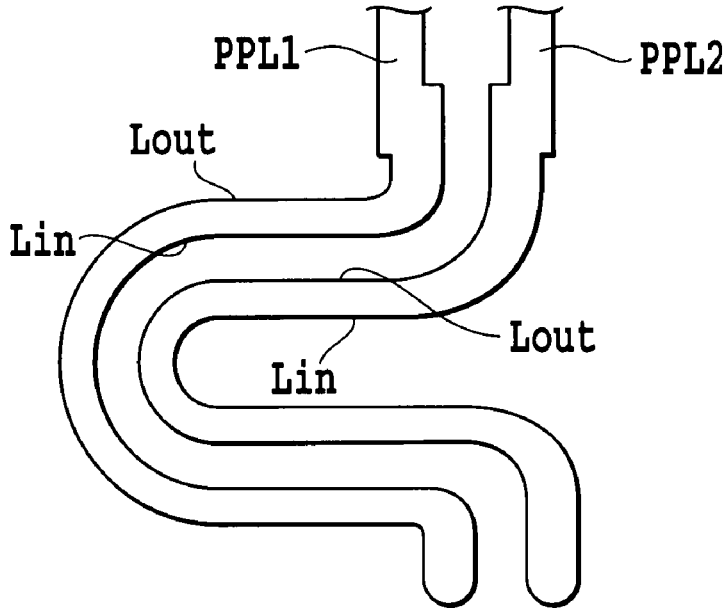
FIGS. 36A and 36B are illustrations, respectively, made available for explaining a line length of a crook of the signal contact terminal.
Figure 36B:
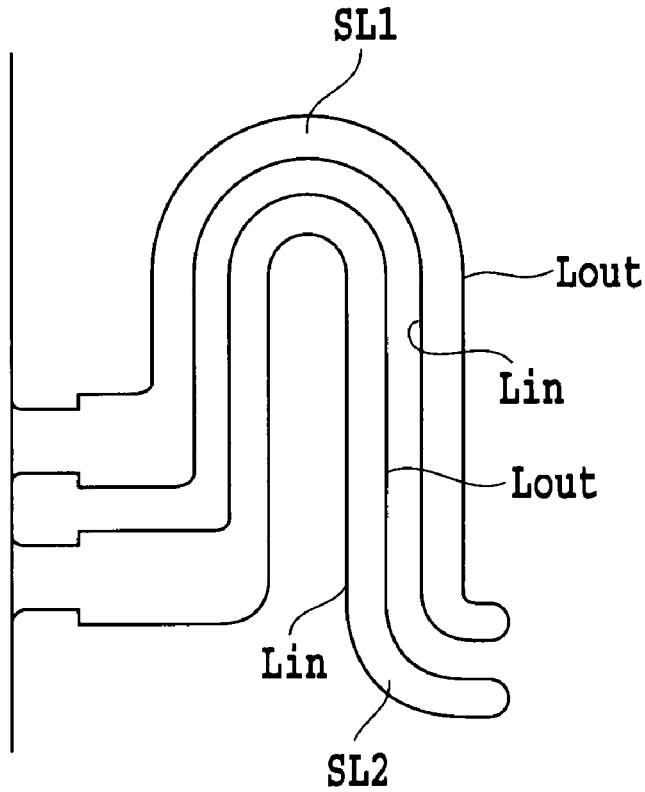

On the other hand, as shown in FIGS. 36A and 37, in the crooks 30*bn* of the contact terminals 30*a* to 30*m* in the above-mentioned plug section 10, adjacent contact terminals 30*a* and 30*b* form a pair of signal paths PPL1 and PPL2. Since the line length (Length) (mm) of a part Lout having a larger radius of curvature and that of a part Lin having a smaller radius of curvature are 5.416 mm and 5.566 mm, respectively, an average value Ave of the line lengths is 5.491 mm. Also, in the signal path SL2, since the line length (Length) (mm) of a part Lout having a larger radius of curvature and that of a part Lin having a smaller radius of curvature are 6.127 mm and 6.277 mm, respectively, an average value Ave of the line lengths is 6.202 mm. Thus, the difference of the line lengths ΔL in the pair of signal paths PPL1 and PPL2 is 0.711 mm.

Accordingly, the differences of the line lengths in the crooks 30*bt*, 52Ea and 52Eb (compression contact areas) of the plug section 10 and the socket section 14 are in a range from 0.711 to 0.89 mm.

In such cases, if the longer signal path PPL2 is connected to a shorter signal path in the signal paths PL 6 of the above-mentioned plug section 10 (see FIGS. 20 and 21), the difference of the whole line lengths is further reduced by approximately 0.5 mm. That is, for the purpose of absorbing the difference in the whole line lengths, the difference of the line lengths in the compression contact areas is used.

Figure 32A:
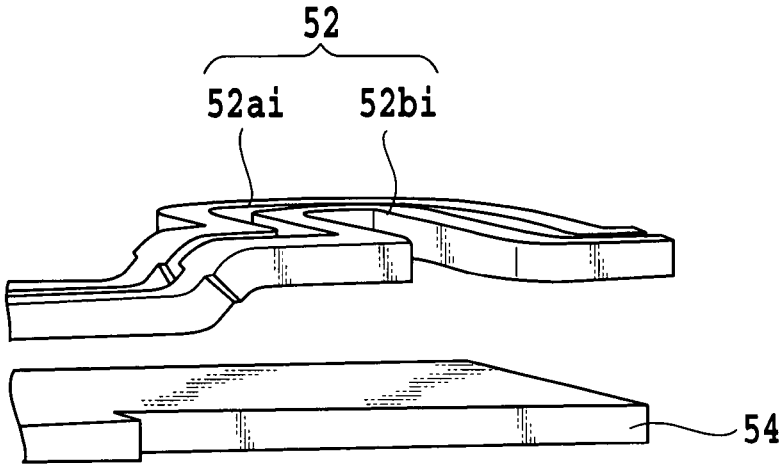
FIGS. 32A and 32B are partially enlarged perspective views, respectively, of a crook of the signal contact terminal shown in FIG. 28.
Figure 32B:
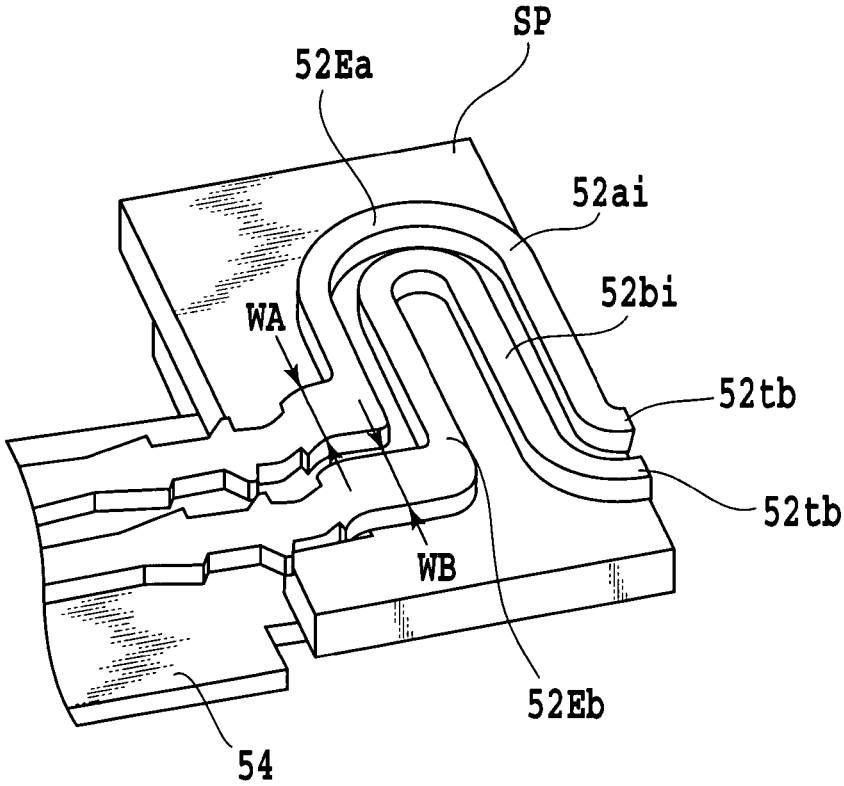

Since the radius of curvature in the crook 52Eb is determined smaller than that of the crook 52Ea, it is possible to dispose the signal contact terminals 52*ai* and 52*bi* in a common plane as shown in FIG. 31 by positioning the crook 52Eb inside the crook 52Ea. At that time, the crooks 52Ea and 52Eb are supported in a positioned state by being press-fit into a groove of a supporting member SP (see FIG. 32B). The supporting member SP for holding a predetermined number of signal contact units 52 is inserted into a slit 50Bi adjacent to a slit 50SBi into which is inserted the ground contact terminal 54, and positioned there. Since there are bending portions, respectively, in a boundary area between the crook 52Ea and the fixed part 52Fa and that between the crook 52Eb and the fixed part 52Fb, the impedance may increase. Accordingly, as shown in FIGS. 32A and 32B in enlarged dimension, widths WA and WB of the bending portions are set to be larger than those of the fixed parts 52Fa and 52Fb and the crooks 52Ea and 52Eb.

Figure 29A:
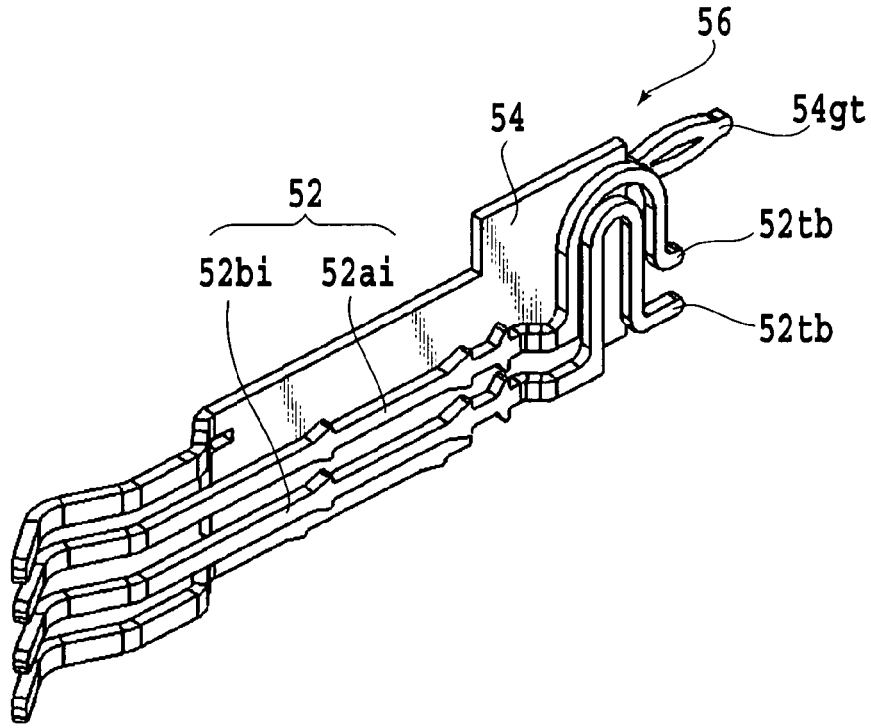
FIGS. 29A and 29B are perspective views showing the socket contacts, respectively, wherein the ground contact terminal and the signal contact terminal shown in FIG. 28 are combined together.
Figure 29B:
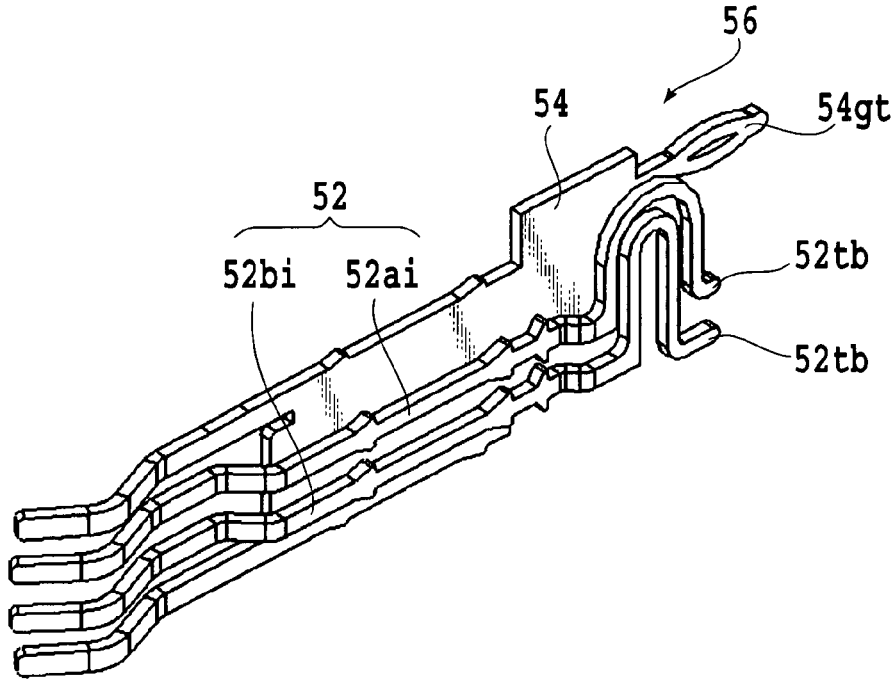
Figure 30:
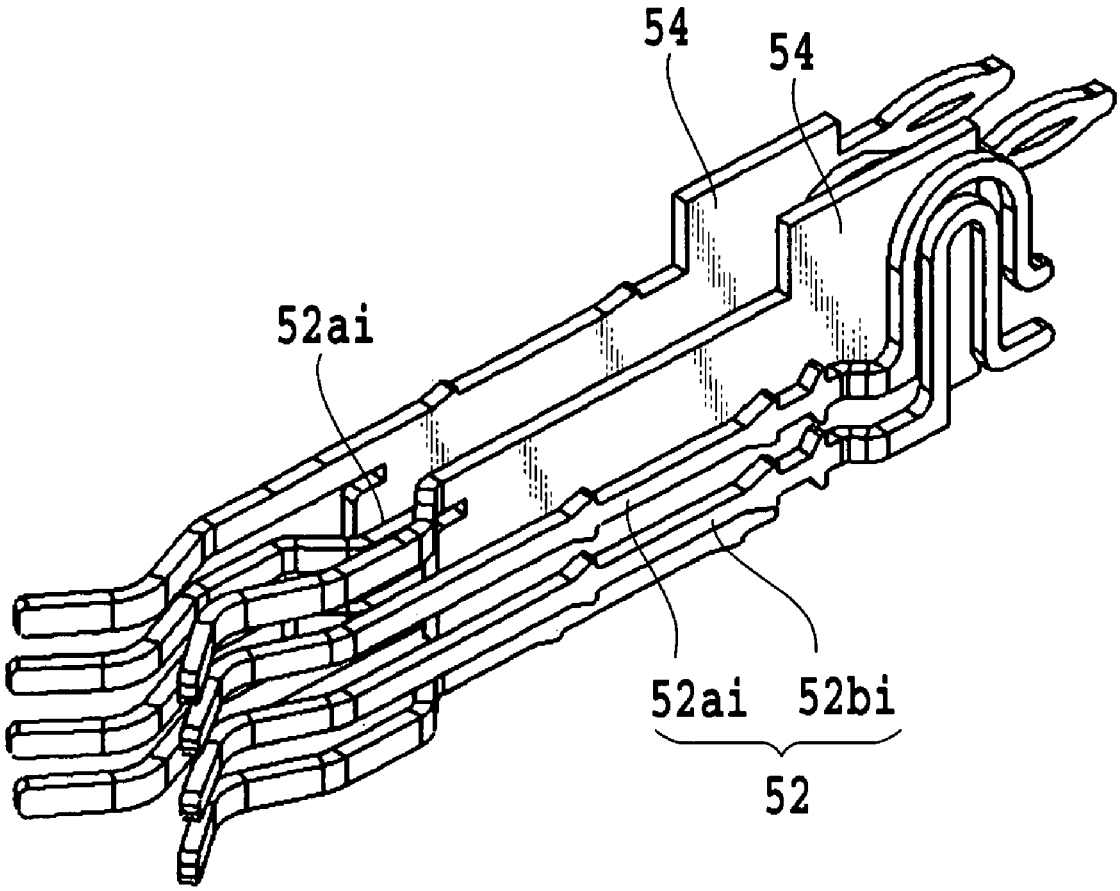
FIG. 30 is a perspective view showing a state wherein the socket contacts shown in FIG. 28 are combined facing each other.

As shown in FIGS. 29A and 29B, in the signal contact terminal 52*ai* and the signal contact terminal 52*b*1 wherein the crook 52 Eb is disposed inside the crook 52Ea, the terminal sections 52Ca and 52Cb thereof are disposed between the terminal sections 54C1 and 54C2 of the ground contact terminal 54. At that time, the contact sections 54*t* of the terminal sections 54C1 and 54C2 and the contact sections 52*t* of the signal contact terminal 52*ai* and the signal contact terminal 52*bi* are positioned within the slits 50SCi.

Figure 27:
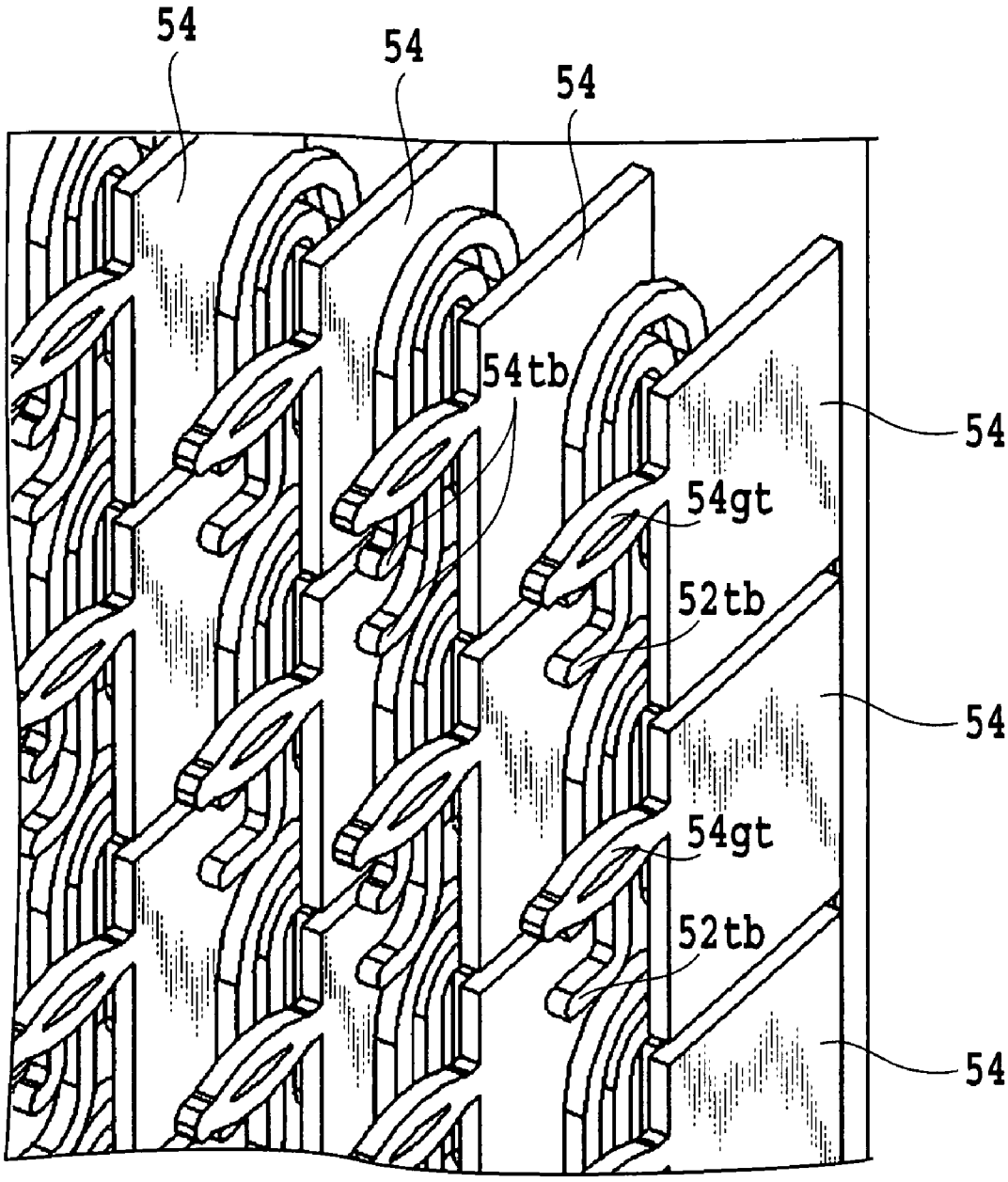
FIG. 27 is a partially enlarged perspective view of an end of the contact terminal while removing a partitioning wall in the embodiment shown in FIG. 26.
Figure 33:
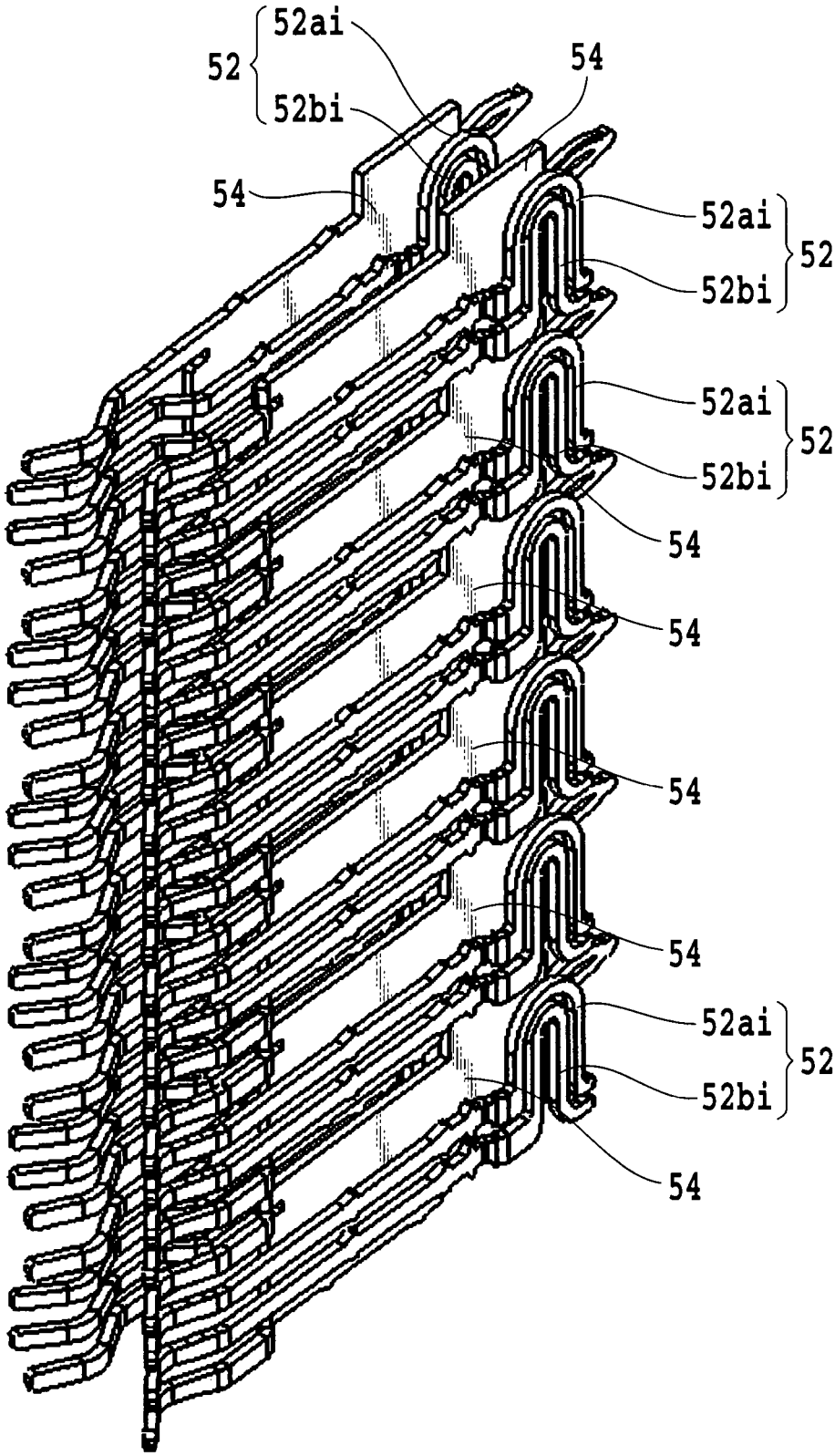
FIG. 33 is a perspective view showing a state wherein a plurality of socket contacts shown in FIG. 28 is arranged.

Thereby, as shown in FIGS. 27 and 33, the socket contacts 56 are disposed in the respective slits 50SBi at a predetermined spacing in the longitudinal direction of the projections 50Pai. When the ends of the contact units 18Bi are inserted into gaps between the socket contacts 56 adjacent to each other in the arrangement direction of the slits 50SBi, the contact units 18Bi are nipped by elastic force of a plurality of terminal sections 54C1 and 54C2 and terminal sections 52Ca and 52Cb.

Figure 35A:
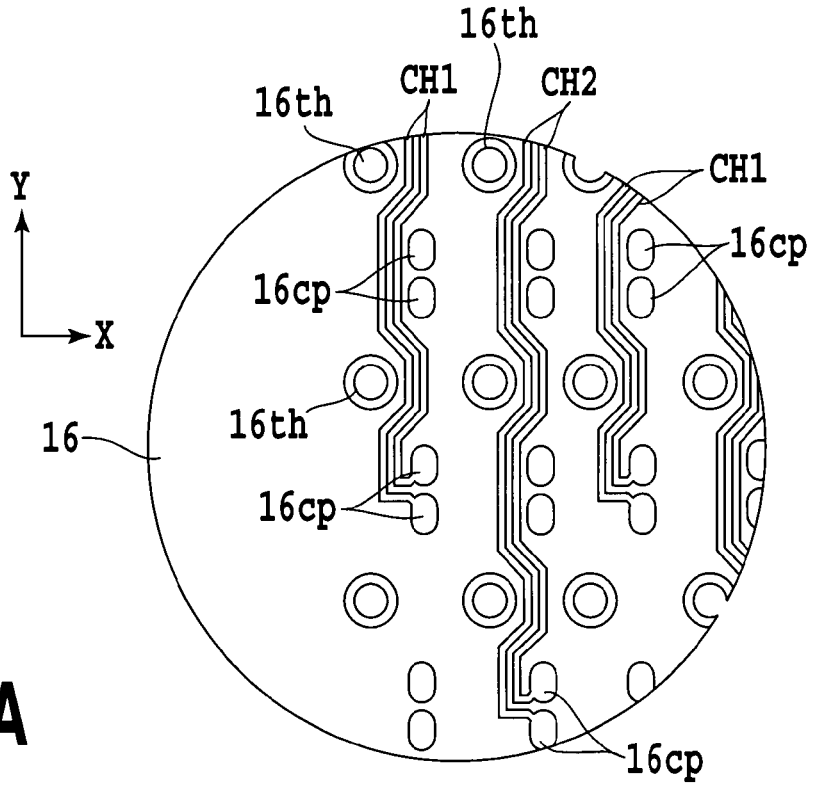
FIGS. 35A and 35B are plan views, respectively, partially showing one embodiment of conductive patterns of the printed wiring board.

The conductive pattern of the printed wiring board 16 is formed as shown in FIG. 35A in a partially enlarged manner. In this regard, FIG. 35A illustrates part of adjacent three rows of the socket contacts 56, each extending in the longitudinal direction of the projection 50Pai; i.e., along an axis Y, and arranged in the arrangement direction; i.e., along an axis X.

In this conductor pattern, through-holes 16*th* into which are press-fit the fixed terminal section 54*gt* of the ground contact 54 are formed at a predetermined interval. Between the adjacent plated through-holes 16*th*, two lands 16*cp* in contact with the respective terminal sections 52*tb* are formed. The two lands 16*cp* are formed on one lone in the arrangement direction of the plated through-holes 16*th*.

A pair of lands 16*cp* adjacent to each other while interposing the plated through-hole 16*th* is connected to a pair of signal paths CH1 forming 1-channel. The lands 16*cp* in the adjacent rows are connected to a pair of signal paths CH2 forming 1-channel.

Figure 35B:
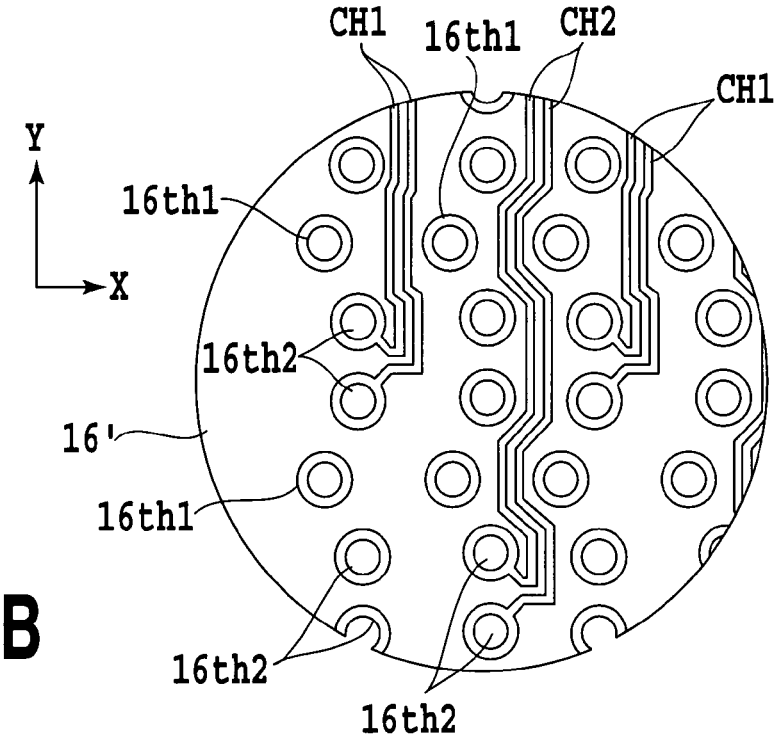

In this regard, when the signal paths CH1 and CH2 forming two channels are necessary in the conductive pattern of the printed wiring board 16', as shown in FIG. 35B in enlarged dimension, a pair of plated through-holes 16*th*2 into which are press-fit the terminal sections, respectively, may be further formed between the pair of plated through-holes 16*th*1 into which are press-fit the terminal sections 52*tb*. A pair of signal paths CH1 and CH2 is connected to the plated through-hole 16*th*2 and the plated through-hole 16*th*2 in the adjacent row, respectively.

In the embodiment of a high speed transmission connector according to the present invention described above, the transmission characteristics of the ground contact terminals 22G1 to 22G6, the contact terminal group 30*a* to 30*m* and the socket contact group 56 were verified as follows by the present inventors while using a 1-channel model and a simulator (MW STUDIO: CST; manufactured by GMBH). As such transmission characteristics, the impedance matching, the insertion loss, the reflectance loss and the jitter were employed.

Figure 38:
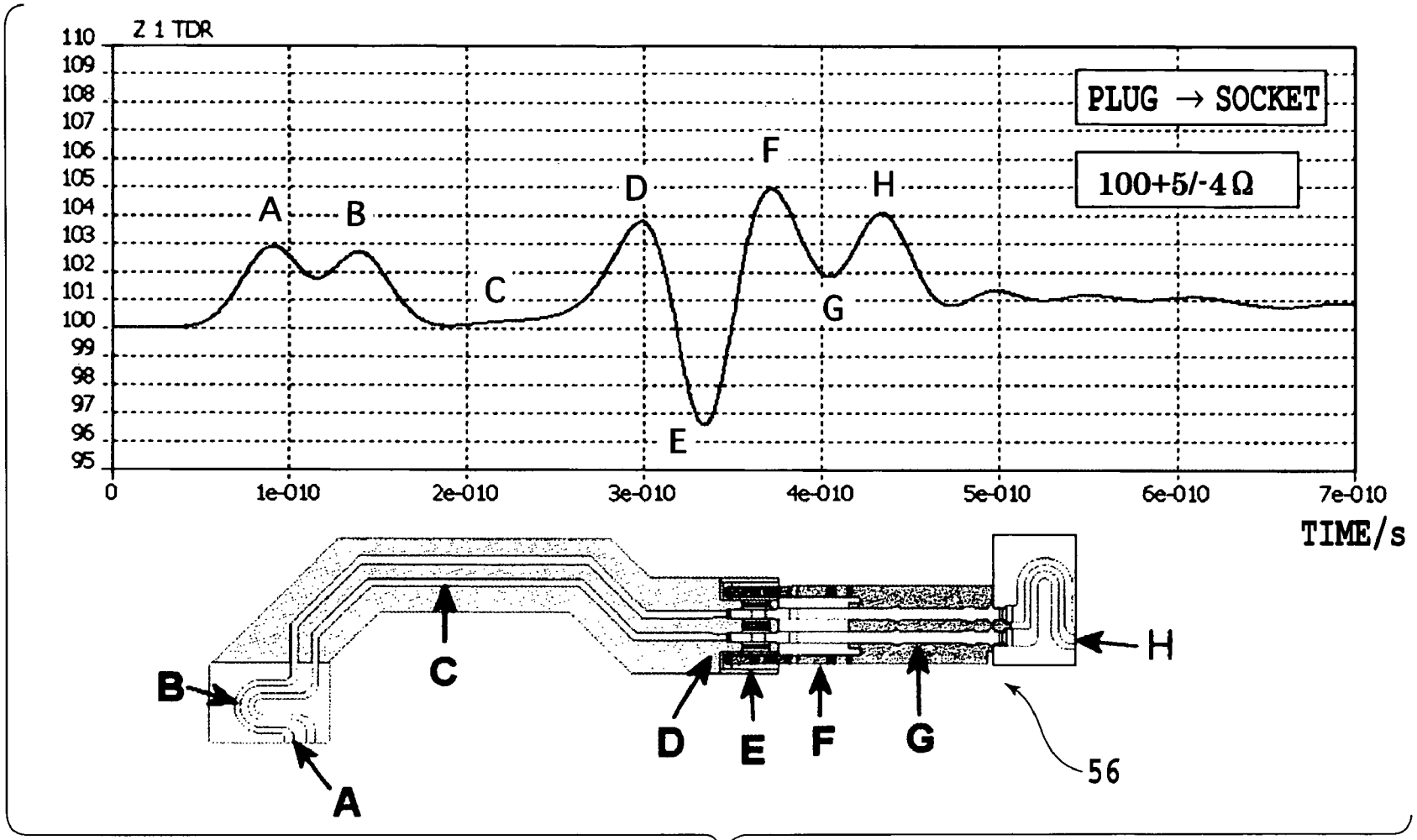
FIG. 38 is a characteristic diagram for illustrating an impedance characteristic in the plug section and the socket section constituting one embodiment of a high speed transmission connector according to the present invention.

FIG. 38 illustrates the transmission characteristic calculated by a 1-channel model wherein one ground contact terminal and one contact terminal selected from the ground contact terminal group 22G1 to 22G6 and the contact terminal group 30*a* to 30*m* which impedance has been adjusted as described above are electrically connected to the socket contact 56.

FIG. 38 illustrates the impedance variation in the respective portions represented on the coordinates wherein a vertical axis indicates the impedance (Ω) and a horizontal axis indicates a time (s). Note references A, B, C, D, E, F and G in the drawing indicate the ground contact terminal, the contact terminal, and locations in the socket contact 56, respectively, and in FIG. 38, the impedances in the respective locations are represented.

Upon the calculation, TDR (Time Domain Reflectometry) method was used for measuring the impedance. That is, in FIG. 38, the impedance variation with time is illustrated when a test signal having a predetermined frequency is input from the location A side.

In this regard, in the TDR measurement of the impedance by pulses, pulses having a standing-up time of 17 psec at the communication speed of 20 Gbps and a standing-up time of 34 psec at the communication speed of 10 Gbps were used. The simulation was carried out in the pulse standing-up time of 17 psec in view of the performance to the communication speed of 20 Gbps. The pulse standing-up time of 17 psec is a very high transmission speed corresponding to approximately 20 Gbps in the differential signal.

As apparent from FIG. 38, an impedance range (variation width) of 100±3Ω was obtained.

Figure 39:
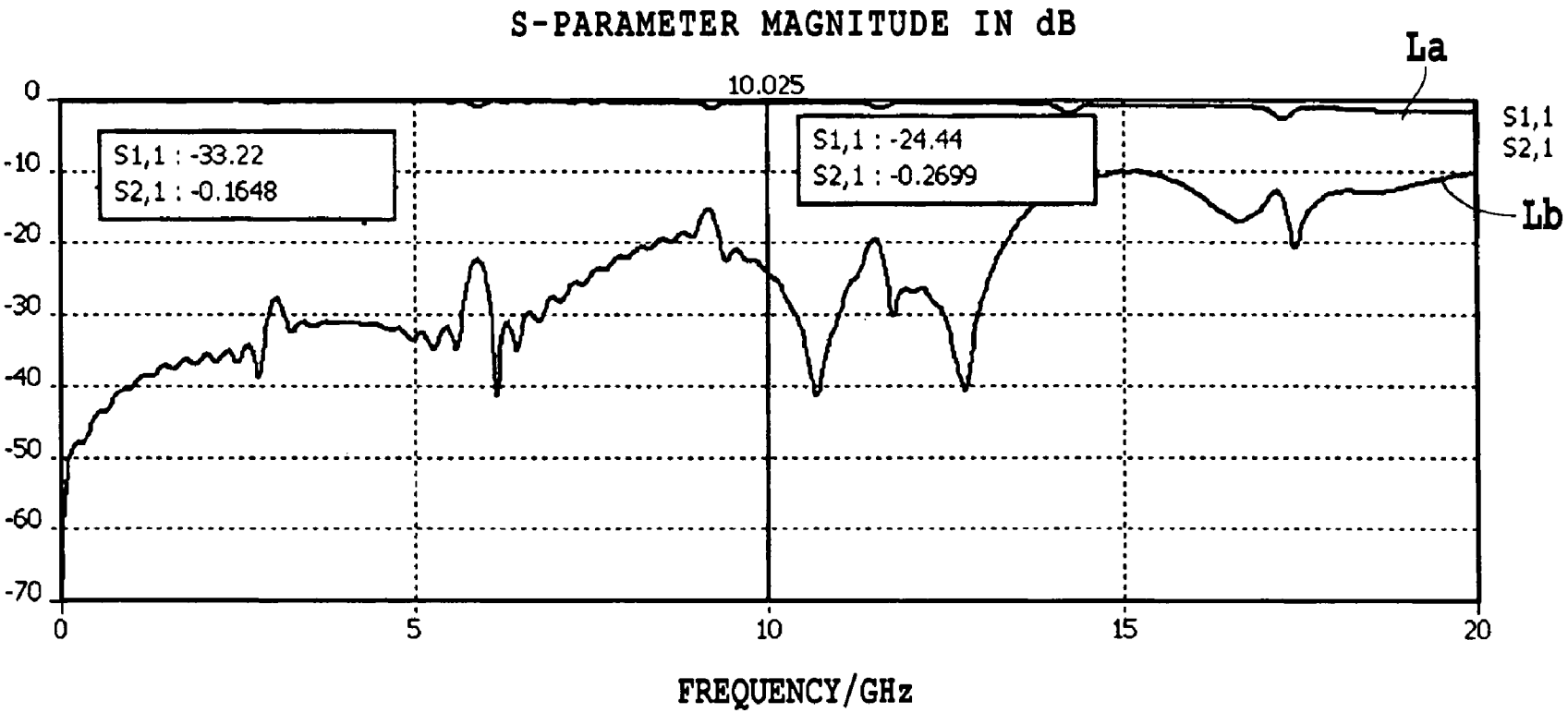
FIG. 39 is a characteristic diagram for illustrating the characteristics of the insertion loss and the reflectance loss in the plug section and the socket section constituting one embodiment of a high speed transmission connector according to the present invention.

FIG. 39 illustrates the insertion loss and the reflectance loss in the same model as that described above. In FIG. 39, the insertion loss characteristic curve Lb and the reflectance loss characteristic curve La are shown on the coordinates consisting of a vertical axis representing decibels (dB) and a horizontal axis representing frequencies (GHz). The frequency range was up to 20 GHz.

As apparent from FIG. 39, in the transmission characteristic at the communication speed 10 Gbps (5 GHz), since the reflection power in relation to the input power is 33 dB=0.05% and the output power is −0.16 dB=96%, a transmission path (connector) having a very small loss could be realized.

Also, when the possibility of signal transmission at the communication speed of 20 Gbps, the reflection power in relation to the reflection power is −24 dB=4% and the output power is −0.16 dB=94%. Since it is generally said that the connector loss is preferably −1 dB or less, it is apparent that this connector is sufficiently practical.

Figure 40A:
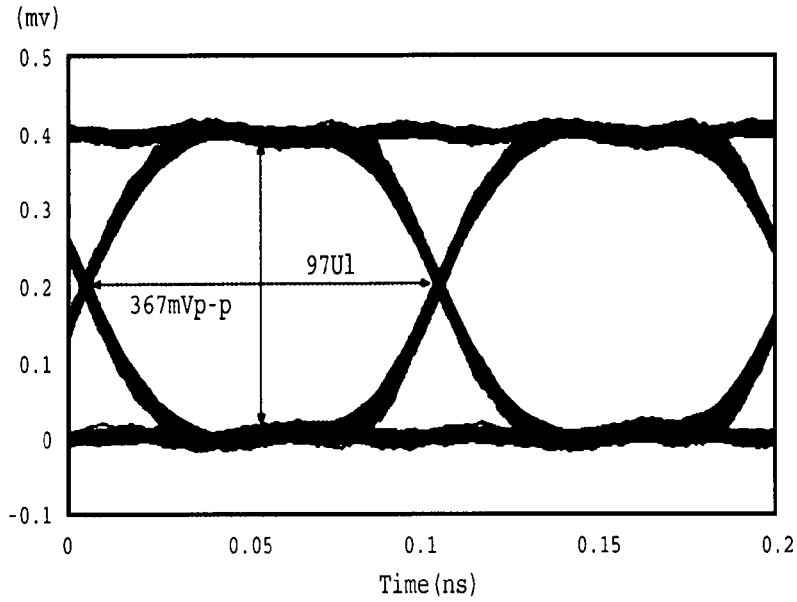
FIGS. 40A and 40B are eye diagrams, respectively, illustrating jitter characteristics in the plug section and the socket section, respectively, constituting on embodiment of a high speed transmission connector according to the present invention.
Figure 40B:
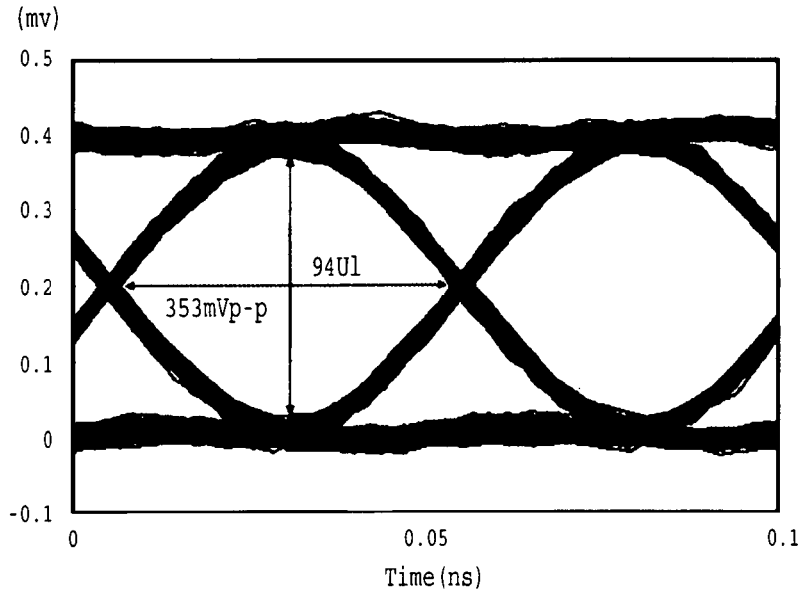

FIGS. 40A and 40B illustrate eye diagrams, respectively, indicating the evaluation of jitter.

FIGS. 40A and 40B illustrate a case wherein a sine wave of 0.4 Vp-p is input into the above-mentioned model by using a predetermined circuit simulator (AnalogOffice: manufactured by AWR).

As apparent from FIG. 40A, there is almost no deformation in the wave shape at the communication speed of 10 Gbps in relation to the input wave shape (0.4=400 mV, 100 psec). Also, as apparent from FIG. 40B, there is considerably less deformation in the wave shape even at the communication speed of 20 Gbps.

Figure 41:
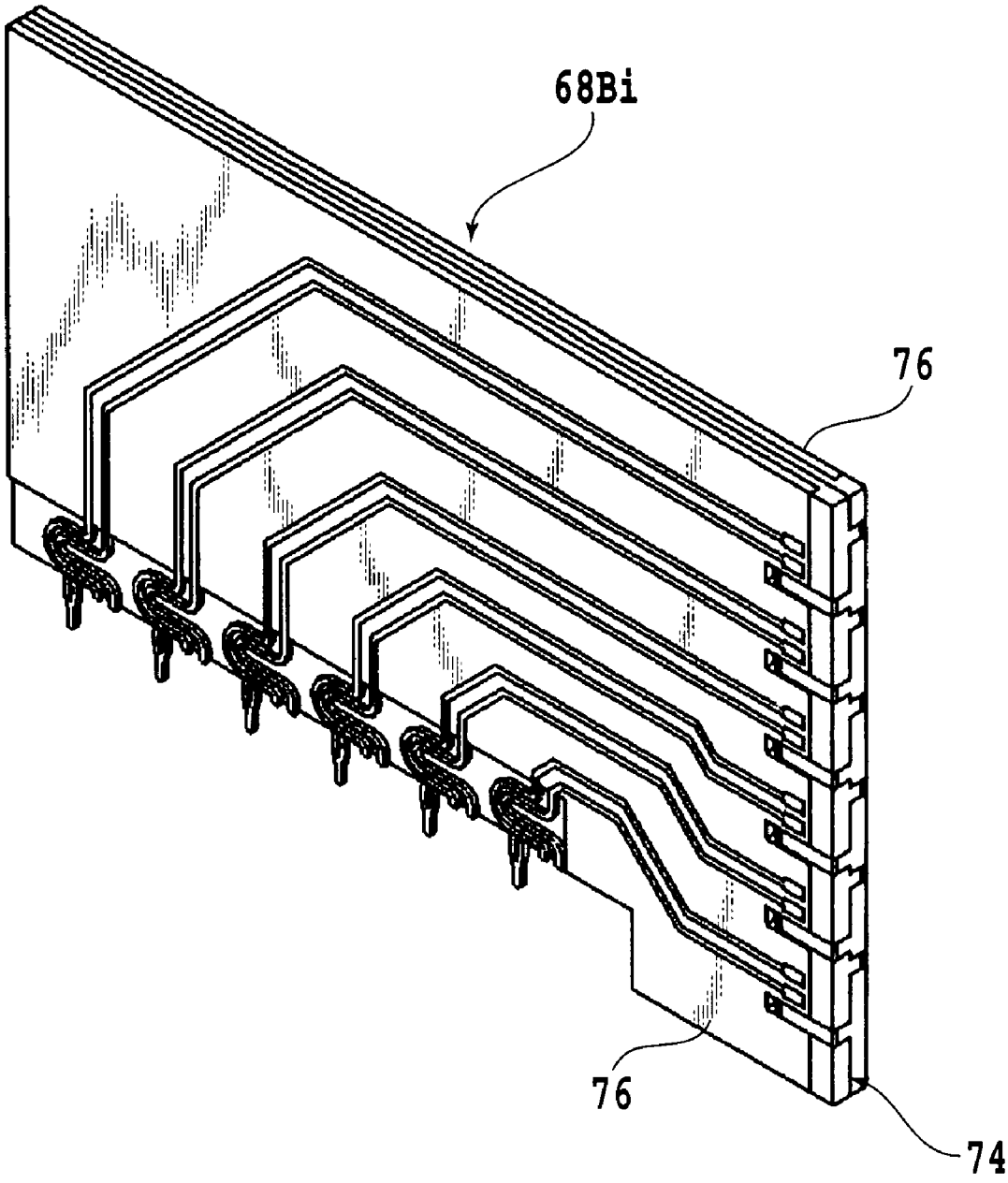
FIG. 41 is a perspective view illustrating the appearance of another example of the contact unit used in a high speed transmission connector according to the present invention.
Figure 42:
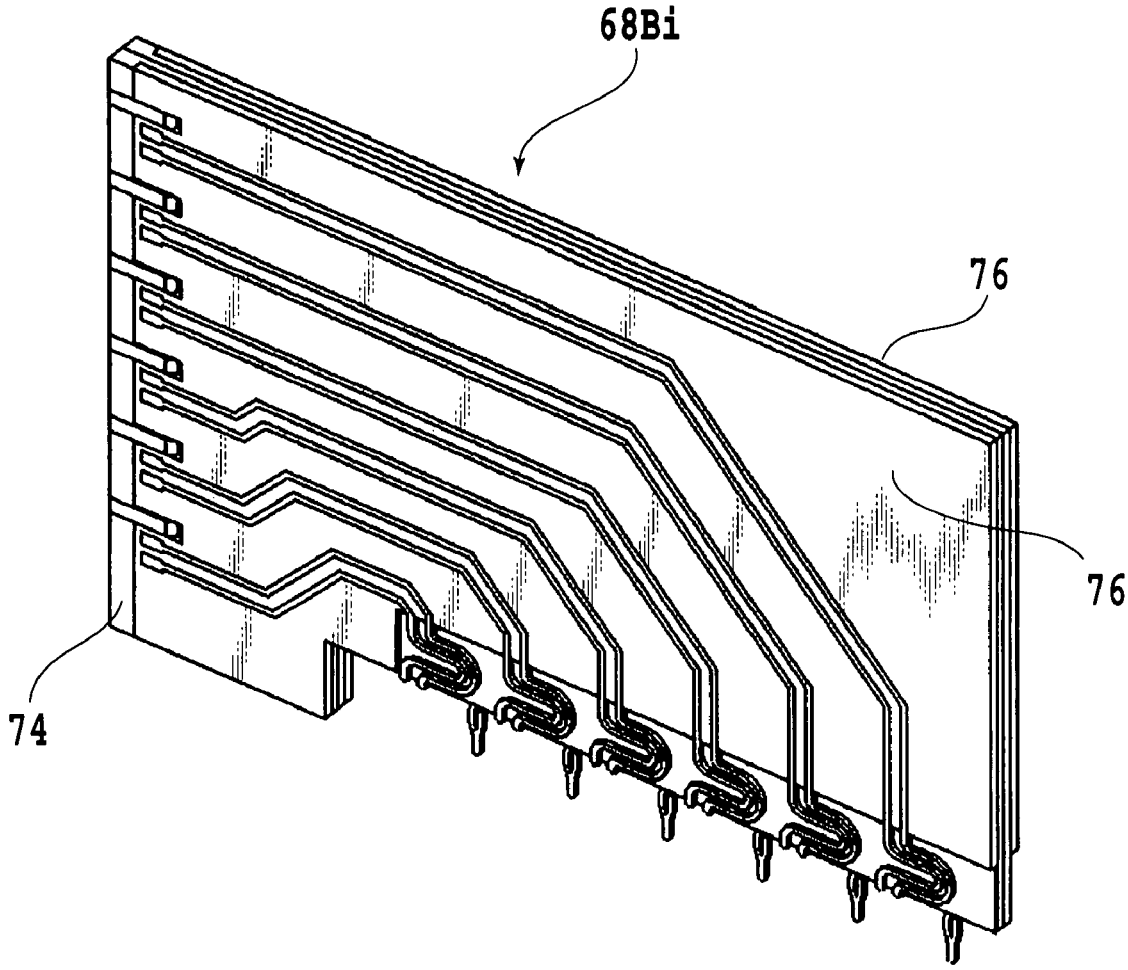
FIG. 42 is a perspective view illustrating the appearance of another example of the contact unit used in a high speed transmission connector according to the present invention.

FIGS. 41 and 42 illustrate the appearance of another contact unit 68Bi used for one embodiment of a high speed transmission connector according to the present invention.

While the ground blade 24 in the contact unit 18Bi shown in FIG. 1 includes two kinds of ground contact terminal groups 22G1 to 22G6 and 22'G1 to 22'G6, a ground blade 74 in the contact unit 68B1 includes one kind of contact terminal group 72G1 to 72G6.

Figure 43:
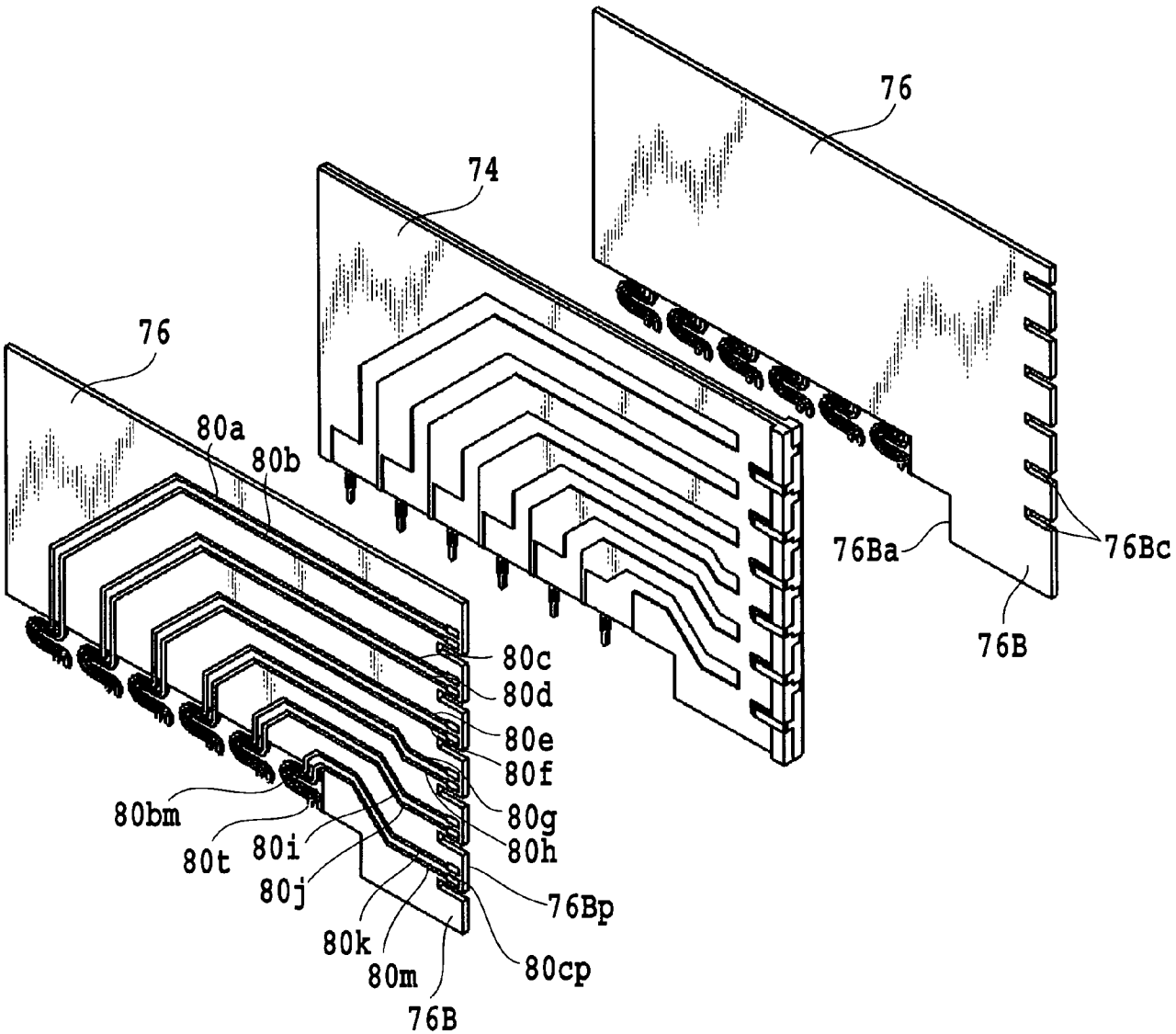
FIG. 43 is an exploded perspective view of the contact unit shown in FIG. 41.

As shown in FIG. 43 in enlarged dimension, a single contact unit 68Bi includes one ground blade 74 and two transmission blades 76 opposed to opposite outer surfaces of the ground blade 74. The ground blade 74 includes a ground contact terminal group 72G1 to 72G6 described later (see FIG. 44A). While, the transmission blade 76 includes a transmission contact terminal group 80*a* to 80*m* for transmitting signals or data.

Figure 44A:
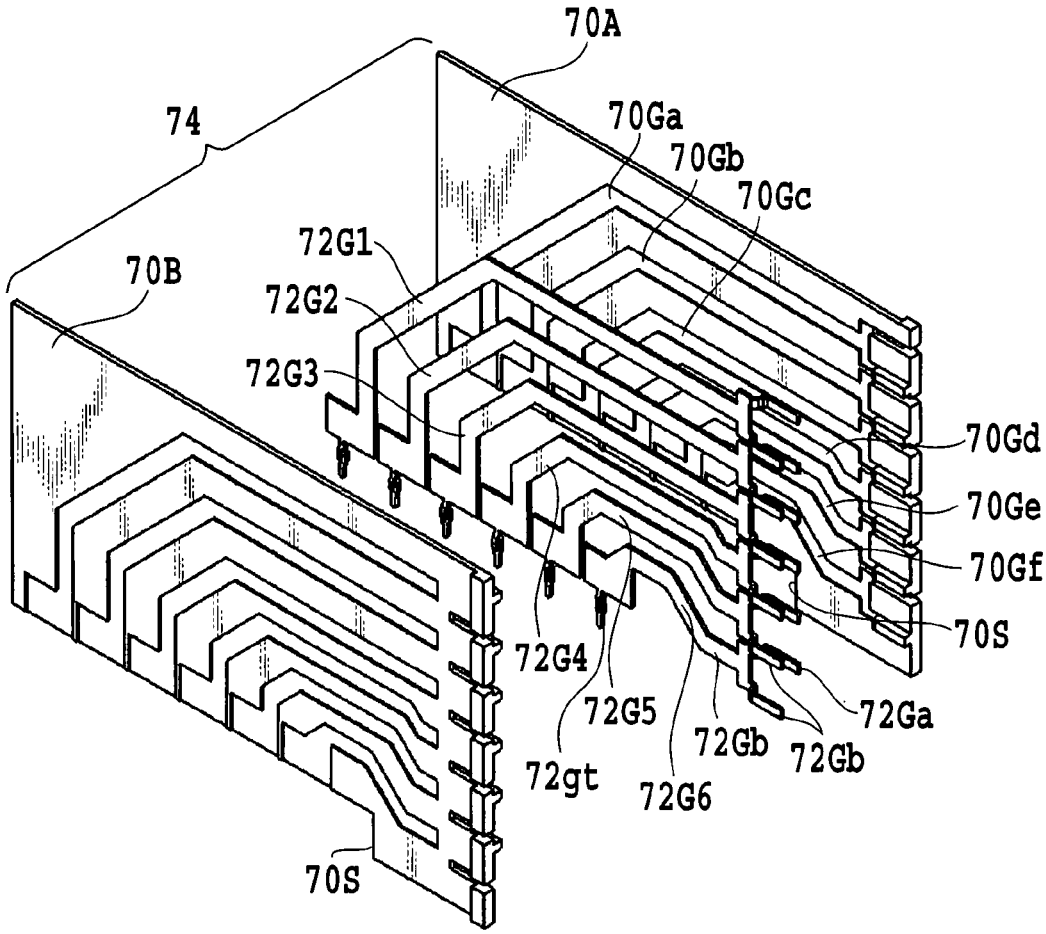
FIG. 44A is a perspective view illustrating the constitution of the ground blade comprising the contact unit shown in FIG. 41.

As shown in FIG. 44A in enlarged dimension, the ground blade 74 includes two supporting plates 70A and 70B and the ground contact terminal group 72G1 to 72G6 to be inserted into grooves in the respective plates 70A and 70B.

The supporting plates 70A and 70B are molded, for example, with resinous material as electro-insulation material and combined with each other to interpose the ground contact terminal group 72G1 to 72G6 between them.

The supporting plate 70A has a stepped portion 70S at a lower end thereof engageable with one end of the above-mentioned printed wiring board 12.

On one surface layer of the supporting plate 70A, grooves 70Ga to 70Gf are formed, into which are inserted the thin plate-like contact terminals 72G1 to 72G6, respectively.

Into the groove 70Gf formed at a position nearest to the above-mentioned stepped portion 70S, the ground contact terminal 72G6 is inserted. One end of the groove 70Gf is connected to a bifurcated slit. On the other hand, the other end of the groove 70Gf is coupled to an enlarged area opened to the stepped portion 70S. A part of the groove 70Gf between one and the other ends thereof is bent. The bending part is formed to couple two horizontal parts having the height difference with each other.

A depth of the groove 70Gf and those of the other grooves 70Ge to Ga are defined somewhat larger than half a thickness of each the ground contact terminals 72G1 to 72G6.

Into the grooves 70Ge to 70Ga located at positions above the groove 70Gf, the ground contact terminals 72G5, 72G4, 72G3, 72G2 and 72G1 are inserted.

A shape of the groove 70Ge adjacent to the groove 70Gf is similar to that of the groove 70Gf with a predetermined interval. The groove 70Ge is formed to encircle the groove 70Gf.

A shape of the groove 70Gd adjacent to the groove 70Ge is similar to that of the groove 70Gf with a predetermined interval. The groove 70Gd is formed to encircle the groove 70Ge.

A shape of the groove 70Gc adjacent to the groove 70Gd is similar to that of the groove 70Gf with a predetermined interval. The groove 70Gc is formed to encircle the groove 70Gd.

A shape of the groove 70Gb adjacent to the groove 70Gc is similar to that of the groove 70Gf with a predetermined interval. The groove 70Gb is formed to encircle the groove 70Gc.

A shape of the groove 70Ga adjacent to the groove 70Gb is similar to that of the groove 70Gf with a predetermined interval. The groove 70Ga is formed to encircle the groove 70Gb.

Figure 45A:
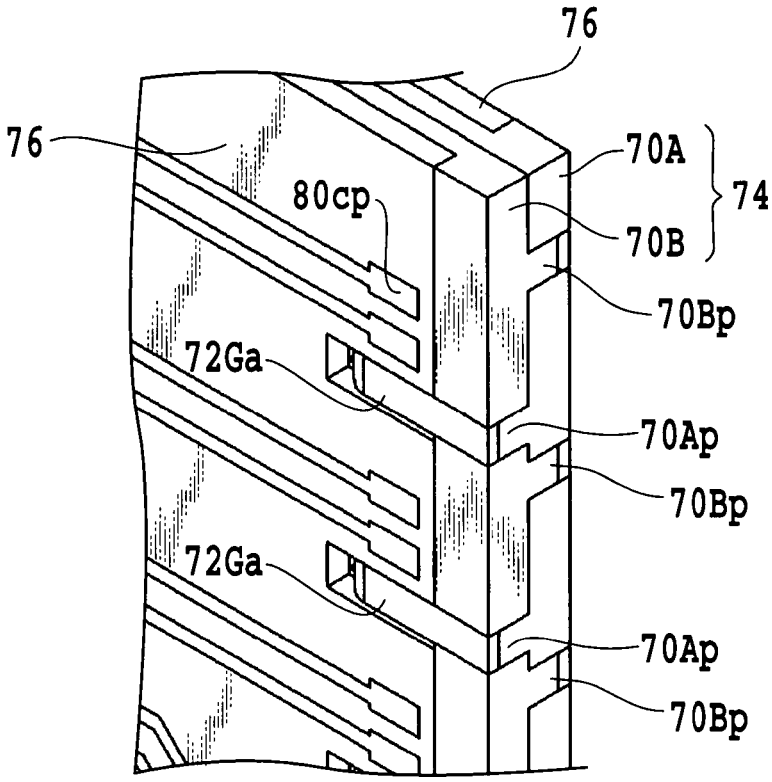
FIGS. 45A and 45B are partially enlarged perspective views, respectively, illustrating the contact unit shown in FIG. 41.
Figure 45B:
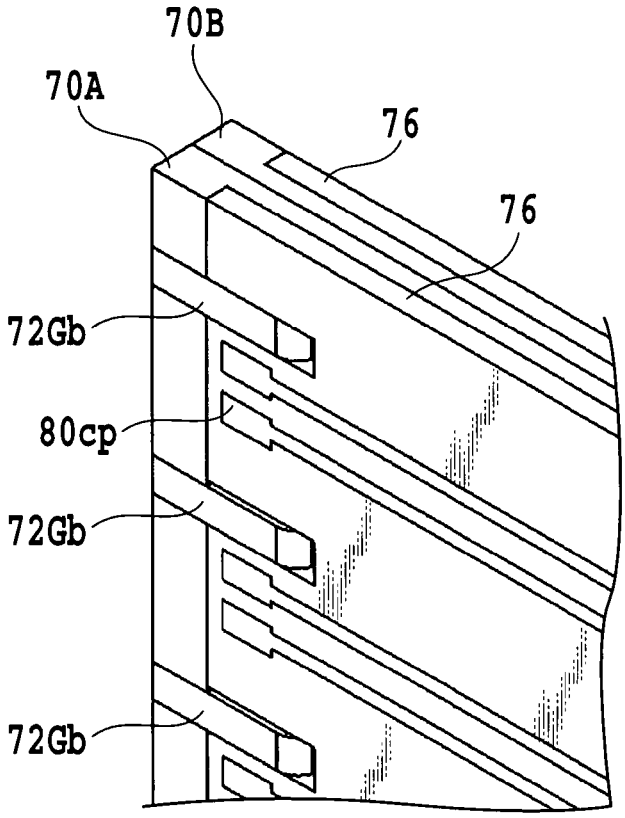

Accordingly, at one end of the supporting plate 70A, bifurcated slits are formed in one row at a predetermined interval between the adjacent ones. As shown in FIGS. 45A and 45B, between the adjacent slits, a projection 70Ap is formed, and engaged with a slit of the supporting plate 70B described later.

Figure 44B:
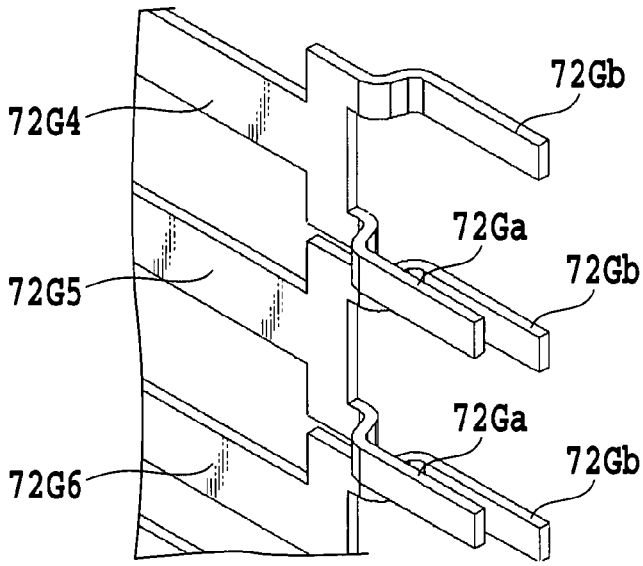
FIG. 44B is a partially enlarged perspective view of the ground contact terminal group comprising the ground blade.

As shown in FIG. 44B, the supporting plate 70B has the stepped portion 70S at a lower end thereof to be engageable with one end of the printed wiring board 12 described above.

On one surface of the supporting plate 70B, grooves are formed, into which are inserted the thin plate-like ground contact terminals 72G1 to 72G6, respectively. A shape of the respective groove is similar to those of the grooves 70Ga to 70Gf in the supporting plate 70A described above.

At one end of the supporting plate 70B, bifurcated slits are formed in one row at a predetermined interval. As shown in FIGS. 45A and 45B, between the adjacent slits, a projection 70Bp is formed, and engaged with a slit of the supporting plate 70A described later.

The ground contact terminal 72G6 is made, for example, of phosphor bronze alloy to be a thin plate. As shown in FIG. 44B in a partially enlarged manner, one end of the ground contact terminal 72G6 is bifurcated to form a pair of terminals 72Ga and 72Gb. The terminal 72Ga is bent in one direction to be separated outward from a middle portion of the ground contact terminal 72G6. On the other hand, the terminal 72G is bent in the counter direction to be separated outward from a middle portion of the ground contact terminal 72G6.

The terminals 72Ga and 72Gb extend parallel to each other at a predetermined interval to be vertical to a shorter sides of the supporting plates 70A and 70B to be fixed.

On the other hand, at the other end of the ground contact terminal 72G6, a flat enlarged portion having a fixed terminal section 72*gt* press-fit into the through-hole of the printed wiring board 12 is formed. The fixed terminal section 72*gt* is formed at an end of the enlarged portion to be generally vertical to the extension line of above-mentioned terminal 72Ga. A part between one end of the ground contact terminal 72G6 and the other end thereof is bent. This bending part is formed to couple two horizontal portions having a height difference to each other.

Shapes of the ground contact terminal 72G5 disposed directly above the ground contact terminal 72G6 and the other ground contact terminals 72G4 to 72G1 disposed further above them are similar to the shape of the ground contact terminal 72G6.

Regarding line lengths of the ground contact terminals 72G1 to 72G6, that of the ground contact terminal 72G6 is defined to be a minimum value, and that of the ground contact terminal 72G1 is defined to be a maximum value. The line length of the ground contact terminal 72G5 is defined to be longer than that of the ground contact terminal 72G6; the line length of the ground contact terminal 72G4 is defined to be longer than that of the ground contact terminal 72G5; and further, the line length of the ground contact terminal 72G3 is defined to be longer than that of the ground contact terminal 72G4. And, the line length of the ground contact terminal 72G2 is defined to be longer than that of the ground contact terminal 72G3. Thereby, when the ground contact terminals 72G1 to 72G6 are arranged in a common plane in the order of line lengths, the ground contact terminal having the relatively shorter line length is encircled by that having the relatively longer line length.

Note that the ground blade 74 should not be limited to such embodiments but may be insert-molded with resinous material together with the ground contact terminal group.

As shown in FIG. 43 in enlarged dimension, the transmission blade 76 has a structure wherein the respective transmission paths forming the contact terminal group 80*a* to 80*m* are insert-molded with resinous material as electro-insulation material while being arranged at a predetermined interval. The substrate 76B of the transmission blade 76 made of resin is flexible since a thickness thereof is set at approximately 0.4 mm. The transmission blade 76 is disposed on each of opposite outer surfaces of the ground blade 74 while being fixed via contact pad forming sections described later.

At one end of the transmission blade 76, a plurality of contact pad forming sections 76Bp are formed at a predetermined interval between a pair of terminals 72Ga and 72Gb. Between the adjacent contact pad forming sections 76Bp, a notch 76Bc is formed. Also, at the lowermost end of the substrate 76B for the transmission blade 76, a stepped portion 76Ba engageable with the end of the printed wiring board 12 described above is disposed opposite to the stepped portion 70S of the supporting plate 70 in the ground blade 74, which stepped portion 76Ba has a shape similar to that of the stepped portion 70S.

The contact terminal group 80*a* to 80*m* are made, for example, of phosphor bronze alloy to be a thin plate-like shape, and have the line lengths different from each other. The line length of the contact terminal 80*a* is defined to have a maximum value and that of the contact terminal 80*m* is defined to have a minimum value. Pairs of contact terminals 80*a* and 80*b*; 80*c* and 80*d*; 80*e* and 80*f*; 80*g* and 80*h*; 801 and 80*j*; and 80*k* and 80*m* form pairs of signal paths, respectively.

The contact terminal 80 in the contact terminal group 80*a* to 80*m* is disposed in the vicinity of the uppermost end of the substrate 76, and the contact terminal 80*m* is disposed in the vicinity of the stepped portion 76Ba at the lowermost end of the stepped portion 76B in the substrate 76.

One end of the contact terminal 80*m* has a contact pad 80*cp*. A width of the contact pad 80*cp* in the arrangement direction is larger than that of the remaining part thereof.

On the other hand, at the other end of the contact terminal 80*m*, a crook 80*bn* is formed, having a terminal part 80*t* in contact with the conductive pattern of the printed wiring board 21. The terminal part 80*t* is formed at an end of the elastic crook 80*bn* generally in the vertical direction to an extended line of the above-mentioned contact pad 80*cp*. A part of the contact terminal 80*m* between the one end and the other crook is opposed to a part 72Gb of the above-mentioned ground contact terminal 72G6 and bent on the surface of the substrate 76B. The bending portion is formed to couple two horizontal parts having the height difference to each other via a slant.

A shape of the contact terminal 80*k* disposed above the contact terminal 80*m* adjacent thereto and those of the other contact terminals 80*j* to 80*a* disposed further above them are similar to that of the contact terminal 80*m*.

Figure 46:
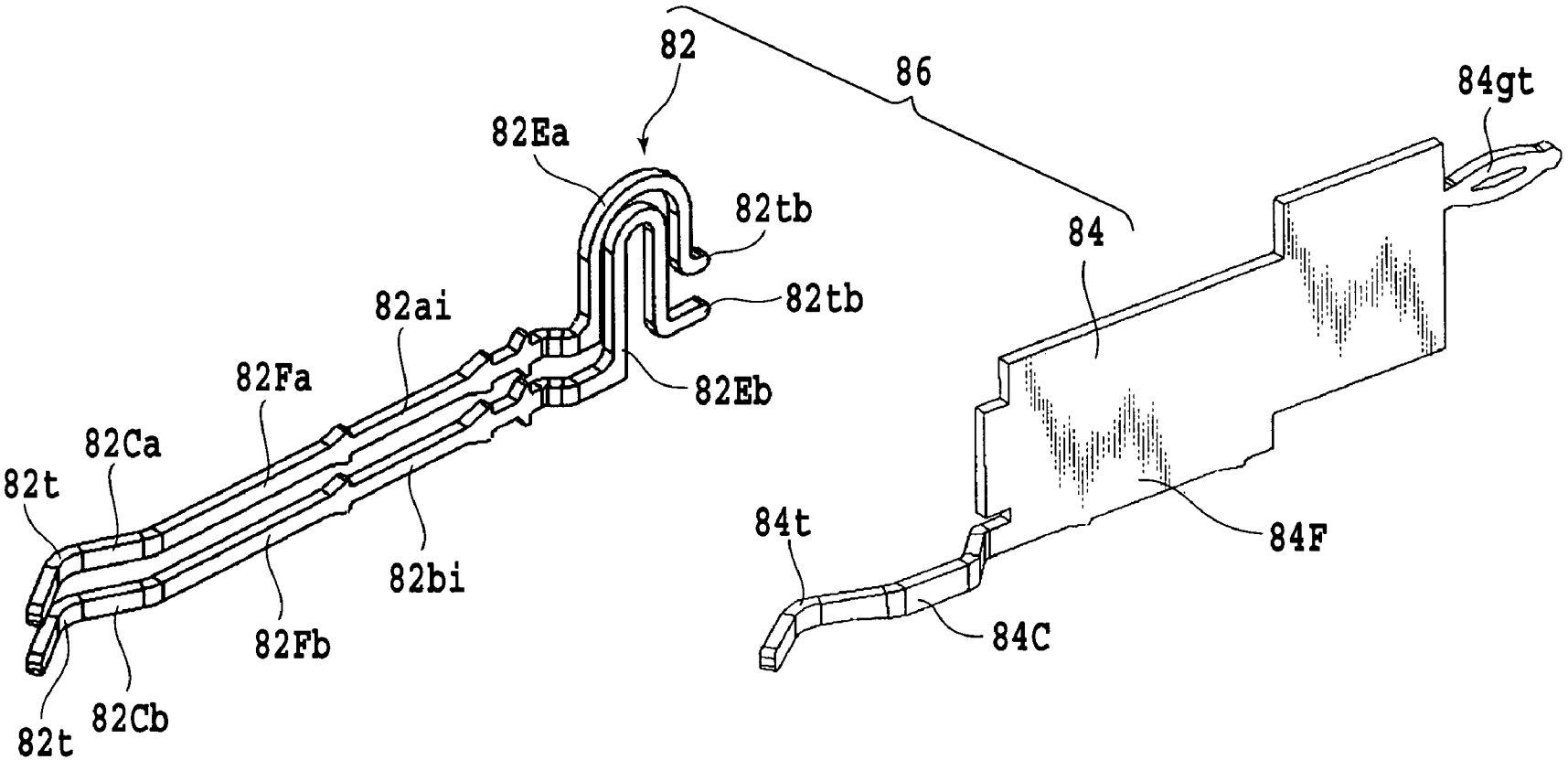
FIG. 46 is a perspective view illustrating the ground contact terminal and the signal contact terminal constituting the socket contact used for the socket section.
Figure 47A:
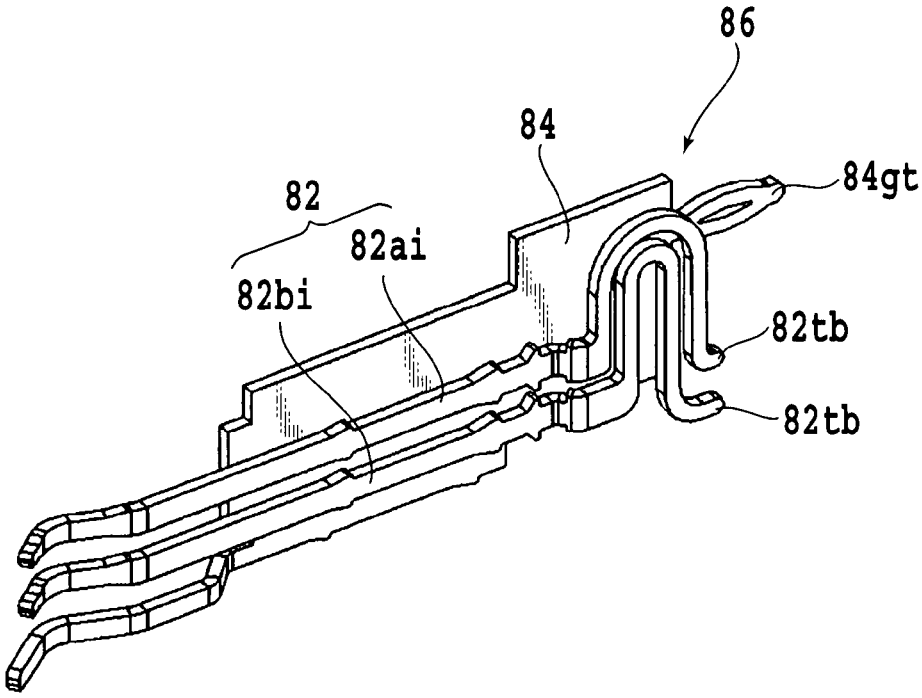
FIGS. 47A and 47B are perspective views, respectively, illustrating the socket contact combining the ground contact terminal with the signal contact terminal shown in FIG. 46.
Figure 47B:
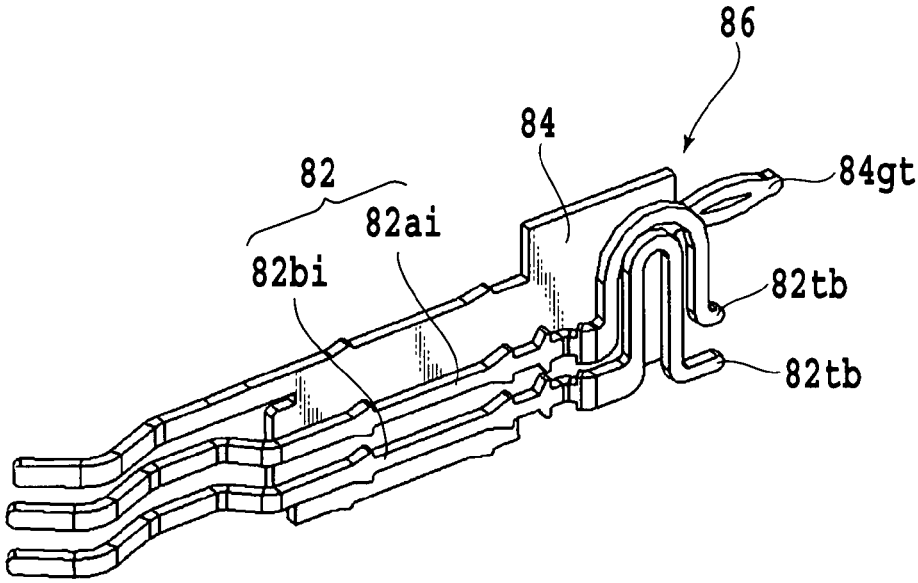

FIG. 46 illustrates a socket contact 86 disposed in the socket section 14 electrically connected to the contact unit 68Bi when the respective contact unit 68Bi is mounted to the cell Si of the casing 10C in the plug section 10. As shown in FIGS. 47A and 47B, the socket contact 86 for 1-channel signal path is of a micro-strip structure (wherein a signal line of differential pair is provided on the ground plate), and includes a ground contact terminal 84 and a signal contact unit 82 having signal contact terminals 82*ai* and 82*bi*.

Figure 48:
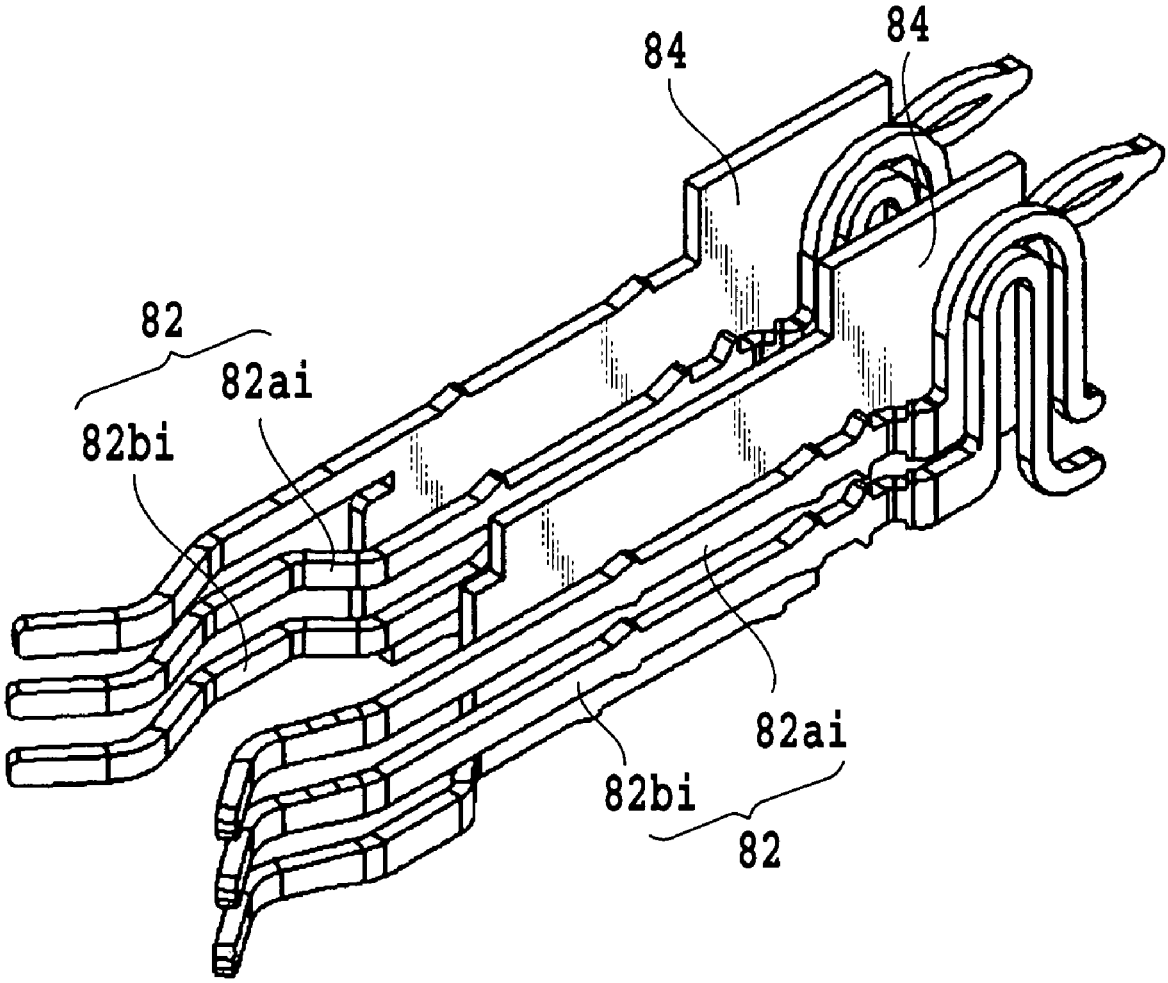
FIG. 48 is a perspective view illustrating a state wherein the socket contacts shown FIG. 46 are combined with each other facing each other.
Figure 49:
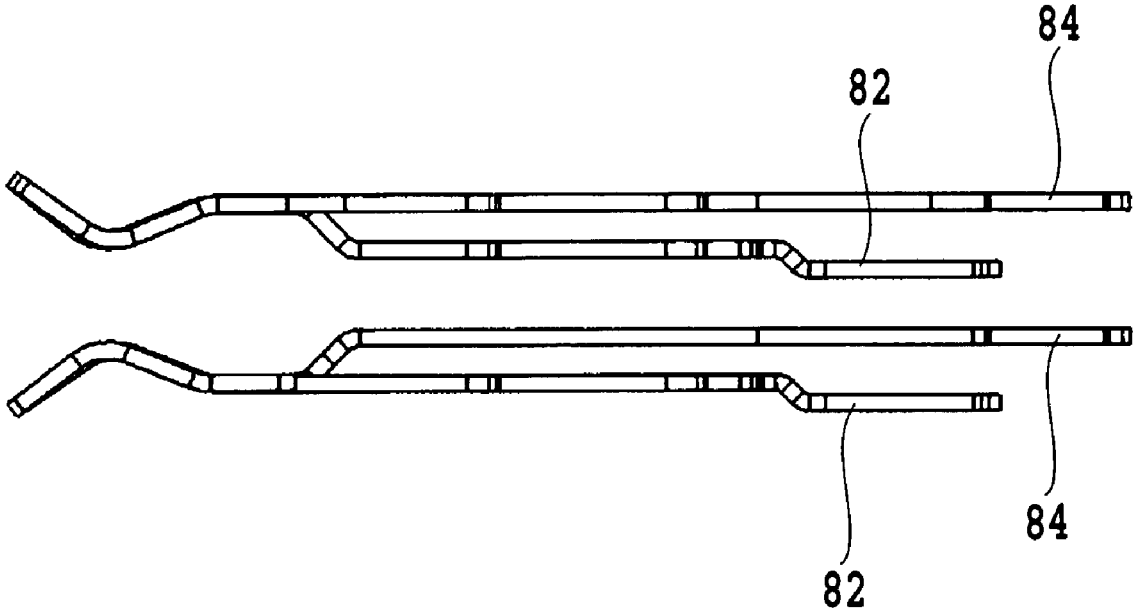
FIG. 49 is a plan view of the embodiment shown in FIG. 48.

As shown in FIGS. 48 and 49, in a case of a pair of terminals 72Ga and 72Gb and a pair of contact pads 80*cp* disposed on the opposite surfaces of a single contact unit 68Bi; that is, a 2-channel signal path, the socket contacts 86 are opposed to each other.

Figure 51:
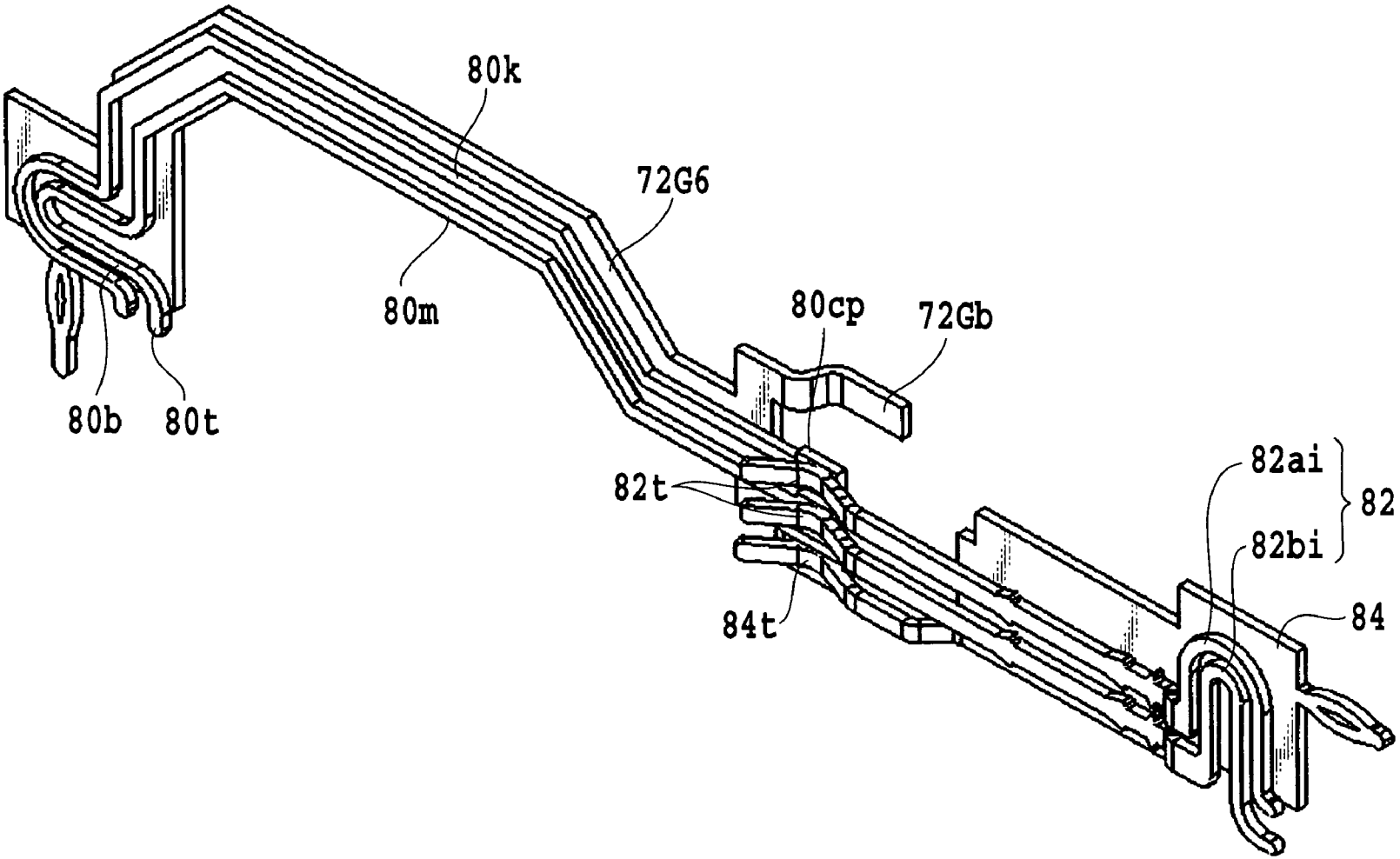
FIG. 51 is a perspective view schematically illustrating a state wherein the socket contact shown in FIG. 48, the ground contact terminal and the transmission contact terminal shown in FIG. 43 are connected together.

As shown in FIG. 51, the ground contact terminal 84 includes a terminal section 84C having contact section 84*gt* in contact with a pair of terminals 72Ga in the contact unit 68Bi, a fixed terminal section 84*gt* fixed to the conductor of the printed wiring board 16 when connected to the plug section 10, and a fixing section 84F for connecting the terminal section 84C to the fixed terminal section 84*gt*. The ground contact terminal 84 is located and held by locking means (not shown) formed within the slit 50Bi.

As shown in FIG. 51, the signal contact terminal 82*ai* includes a terminal section 82Ca having a contact section 82*t* in contact with the contact pad 80*cp* in the contact unit 68Bi, a curved section 82Ea having a terminal section 82*tb* in contact with the conductor of the printed wiring board 16 when connected to the plug section 10, and a fixing section 82Fa for coupling the terminal section 82Ca to the crook 82Ea. The terminal section 82Ca and the fixed terminal section 82*tb* are elastically deformable, respectively.

As shown in FIG. 51, the signal contact terminal 82*bi* includes a terminal section 82Cb having the contact section 82*t* in contact with the contact pad 80*cp* in the contact unit 68Bi, the crook 82Eb having a fixed terminal section 82*tb* in contact with the conductor of the printed wiring board 16, and a fixing section 82Fb for coupling the terminal section 82Cb to the curved section 82Eb. The terminal section 82Cb and the fixed terminal section 82*tb* are elastically deformable, respectively.

Figure 50:
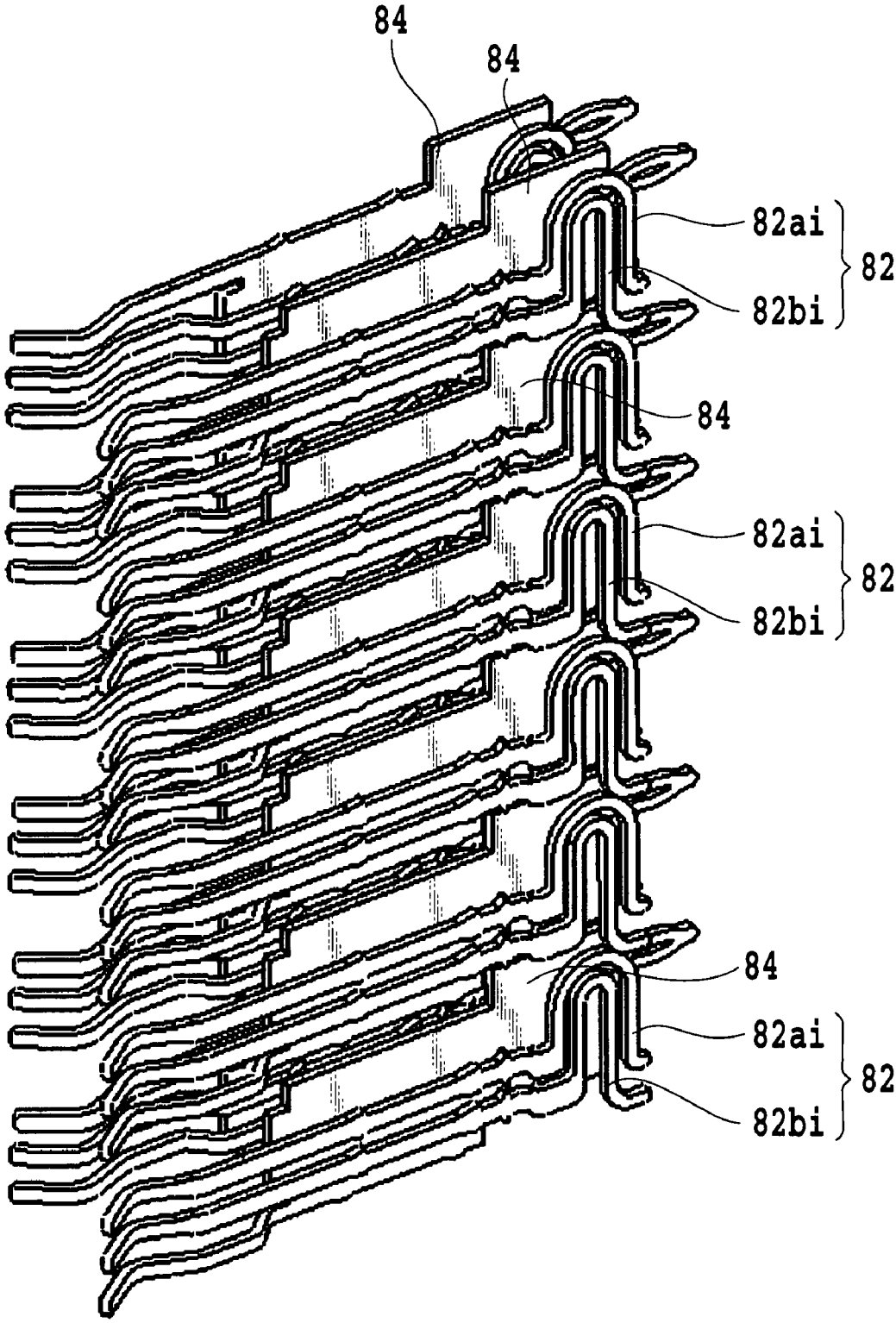
FIG. 50 is a perspective view illustrating a state wherein a plurality of the socket contacts shown in FIG. 48 are arranged.

Thereby, as shown in FIG. 50, the respective socket contacts 86 are arranged within the slits 50SBi in the longitudinal direction of the projection 50Pai at a predetermined interval. When an end of the contact unit 68Bi is inserted into a gap between the socket contacts 86 adjacent to each other in the arrangement direction of the slits 50SBi, the contact unit 68Bi is elastically nipped with the terminal sections 82Ca and 82Cb.

According to one embodiment of a high speed transmission connector of the present invention, it is possible to realize the transmission of 90 DiffPair (90 pairs of signal per 1 inch). For example, if there are seven contact units, it is possible to transmit 84 pairs of signals per 1 inch. By employing the above-described structure, a connector capable of transmitting super-high speed signals of 20 Gbps exceeding 10 Gbps is realized. Further, low speed control signals could be provided at a high density. In the BackPlane connector, it is also necessary to be built-in relatively low speed control signals within many connectors. Generally, a clock frequency is 100 MHz and a transmission frequency is in a range from 200 to 400 MHz. In this case, according to the above-mentioned structure, it is possible to form four contact pads only by dividing a ground plate into signal contacts. Since the socket connector side is of a shape formed by dividing the ground contact, it is possible to arrange four low speed signals by a space corresponding to one channel of the differential signal.

Figure 55:
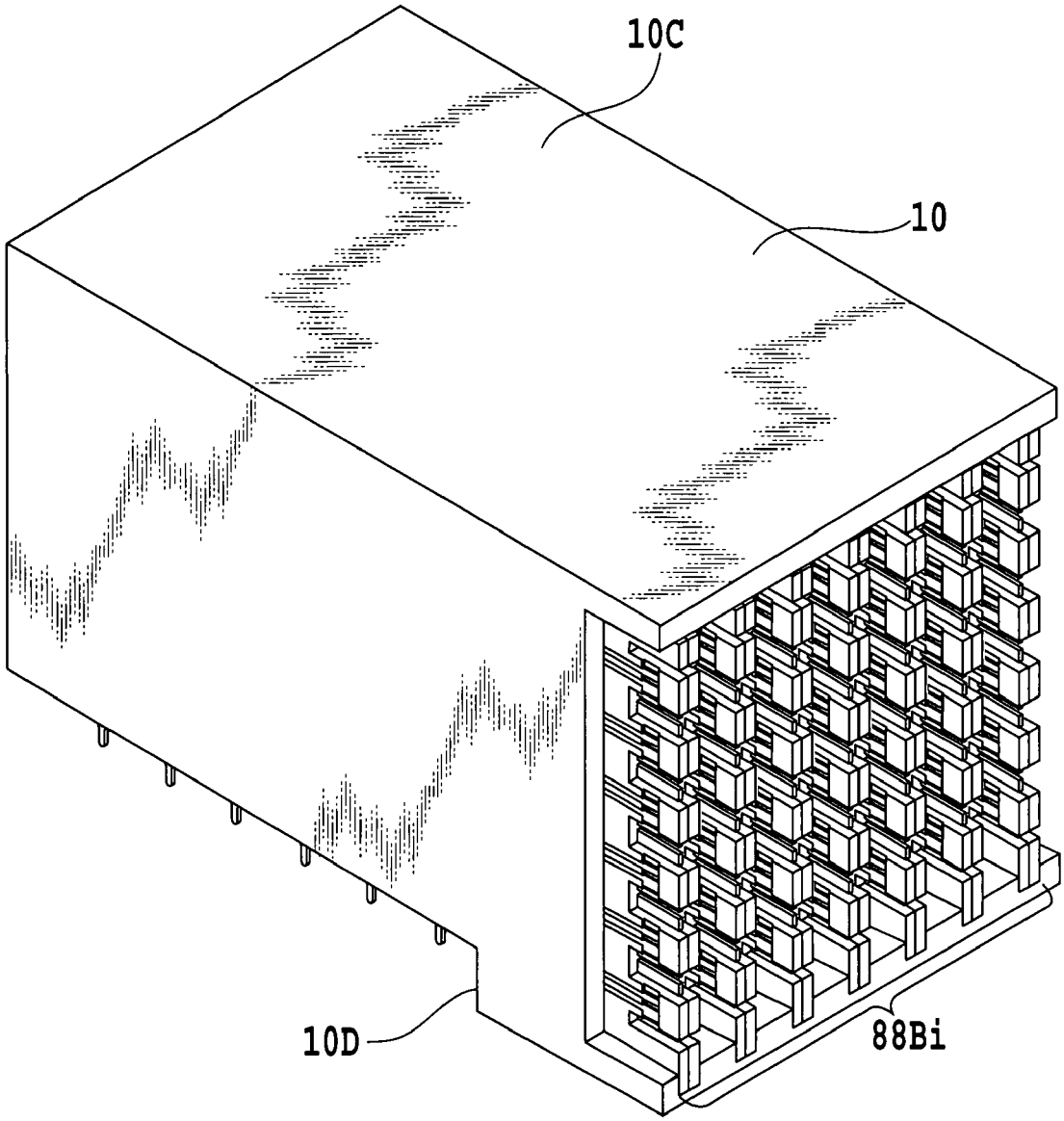
FIG. 55 is a perspective view illustrating the appearance of the plug section provided with another example of the contact unit used in one embodiment of a high speed transmission connector according to the present invention.

FIG. 55 illustrates, in enlarged dimension, the appearance of a plug section built-in a contact unit 88Bi, as further embodiment wherein a high speed transmission connector according to the present invention. In this drawing, the same reference numerals are used for denoting the same constituent elements as in FIG. 4, and the explanation thereof will be eliminated.

Figure 56:
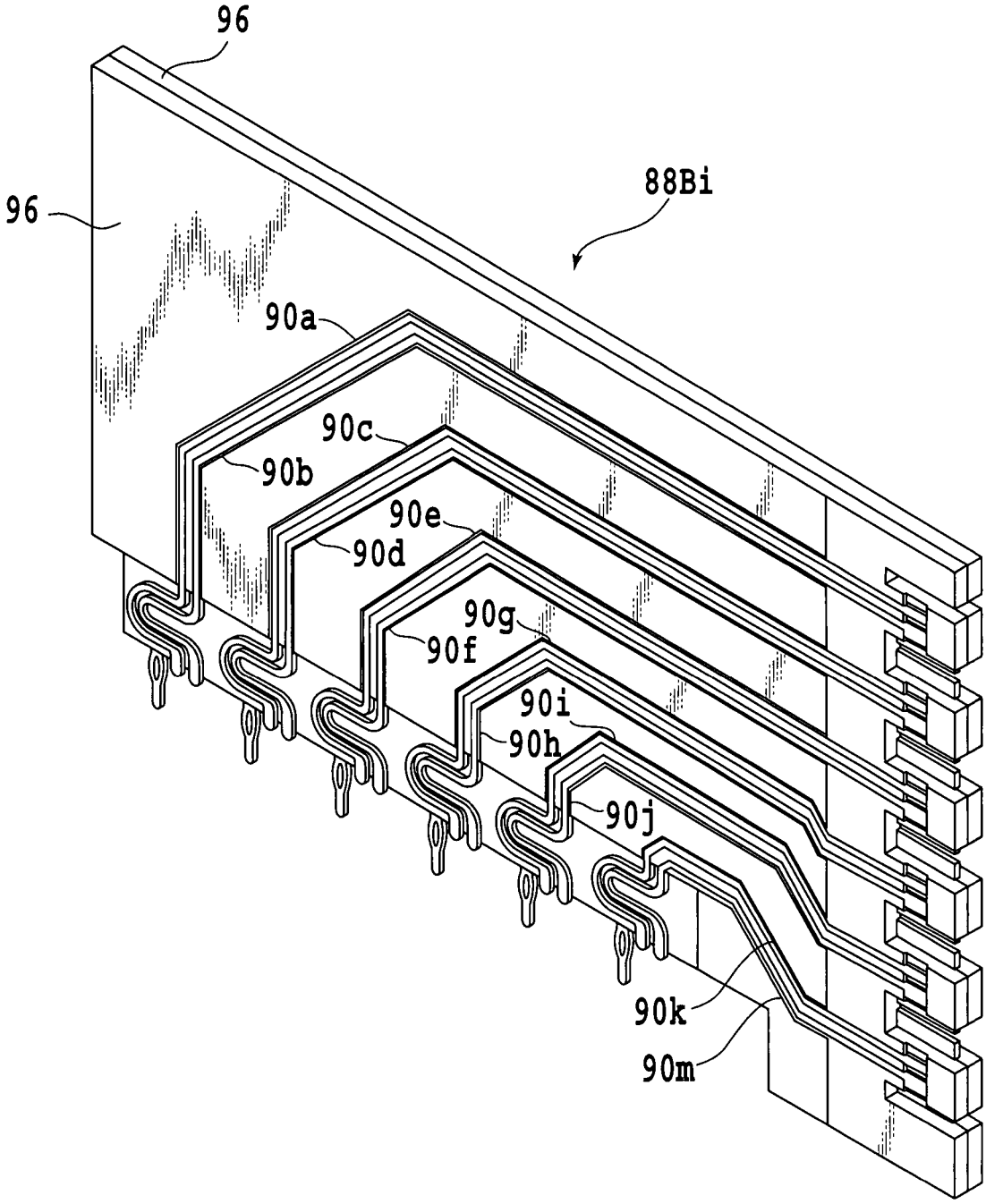
FIG. 56 is a perspective view illustrating the appearance of the contact unit in the embodiment shown in FIG. 55.
Figure 58:
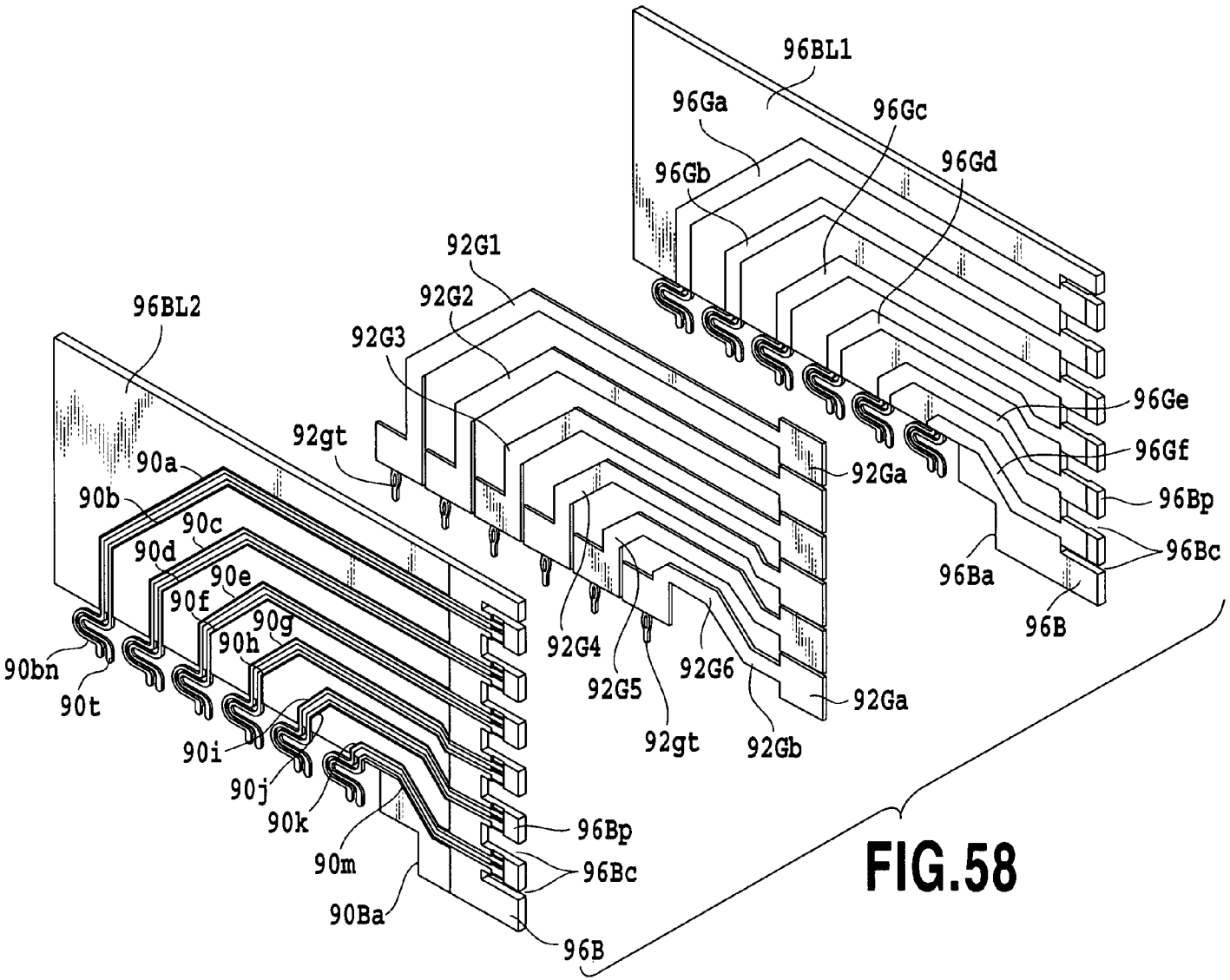
FIG. 58 is an exploded perspective view of the contact unit shown in FIG. 56.

While the ground contact terminal group 72G1 to 72G6 (see FIGS. 44A and 44B) in the ground blade 74 shown in FIG. 41 have pairs of bifurcated terminals 72Ga and 72Gb, respectively, the contact unit 88Bi shown in FIG. 56 has a ground contact terminal group 92G1 to 92G6 provided with a single terminal portion 92Ga wherein the terminal portion 92Ga has opposite flat surfaces of a generally rectangular shape as shown in FIG. 58.

As illustrated in FIGS. 56 and 58 in enlarged dimension, the contact unit 88Bi comprises a ground contact terminal group 92G1 to 92G6 and two transmission blades 96BL1 and 96BL2 disposed on the opposite outer surfaces of the ground contact terminal. Each of the transmission blades 96BL1 and 96BL2 includes a transmission contact terminal group 90*a* to 90*m* for transmitting signals or data.

Each of the transmission blades 96BL1 and 96BL2 is molded, for example, with resinous material as electro-insulation material, and combined to each other so that the ground contact terminal group 92G1 to 92G6 described later is interposed therebetween.

Since the transmission blades 96BL1 and 96BL2 are formed to be symmetry in shape so that the ground contact terminal group 92G1 to 92G6 becomes a plane of symmetry, the explanation will be made solely on the transmission blade 96BL1 and the explanation of the transmission blade 96BL2 will be eliminated.

The transmission blade 96BL1 has a stepped portion 96Ba in a lower end area thereof engageable with one end of the printed wiring board 12.

On one outer layer of the transmission blade 96BL1, grooves 96Ga to 96Gf are formed, into which are inserted the thin plate-like ground contact terminals 92G1 to 92G6, respectively, as shown in FIG. 58.

Into the groove 96Gf formed at a position nearest to the stepped portion 96Ba, the ground contact terminal 92G6 is inserted. One end of the groove 96Gf is coupled to a recess formed in the projection 96Bp. A plurality of projections 96Bp is formed in one row at one end of the transmission blade 96BL1 at a predetermined interval. A slit 96Bc is formed between the respective adjacent projections 96Bp.

On the other hand, the other end of the groove 96Gf is coupled to an end contiguous to the stepped portion 96Ba. A part of the groove 96Gf between one and the other ends thereof is bent. The bending portion is formed to couple two horizontal portions having the height difference to each other through an inclination portion.

Figure 59:
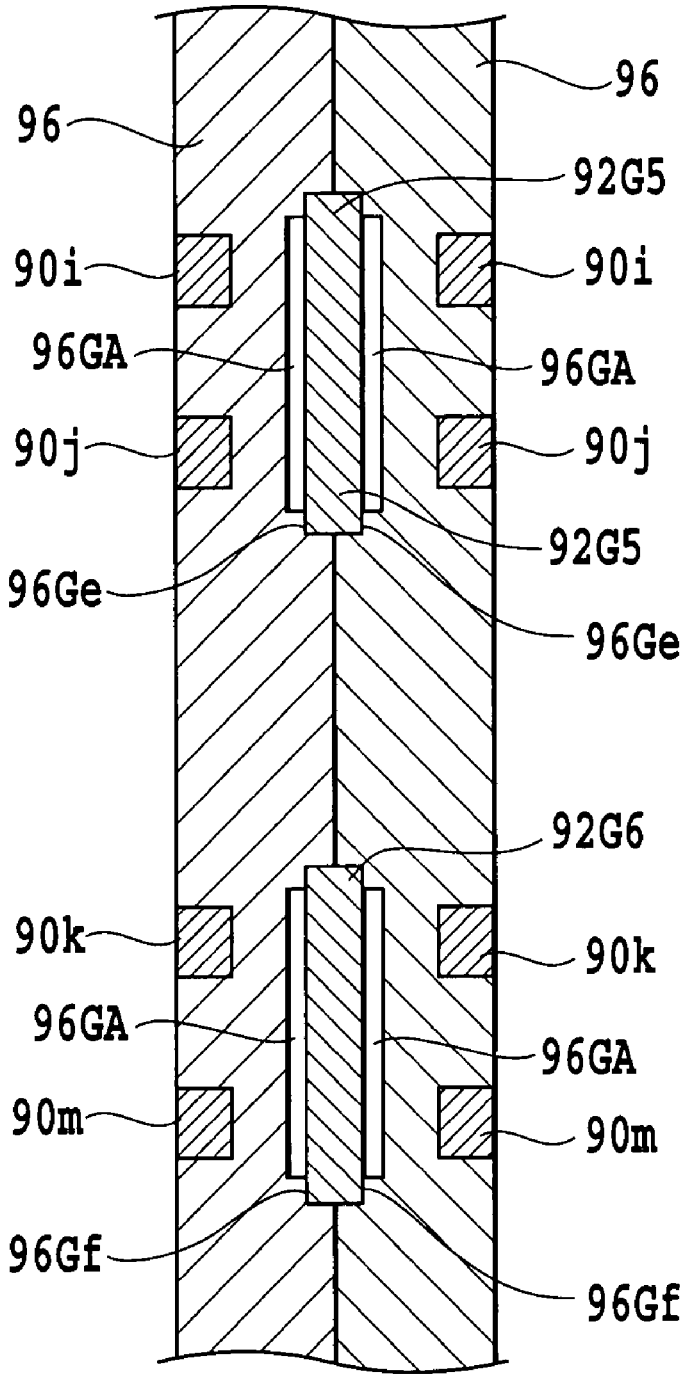
FIG. 59 is a partial sectional view of the contact unit shown in FIG. 56.

As shown in FIG. 59 in enlarged dimension, depths of the groove 96Gf and other grooves 96Ge to 96Ga are set to equal to or somewhat larger than half a thickness of the ground contact terminals 92G1 to 92G6. In a central area of the groove 96Gf, a relatively shallow recess is formed so that a predetermined air layer 96GA is formed between it and the outer circumference surface of the ground contact terminal 92G1 to 92G6.

In the grooves 96Ge to 96Ga formed at positions upper than the groove 96Gf, the ground contact terminals 92G5, 92G4, 92G3, 92G2 and 92G1 are inserted, respectively.

A shape of the groove 96Ge adjacent to the groove 96Gf is similar to that of the groove 96Gf at a predetermined interval. The groove 96Ge is formed to encircle the groove 96Gf.

A shape of the groove 96Gd adjacent to the groove 96Ge is similar to that of the groove 96Gf at a predetermined interval. The groove 96Gd is formed to encircle the groove 96Ge.

A shape of the groove 96Gc adjacent to the groove 96Gd has no bending portion as in the groove Gf, and is formed to encircle the groove 96Gd.

A shape of the groove 96Gb adjacent to the groove 96Gc is similar to that of the groove 96Gc at a predetermined interval. The groove 96Gb is formed to encircle the groove 96Gc.

A shape of the groove 96Ga adjacent to the groove 96Gb is similar to that of the groove 96Gc at a predetermined interval. The groove 96Ga is formed to encircle the groove 96Gb.

The other surface layer of the transmission blade 96BL1 has a structure wherein the contact terminal group 90*a* to 90*m* forming the respective transmission paths are insert-molded with resinous material as electro-insulation material while being arranged at a predetermined interval. The substrate 96B of the transmission blade 96 made of resin is flexible since a thickness thereof is set to approximately 0.4 mm.

Figure 57:
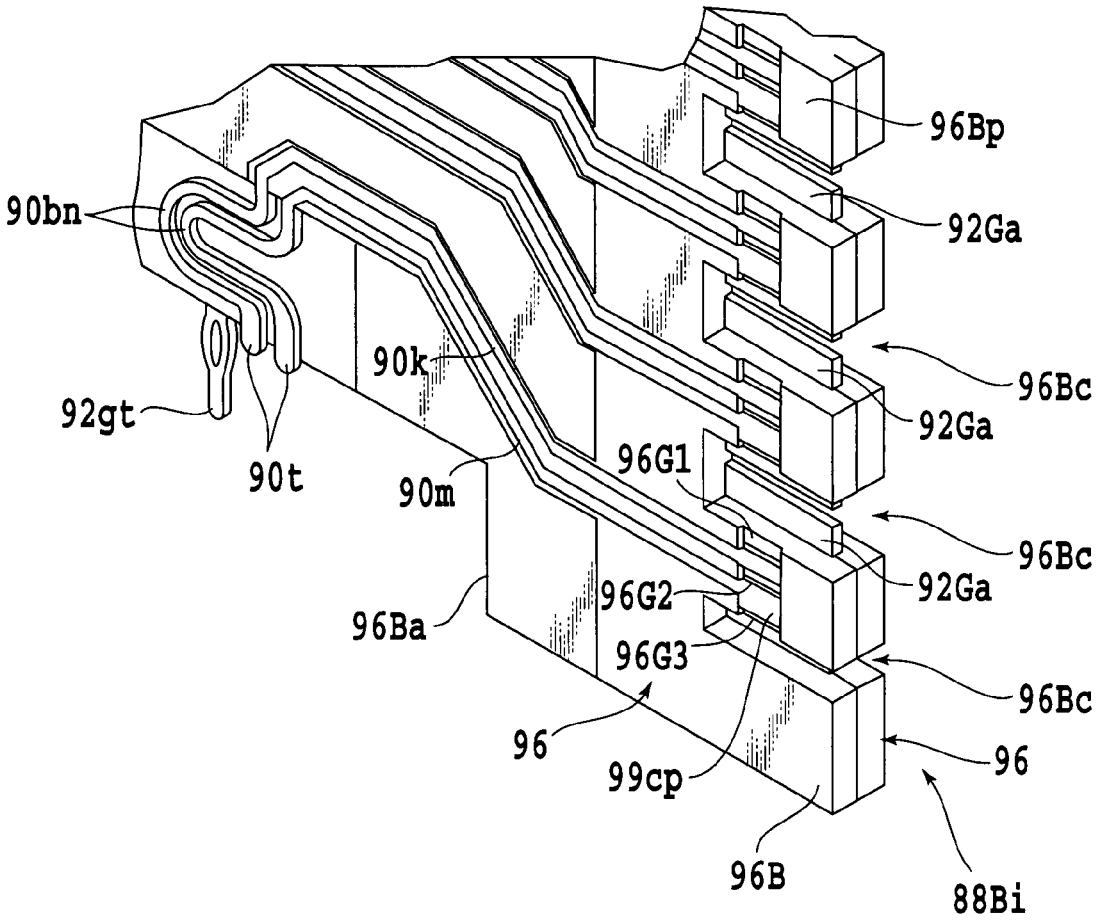
FIG. 57 is a partially enlarged perspective view of FIG. 56.

At one end of the transmission blade 98BL1, projections 96Bp are formed at a predetermined interval. Between the adjacent projections 96Bp, a slit 96Bc is formed. As shown in FIG. 57 in a partially enlarged manner, in the projection 96Bp, a contact pad forming section is formed at one end a pair of contact terminals wherein contact pads are arranged. In the contact pad forming section, grooves 96G1, 96G2 and 96G3 are formed at opposite ends and between the adjacent contact pads, respectively.

The contact terminal group 90*a* to 90*m* is made, for example, of phosphor bronze alloy to have line lengths different from each other. The contact terminal 90*a* is defined to have the maximum length and the contact terminal 90*m* is defined to have the minimum length. The contact terminals 90*a* and 90*b*; 90*c* and 90*d*; 90*e* and 90*f*; 90*g* and 90*h*; 901 and 90*j*; and 90*k* and 90*m* form pairs of signal paths, respectively.

The contact terminal 90*a* in the contact terminal group 90*a* to 90*m* is disposed at a position in the vicinity of the uppermost end of the substrate 96B, while, the contact terminal 90*m* is disposed at a position in the vicinity of the stepped portion 96Ba at the lowermost end.

One end of the contact terminal 90*m* has a contact pad 90*cp*. A width of the contact pad 90*cp* in the arrangement direction is defined to be larger than that of the remaining part.

On the other hand, at the other end of the contact terminal 90*m*, a crook 90*bn* is formed having a terminal part 90*t* to be in contact with a conductive pattern of the printed wiring board 12 at a predetermined pressure. The terminal part 90*t* is formed at an end of the elastic crook 90*bn* to be generally vertical to the extension line of the above-mentioned contact pad 90*cp*. As shown in FIG. 58, an area between the one end and the other crook of the contact terminal 90*m* is bent on the surface of the substrate 96B while being opposed to a part 92Gb of the above-mentioned ground contact terminal 92G6 in conformity therewith.

A shape of a contact terminal 90*k* disposed above the contact terminal 90*m* while being adjacent thereto and those of other contact terminals 90*j* to 90*g* disposed further above the former are similar to that of the contact terminal 90*m*.

The contact terminals 90*e* and 90*f* have a shape in correspondence to that of the ground contact terminal 92G3 described later, respectively. The contact terminals 90*c* and 90*d*, and the contact terminals 90*a* and 90*b* have a shape in correspondence to those of the ground contact terminals 92G2 and 92G1 described later. A shape of the contact terminal 90*a* is similar to those of the contact terminals 90*b* to 90*f*.

Figure 60:
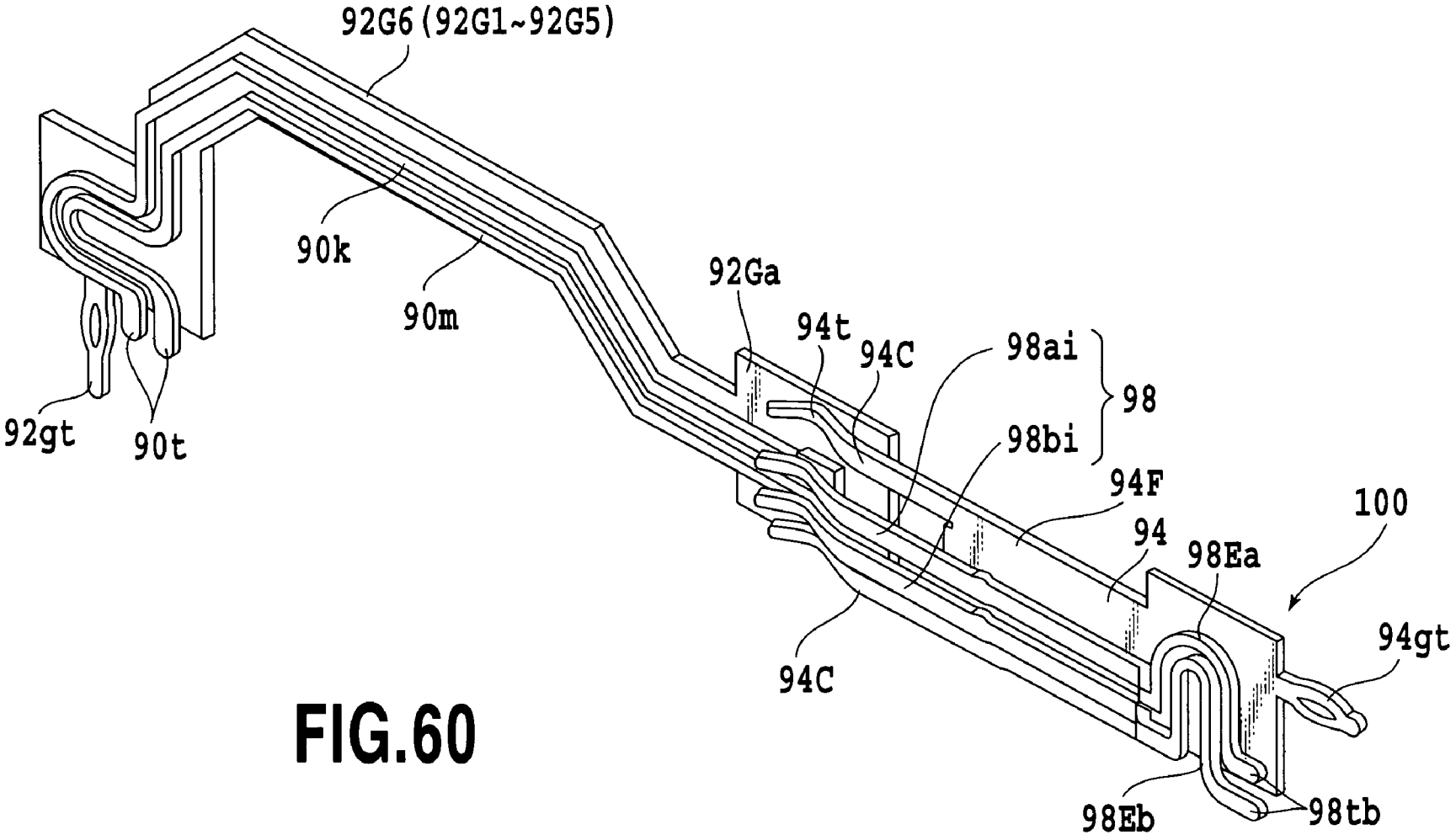
FIG. 60 is a schematically perspective view illustrating a state wherein the socket contact, the ground contact terminal and the transmission contact terminal shown in FIG. 58 are connected to each other.
Figure 61:
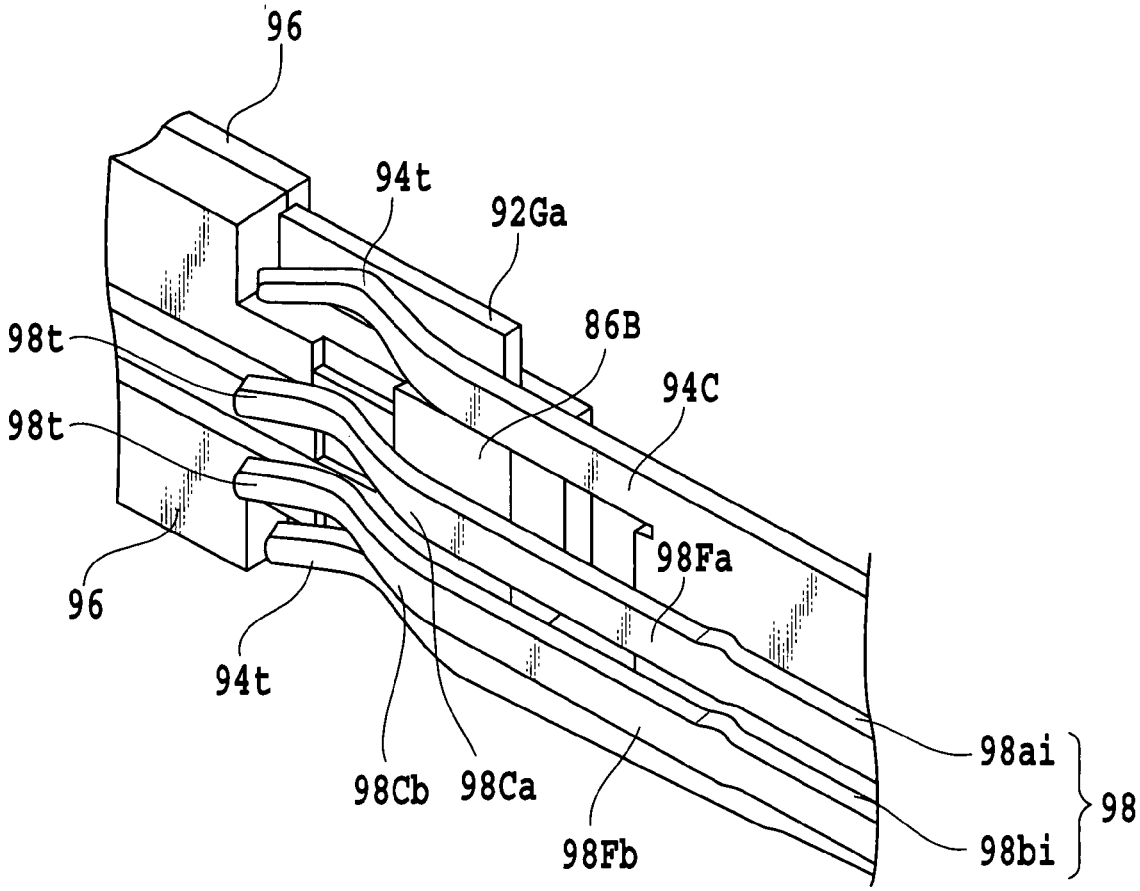
FIG. 61 is a partially enlarged perspective view of part of FIG. 60.

The ground contact terminal 92G6 is made, for example, of phosphor bronze alloy to be a thin plate. As shown in FIG. 60 in a partially enlarged manner, one end of the ground contact terminal 92G6 has a generally rectangular flat terminal portion 92Ga. The terminal portion 92Ga extends vertically to short sides of the transmission blades 96BL1 and 96BL2. Thereby, as shown in FIG. 57 in enlarged dimension, the opposite ends of the terminal portion 92Ga are exposed in the interior of the adjacent slit 96Bc, respectively.

On the other hand, at the other end of the ground contact terminal 92G6, a flat enlarged portion is formed, having a fixed terminal section 92*gt* to be fit into the through-hole of the above-mentioned printed wiring board 12. The fixed terminal section 92*gt* is formed at an end of the enlarged portion while extending generally vertical to the extending direction of the above-mentioned terminal portion 92Ga. A part of the ground contact terminal 92G6 between one and the other ends thereof is bent. The bending portion is formed to couple the two horizontal parts having the height difference by a slant.

A shape of a contact terminal 92G5 disposed above the contact terminal 92G6 while being adjacent thereto and those of other contact terminal 92G4 disposed further above the former are similar to that of the contact terminal 92G6. The ground contact terminal 92G3 has no bending portion such as in the ground contact terminal 92G4 but is formed to encircle the ground contact terminal 92G4. Shapes of the ground contact terminals 92G1 to 92G3 are similar to each other.

Regarding the line lengths of the ground contact terminals 92G1 to 92G6, that of the ground contact terminal 92G6 is defined to be a minimum value, and that of the ground contact terminal 92G1 is defined to be a maximum value. The line length of the ground contact terminal 92G5 is defined to be longer than that of the ground contact terminal 92G6, and that of the ground contact terminal 92G4 is defined to be longer than that of the ground contact terminal 92G5. Further, the line length of the ground contact terminal 92G3 is defined to be longer than that of the ground contact terminal 92G4. And, the line length of the ground contact terminal 92G2 is defined to be longer than that of the ground contact terminal 92G3. Thereby, when the ground contact terminals 92G1 to 92G6 are arranged in a common plane in the order of the line lengths starting from the shortest one, the ground contact terminal having the relatively shorter line length is encircled by that having the relatively longer line length.

FIG. 60 illustrates a socket contact 100 disposed in a socket section (not shown) electrically connected to the contact units 88Bi when the respective contact units 88Bi are mounted to the cell 10S1 of the casing 10C for the plug section 10. Note that the socket section has the same structure as that of the socket section 14 in the above-mentioned embodiment.

The socket contact 100 for the one channel signal path is of a micro-strip structure (wherein a differential pair signal line is provided on the ground plate), including a ground contact terminal 94 and a signal contact unit 98 having signal contact terminals 98*ai* and 98*bi*.

Figure 62:
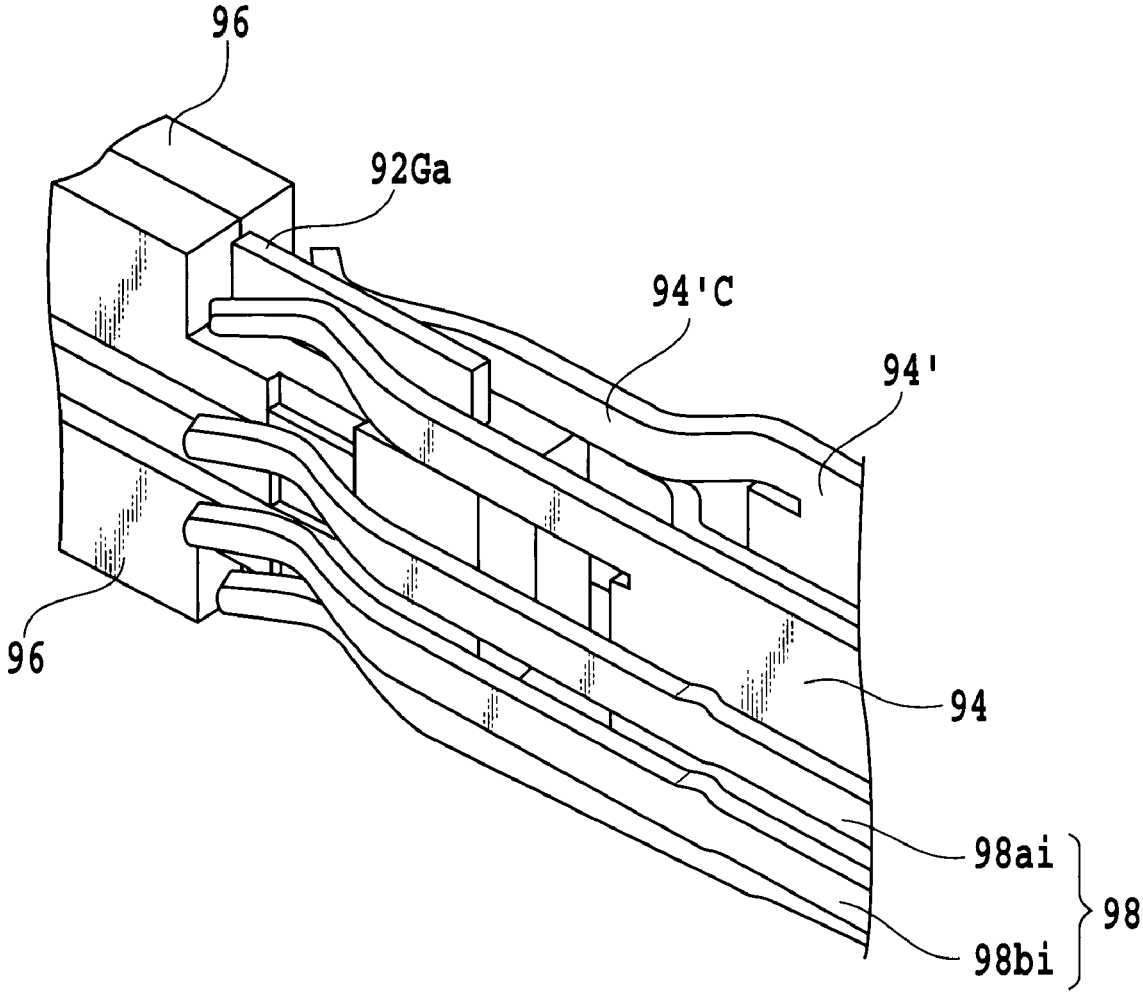
FIG. 62 is a perspective view illustrating a state wherein the socket contacts shown in FIG. 60 are combined facing each other.
Figure 63:
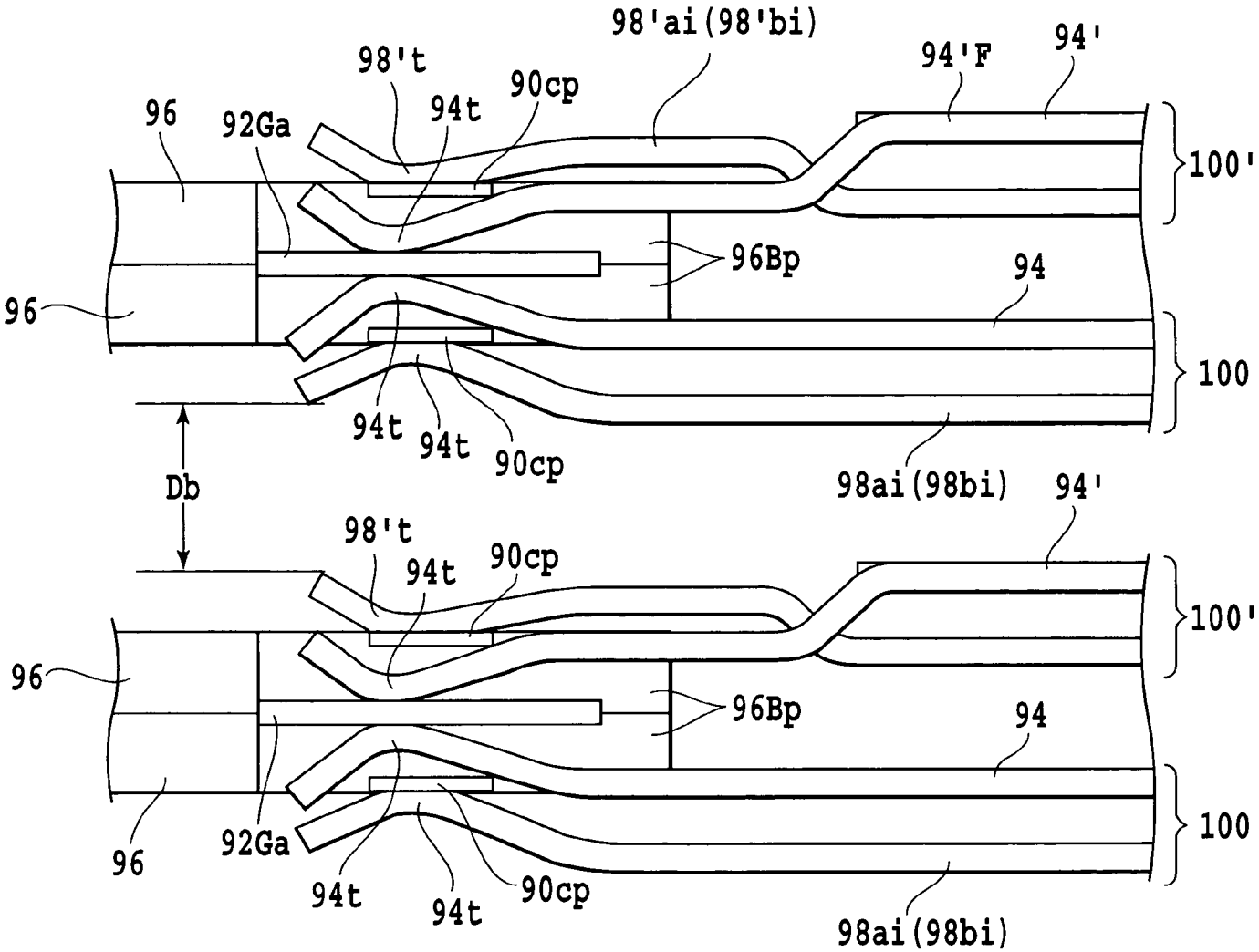
FIG. 63 is a plan view of the embodiment shown in FIG. 62.

As shown in FIGS. 62 and 63 in enlarged dimension, socket contacts 100 and 100' are opposed to each other in a case of a 2-channel signal path wherein a pair of contact pads 90*cp* disposed on the opposite surfaces of a single contact unit 88Bi and a terminal portion 92Ga exposed in the respective slit 96Bc.

In FIG. 63, while the fixed section 94F of the ground contact terminal 94 are provided at a position nearer to the terminal portion 92Ga in comparison with the signal contact terminals 98*ai* and 98*bi* in the socket contact 100, the fixed section 94'F of the ground contact terminal 94' are provided at a position farther from the terminal portion 92Ga in comparison with the signal contact terminals 98*'ai* and 98*'bi*.

As shown in FIG. 60, the ground contact terminal 94 includes a terminal section 94C having a contact part 94*t* in contact with the terminal portion 92Ga of the contact unit 88Bi, a fixed terminal part 94*gt* fixed to the conductor of the printed wiring board, and a fixing part 94F coupling the terminal section 94C to the fixed terminal part 94*gt*, when the ground contact terminal 94 is connected to the plug section 10. The ground contact terminal 94 inserted into the slit of the socket section is positioned and held by locking means (not shown) formed within the slit.

The signal contact terminal 98*ai* includes a terminal section 98Ca having a contact part 98*t* in contact with the contact pad 90*cp* in the contact unit 88Bi, a crook 98Ea having a terminal part 98*tb* in contact with the printed wiring board, and a fixing part 98Fa coupling the terminal part 98Ca to the crook 98Ea, when the signal contact terminal 98 is connected to the plug section 10. The terminal part 98Ca and the fixed terminal part 98*tb* are elastically deformable.

The signal contact terminal 98*bi* includes a terminal section 98Cb having a contact part 98*t* in contact with the contact pad 90*cp* in the contact unit 88Bi, a crook 98Eb having a terminal part 98*tb* in contact with the printed wiring board, and a fixing part 98Fb coupling the terminal part 98Cb to the crook 98Eb, when the signal contact terminal 98*bi* is connected to the plug section 10. The terminal part 98Cb and the fixed terminal part 98*tb* are elastically deformable.

Thereby, the socket contacts 100 and 100' are arranged in the respective slits of the socket section at a predetermined interval in the longitudinal direction of the projections. When ends of the contact units 88Bi are inserted into gaps between the respective socket contacts 100 and 100' adjacent to each other in the arrangement direction of the slits, they are nipped by the elastic force of a plurality of terminal sections 94C and 94'C and the terminal sections 98Ca and 98Cb. At that time, as described later, a crosstalk between the adjacent signal paths is restricted.

In FIG. 63, in the adjacent contact units 88Bi, a distance Db between a tip end of the signal socket contact terminal 98*ai* (98*bi*) in the socket contact 100 and a tip end of the signal socket contact terminal 98*'ai* (98*'bi*) is defined to be, for example, approximately 1.32 mm. On the other hand, a distance Da between tip ends of the signal contact terminals 52 in the adjacent socket contacts 56 shown in FIG. 31 is defined to be approximately 0.26 mm. Accordingly, since it is possible to define the distance Db to be larger than the distance Da, the embodiment shown in FIG. 63 is more advantageous in view of the reduction of crosstalk. At that time, the distance between the adjacent signal contact terminals 98*ai* and 98*'ai* becomes shorter. However, since the terminal portion 92Ga and the ground contact terminal 94 extend between the signal contact terminals 98*ai* and 98*'ai*, the crosstalk between the signal paths therebetween is also restricted.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A high speed transmission connector comprising:

a contact unit including a ground blade and a transmission blade, the transmission blade being disposed on the ground blade;

a plug section having a casing for accommodating said contact unit in a detachable manner; and a socket section for connection to said contact unit, wherein the ground blade includes two ground terminal sections, the transmission blade includes two high speed transmission paths, the two high-speed transmission paths being adjacent to one another and including connection ends, the connection ends of the two high speed transmission paths lie between the two ground terminal sections; and a surface on each of the connection ends of the two high speed transmission paths and a surface on each of the ground terminal sections lie in a common plane.

2. A high speed transmission connector as claimed in claim 1, wherein said two ground terminal sections are formed by bifurcating an end of a ground contact terminal.

3. A high speed transmission connector as claimed in claim 2, wherein said two ground terminal sections are disposed substantially parallel to each other.

4. A high speed transmission connector as claimed in claim 2, wherein said two ground terminal sections are spaced from each other and are substantially parallel to each other.

5. A high speed transmission connector as claimed in claim 1, wherein a predetermined gap is formed between said two high speed transmission paths and an inner surface of said casing of said plug section.

6. A high speed transmission connector as claimed in claim 2, wherein the ground terminal sections are substantially parallel and adjacent to said two high speed transmission paths.

7. A high speed transmission connector as claimed in claim 1, wherein said contact unit is flexible.

8. A high speed transmission connector as claimed in claim 2, wherein a space is formed between a surface of the transmission blade and a surface of the ground contact terminal.

9. A high speed transmission connector as claimed in claim 1, wherein a difference in overall line lengths between said two high speed signal transmission paths is 0.5 mm.

10. A high speed transmission connector as claimed in claim 2, wherein said ground contact terminal and said two high speed signal transmission paths form a micro strip structure.

11. A high speed transmission connector as claimed in claim 1, wherein at least one groove is formed between connection ends of said two high speed signal transmission paths in said contact unit.

12. A high speed transmission connector as claimed in claim 8, wherein two crooks are arranged in a common plane on said transmission blade; said crooks having terminal sections for contacting with the conductor of a wiring board, each of said crooks is coupled to one of said high speed signal transmission paths, and said crooks bias said terminal sections toward the conductor of the wiring board.

13. A high speed transmission connector as claimed in claim 1, wherein the transmission blade is a first transmission blade, and the high speed transmission connector further comprises a second transmission blade.

14. A high speed transmission connector as claimed in claim 13, wherein the first and second transmission blades are disposed on outer surfaces of the ground blade.

15. A high speed transmission connector comprising:

a contact unit including a ground blade and a transmission blade, the transmission blade being disposed on the ground blade;

a plug section having a casing for accommodating said contact unit in a detachable manner; and a socket section having third and fourth high speed signal transmission paths, wherein the ground blade includes first and second ground terminal sections each having a surface disposed in a common plane, the transmission blade includes first and second high speed signal transmission paths each having a connection end with a surface disposed in the common plane, the first and second high-speed transmission paths are adjacent to one another, connection ends of the first and second high speed transmission paths are substantially parallel to the first and second ground terminal sections, the socket section includes third and fourth ground terminal sections, when the socket section is connected to the plug section, the first and second high speed signal transmission paths connect with the third and fourth high speed signal transmission paths, respectively, and when the socket section is connected to the plug section, the first and second ground terminal sections connect with the third and fourth ground terminal sections, respectively.

* * * * *